US007959063B2

(12) United States Patent
McLeod

(10) Patent No.: US 7,959,063 B2
(45) Date of Patent: Jun. 14, 2011

(54) INTEGRATED CARTON LID DESIGNS

(75) Inventor: Michael McLeod, Romeoville, IL (US)

(73) Assignee: Smurfit-Stone Container Enterprises, Inc., Chicago, IL (US)

( * ) Notice: Subject to any disclaimer, the term of this patent is extended or adjusted under 35 U.S.C. 154(b) by 68 days.

(21) Appl. No.: 12/267,378

(22) Filed: Nov. 7, 2008

(65) Prior Publication Data

US 2009/0101701 A1 Apr. 23, 2009

Related U.S. Application Data

(63) Continuation of application No. 10/831,987, filed on Apr. 26, 2004, now Pat. No. 7,484,655.

(51) Int. Cl.
*B65D 5/28* (2006.01)

(52) U.S. Cl. ..... 229/143; 229/147; 229/170; 229/174; 229/918

(58) Field of Classification Search ..... 229/143, 229/147, 169, 170, 171, 174, 180, 915, 918, 229/919

See application file for complete search history.

(56) References Cited

U.S. PATENT DOCUMENTS

| | | | | |
|---|---|---|---|---|
| 2,568,204 | A | 9/1951 | Reeser | |
| 2,603,404 | A | 7/1952 | Eldredge | |
| 2,995,290 | A * | 8/1961 | Swanson et al. | 229/143 |
| 3,019,959 | A | 2/1962 | Skowronski | |
| 4,056,223 | A | 11/1977 | Williams | |
| 4,214,695 | A | 7/1980 | Cooper | |
| 4,319,710 | A * | 3/1982 | Osborne | 229/143 |
| 4,537,344 | A * | 8/1985 | Thomas | 229/169 |
| 4,676,428 | A | 6/1987 | McClure | |
| 4,860,948 | A | 8/1989 | Hofstede | |
| 4,883,221 | A | 11/1989 | Brundage | |
| 5,002,224 | A * | 3/1991 | Muise | 229/169 |
| 5,052,221 | A | 10/1991 | Glöckner et al. | |
| 5,853,120 | A * | 12/1998 | McLeod et al. | 229/169 |
| 5,979,746 | A | 11/1999 | McLeod et al. | |
| 6,481,619 | B1 | 11/2002 | Jackson | |
| 6,935,504 | B2 | 8/2005 | Ritter et al. | |
| 7,314,159 | B2 | 1/2008 | Rochefort et al. | |

FOREIGN PATENT DOCUMENTS

FR 2677956 A1 * 12/1992

* cited by examiner

*Primary Examiner* — Gary E Elkins
(74) *Attorney, Agent, or Firm* — Armstrong Teasdale LLP

(57) ABSTRACT

A plurality of cartons, preferably fabricated from paper, paperboard and/or corrugated paperboard, and particularly of tray or wrapper-style construction, are provided, having integral lid constructions, and outer overlap panels, operably associated with the at least one top panel, to enable articulation of the carton into a substantially completed structure, without interfering with the subsequent articulation of the at least one top panel to enable loading of the carton subsequent to articulation and affixation of the outer overlap panels.

14 Claims, 50 Drawing Sheets

INTEGRATED CARTON LID DESIGNS

CROSS REFERENCE TO RELATED APPLICATIONS

This application is a continuation of prior application Ser. No. 10/831,987, filed Apr. 26, 2004 now U.S. Pat. No. 7,484,655, which is hereby incorporated by reference in its entirety.

BACKGROUND OF THE DISCLOSURE

1. Field of the Invention

The present invention relates in general to cartons fabricated from paper, paperboard and/or corrugated paperboard material, particularly cartons in the form of wrapper or tray type packages.

2. Background Art

Machine formed full overlap carton tray and wraparound carton structures have long been used to contain and ship heavy products, where the stacking strength of the carton is of utmost concern.

However, the overall stacking strength of such a carton can be negatively affected, if the outer, full overlap flap and attached structures are not properly sealed into position, or are damaged prior to sealing.

There are a number of full overlap tray and wrapper type package designs presently in use that fully enclose the product, but are difficult to use due to the outer-full overlap-flaps not being initially sealed at the point of initial carton erecting. This material is attached to the top horizontal flap or flaps of the shipper and extend well beyond the length of the erected carton when the top flap or flaps are upright. For packaging facilities with centralized erecting and sealing areas, this extending material can easily be damaged when the carton is transferred through the facility, which damage may compromise the stacking performance the carton is intended to provide.

In addition, some products may slightly overfill the carton's cavity which can cause the product to extend above the top of the carton, making it difficult to place the top flaps into a horizontal plane, and the outer vertical full overlap flaps properly aligned, which again may compromise the stacking strength of the carton.

Therefore, it would be desirable to provide an alternative carton construction which is less susceptible to loss of stacking strength, due to improper sealing of, or damage prior to sealing of, closure or overlap flaps.

These and other desirable characteristics of the invention will become apparent in view of the present specification, claims and drawings.

SUMMARY OF THE INVENTION

The present invention is directed to a carton, fabricated from at least one of paper, paperboard and corrugated paperboard, and comprising a bottom panel; two outer side panels emanating from opposing side edges of the bottom panel; and two end panels emanating from opposing end edges of the bottom panel. The opposing end edges of the bottom panel preferably extend perpendicular to the opposing side edges of the bottom panel. Two connection panels are associated with respective end edges of each of the two outer side panels, and are affixed, at least indirectly, to inside surfaces of an adjacent one of the two end panels, for maintaining the two end panels and the two end panels in raised, upright orientation relative to the bottom panel. At least two first outer overlap panels emanate, at least indirectly, from top edges of at least one of the side and end panels, respectively, and are placed in overlying relation and affixed to an outer surface of at least one of the end and outer side panels, respectively. At least one top panel emanates from the top edge of the one of the side and end panels from which the at least two first outer overlap panels emanate, at least indirectly. At least two overlap panel connection structures are operably associated with the at least two outer overlap panels and the at least one top panel, for enabling the at least two first outer overlap panels to be affixed in place without interfering with movement of the at least one top panel, to permit the restrained formation and subsequent loading of the carton, subsequent to positioning and affixation of the at least two first outer overlap panels.

In a preferred embodiment of the invention, the at least two overlap panel connection structures comprise at least two top corner panels, emanating from the panel from which the at least one top panel emanates, and contiguously connected to the at least two first outer overlap panels. The at least two overlap panel connection structures may further comprise lines of weakness frangibly connecting the at least one top panel to the at least two top corner panels, whereby upon articulation of the carton, the at least one top panel is disposed in a closed orientation, prior to loading of the carton, and prior to lifting of the at least one top panel and breaking of the connection between the at least one top panel and the at least two top corner panels. Alternatively, the at least two first outer overlap panels may emanate directly from the at least one top panel, with the at least two overlap panel connection structures comprising lines of weakness frangibly connecting the at least one top panel to the at least two first outer overlap panels.

The carton may further comprise a second outer overlap panel emanating from a side edge of each of the at least two outer overlap panels, each second outer overlap panel being folded, relative to its respective first outer overlap panel, and affixed to an outer surface of an adjacent one of the side and end panels, each second outer overlap panel having a height substantially equal to the at least one of the side and end panels to which the second outer overlap panel is affixed.

The carton may further comprise an inner side panel, disposed adjacent to and in overlying relationship to each of the outer side panels, each inner side panel being connected to its respective outer side panel, along at least portions of a top edge region of the outer side panel. Minor flaps may at least indirectly emanate from opposing end edges of each of the inner side panels, the minor flaps being affixed to inside surfaces of the two end panels. The carton may further comprise gusset panels, disposed between the inner side panels and their respective minor flaps, the gusset panels extending diagonally across portions of corner regions of an interior area of the carton. The gusset panels may be substantially rectangular. Alternatively, the gusset panels may be substantially triangular.

The carton may further comprise minor flaps, at least directly emanating from opposing end edges of each of the outer side panels, the minor flaps being affixed to inside surfaces of the two end panels. The carton may further comprise gusset panels, disposed between the outer side panels and their respective minor flaps, the gusset panels extending diagonally across portions of corner regions of an interior area of the carton. The gusset panels may be substantially rectangular. Alternatively, the gusset panels may be substantially triangular.

The carton may further comprise stacking tabs, emanating upwardly from at least one of the outer side panels, the end panels; and stacking tab receiving apertures, disposed in at least one of the bottom panel, bottom edge regions of the outer side panels, bottom edge regions of the end panels.

The carton may further comprise at least one top side closure flap, emanating from a side edge of the at least one top panel, and configured to be adhered to an outer surface of an outer side panel. A cut-out region may be disposed in each of the at least two first overlap panels for enabling the at least one top side closure flap to make direct contact with an outer surface of an outer side panel.

The carton may further comprise at least one top front closure flap, emanating from a front edge of the at least one top panel, and configured to be adhered to an outer surface of an end panel.

The at least one top panel may comprise two top panels emanating from top edges of opposing ones of the side and end panels.

The carton may further comprise stacking tabs, emanating upwardly from at least one of the outer side panels, the end panels, the stacking tabs including notches operably configured to engage side edge regions of the at least one top panel. Alternatively, the carton may further comprise stacking tabs, emanating upwardly from at least one of the outer side panels, the end panels. These stacking tabs may include notches operably configured to engage side edge regions of the at least one top panel. Apertures may be disposed in the at least one top panel, for receiving the stacking tabs, when the at least one top panel is in a closed position.

The carton may further comprise an extension of the at least one top panel, extending into the one of the side and end panels from which the top panel emanates; and a frangible line of weakness separating the extension from remaining portions of the one of the side and end panels, for enabling separation of the at least one top panel from the one of the side and end panels.

The at least one top panel may further comprise inner and outer top panel members foldably connected to one another.

The carton may further comprise venting apertures disposed in at least one of the two outer side panels, the end panels, the bottom panel, the at least one top panel.

The carton may further comprise at least one hand hole disposed on at least one of the two outer side panels, the end panels.

The two connection panels may each have a height substantially equal to the inside surfaces of the adjacent one of the two end panels to which the two connection panels are affixed.

The at least two first outer overlap panels may each have a height substantially equal to the at least one of the end and outer side panels to which the at least two outer overlap panels are affixed.

DETAILED DESCRIPTION OF THE INVENTION

Figure 1:
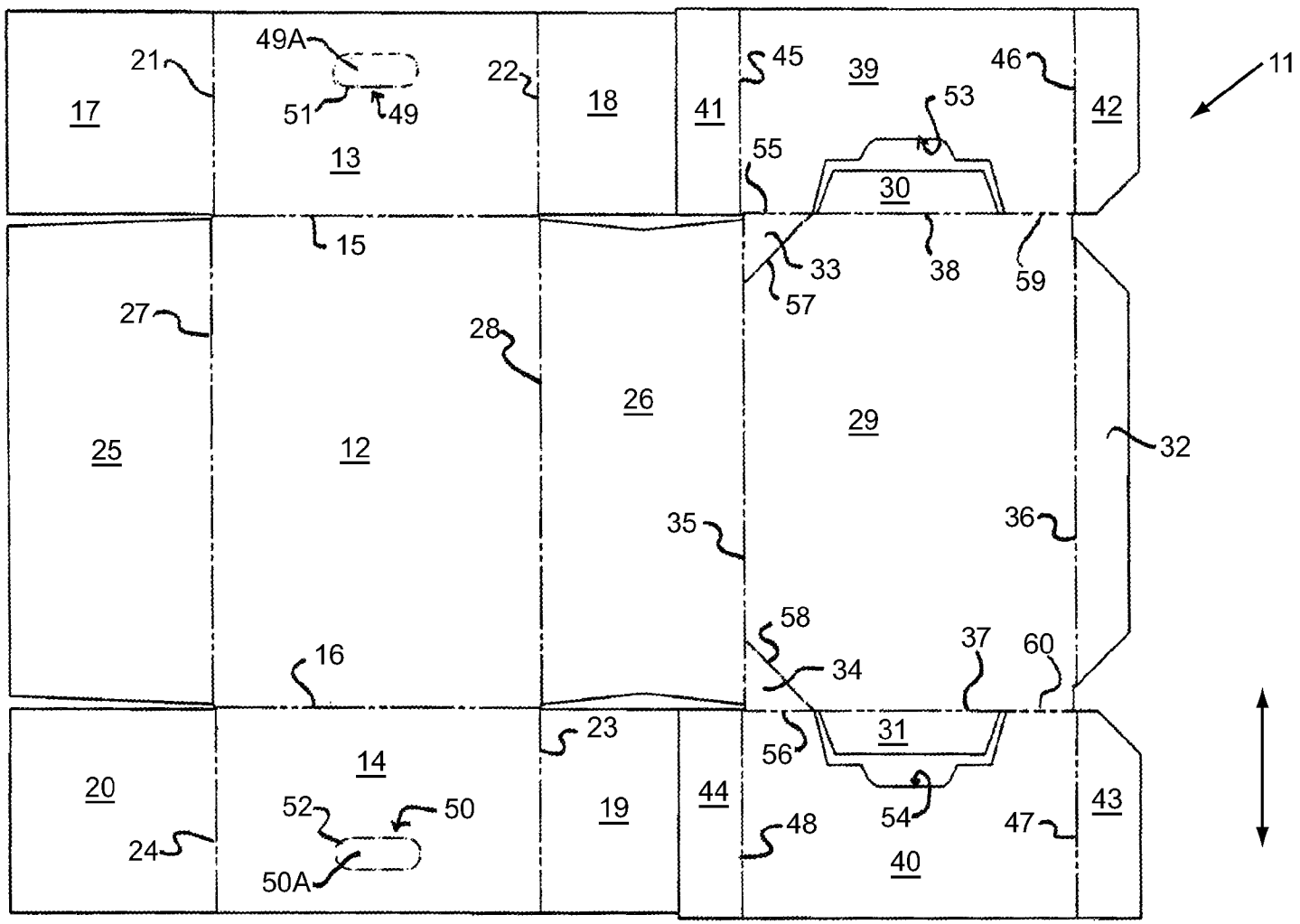
FIG. 1 is a plan view of a blank of a carton with integrated lid according to a preferred embodiment of the invention.

While this invention is susceptible of embodiment in many different forms, there is shown in the drawings and will herein be described in detail, a preferred embodiment with the understanding that the present disclosure should be considered as an exemplification of the principles of the invention and is not intended to limit the invention to the embodiment so illustrated.

The cartons of the present invention are preferably fabricated from paper, paperboard and/or corrugated paperboard, although other materials having similar performance characteristics may be employed, as desired or dictated by the requirements of a particular application.

When referring to the plan illustrations of the blanks, the usual drawing conventions for illustration of carton blanks fabricated from paper, paperboard and/or corrugated paperboard, as are customarily employed in the art, are applied. That is, unless otherwise noted, broken lines indicate scores, fold lines or other lines of weakness such as perforations; scalloped lines indicate lines of weakness forming a tear strip or similar structure; and solid lines within the interior of, or extending to the edge of, a blank, indicate through-cuts.

Figure 2:
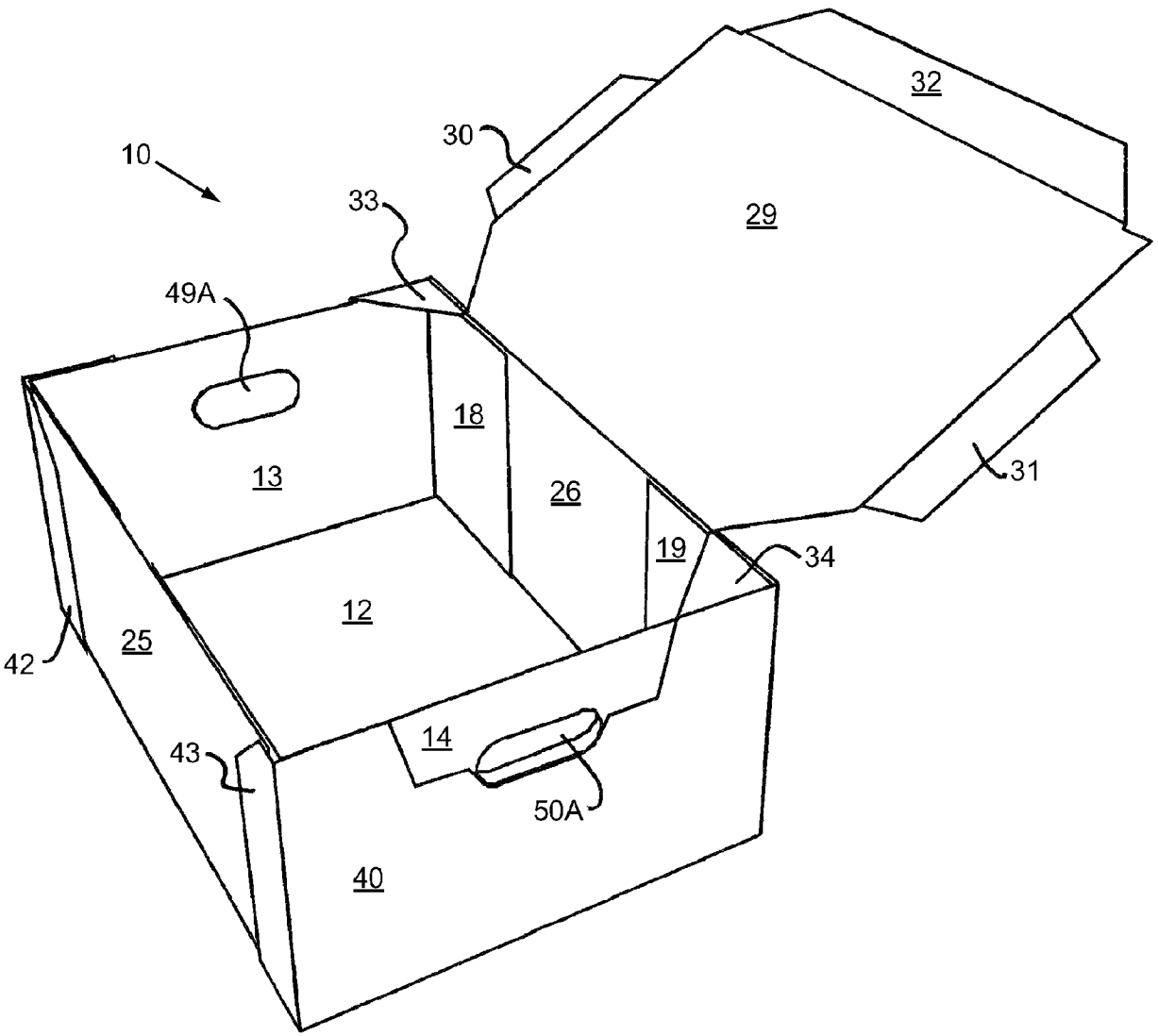
FIG. 2 is a simplified perspective view of a carton with integrated lid according to the embodiment of FIG. 1, shown in its erected configuration, with the top open prior to loading and sealing.

A first embodiment of the invention is illustrated in FIGS. 1 and 2, which features a single top panel. Carton 10 (FIG. 2) is formed from blank 11, which is preferably fabricated from corrugated paperboard, although similarly performing alternative materials may be employed. If corrugated paperboard is employed, the preferred direction of the flutes is indicated by the double-headed arrow in FIG. 1. Blank 11 includes bottom panel 12; side panels 13, 14; fold lines 15, 16; minor flaps 17-20; fold lines 21-24; (front) end panel 25; (rear) end panel 26; fold lines 27, 28; top panel 29; top side closure flaps 30, 31; top front closure flap 32; top corner panels 33, 34; fold lines 35-38; first overlap panels 39, 40; second overlap panels 41-44; and fold lines 45-48.

Inner side panels 13, 14 include hand-holes 49, 50, which are preferably formed by oval perforations 51, 52, to enable the centers 49A, 50A to be pushed out, as desired. Outer side panels 39, 40 include upper edge cutouts 53, 54. In this embodiment, front panel 25 is slightly trapezoidal (although it could be rectangular in alternative embodiments). Rear panel 26 has an hourglass shape, though it too, could be rectangular in alternative embodiments. Blank 11 also includes fold lines 55, 56 and perforations 57, 58, 59, 60.

In order to erect carton 10, side panels 13 and 14 have been folded up perpendicular to bottom panel 12. Minor flaps 17-20 have been folded perpendicular to side panels 13, 14 and may be, if desired, adhered to the inside surfaces of (front) end panel 25 and (rear) end panel 26. First overlap panels 39, 40 have been positioned to the outside of and adhered to side panels 13, 14. First overlap panels 41-44 have been folded perpendicular to first overlap panels 39, 40 and adhered to the outwardly facing surfaces of (front) end panel 25 and (rear) end panel 26.

Because of perforations 57, 58, 59, 60 are maintained intact when the overlap panels are positioned and glued, top panel 29 is initially positioned over the carton opening, parallel to bottom panel 12, but top side closure flaps 30, 31 and top front closure flap 32 are not glued. To place product in carton 10 (if blank 11 was not, in fact formed around a load of product), a worker (or machine) pulls up on top panel 29, breaking perforations 57, 58.

After product has been placed in carton 10, which placement may occur early in the carton erecting process while the carton is wrapped around the load in the usual manner of wrapper type container blanks, top panel 29 is then folded over parallel to bottom panel 12 and then top side closure flaps 30, 31 are folded down and adhered to outwardly facing surfaces of inner side panels 13, 14 and top front closure flap 32 is folded down perpendicular to top panel 29 and adhered to an outwardly facing surface of (front) end panel 25.

Figure 47:
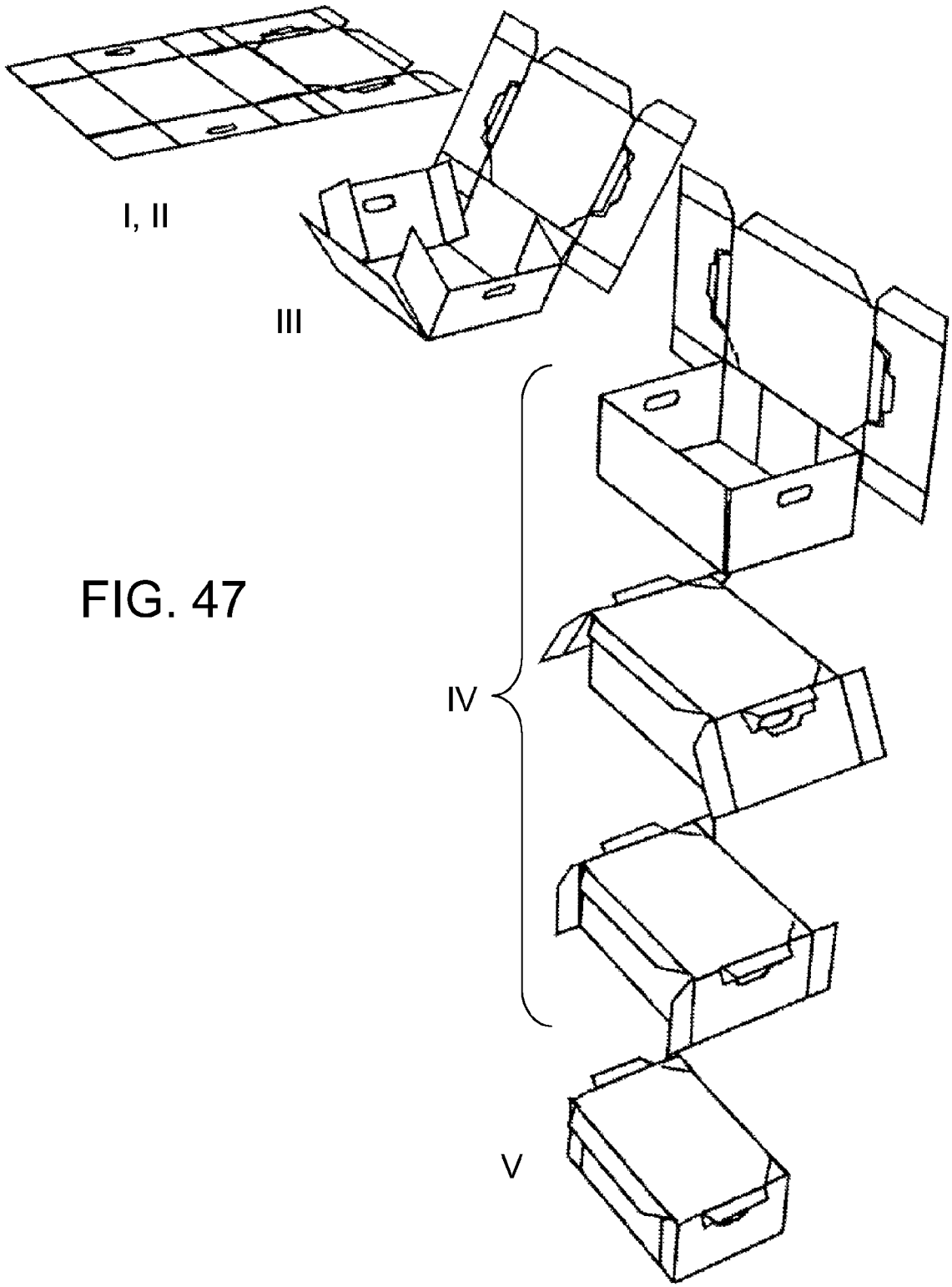
FIG. 47 illustrates the first several steps in a method for forming a package, using the carton blank from FIGS. 1-2.
Figure 48:
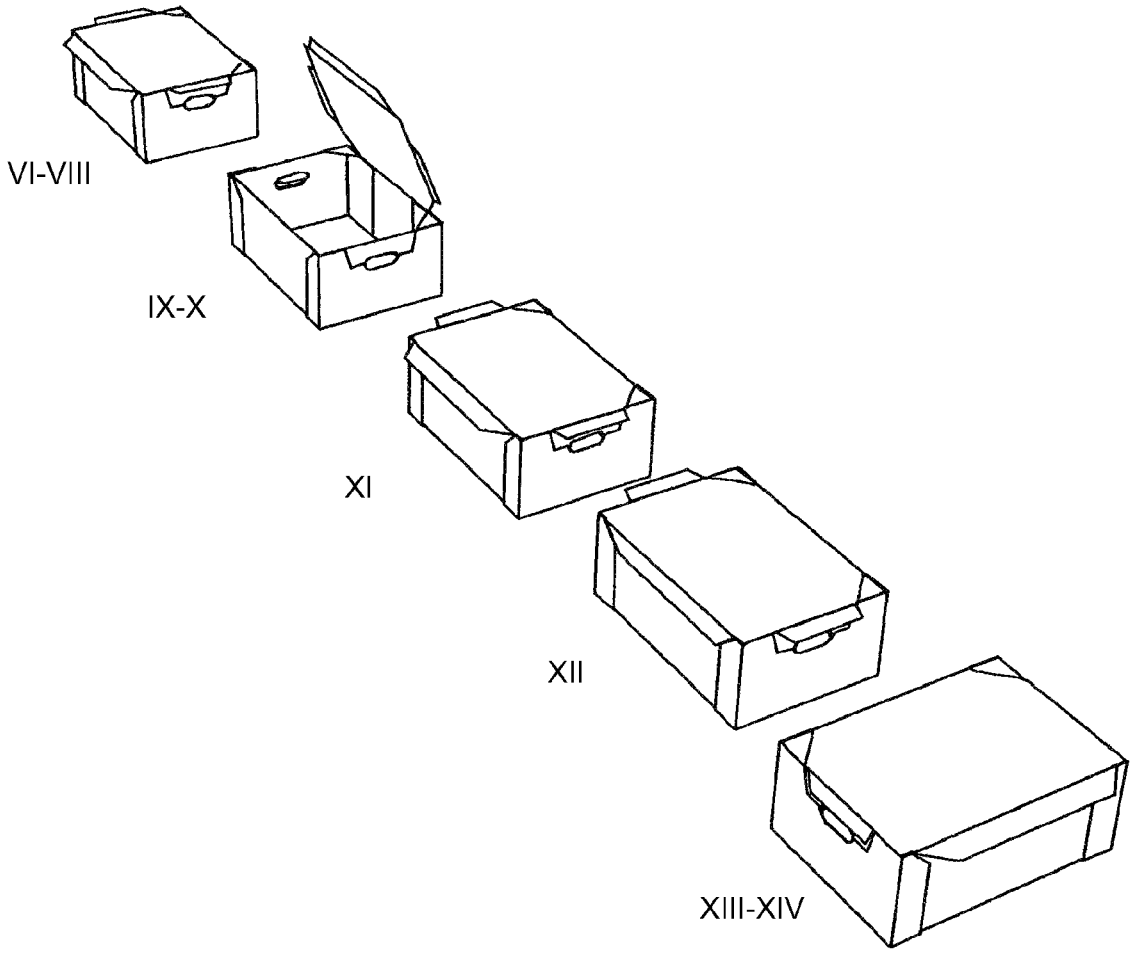
FIG. 48 illustrates the remaining steps in a method for forming a package, using the carton blank from FIGS. 1-2.

FIGS. 47-48 illustrate the steps in a method for setting up a carton, such as may be fabricated from the blank of FIGS. 1-2. These methods may be performed using suitably modified carton forming machinery such as are known in the art, and such modifications may be readily accomplished by one of ordinary skill in the art, having the present disclosure before them. The steps are as follows:

I. A flat blank is indexed into a forming station from the top of a stack of blanks.

II. The blank is then indexed laterally as adhesive is applied to the inside surfaces of the blank, such as on panels 25, 26, 39, 40, 41, 42, 43, 44.

III. A mandrel then pushes the blank down through a forming chamber in the forming station into a compression station.

IV. At a secondary forming station, the top and side panels are folded while the overlap panels are articulated and glued.

V. As a new carton is received in the forming chamber, the just-formed carton is discharged from the compression section onto a powered take-away conveyor.

VI. Formed cartons are pushed down a chute from a case-erecting room located on an upper floor to a production floor of a production facility.

VII. Cartons are moved laterally, e.g., at shoulder height, on a powered belt conveyor, past manual packing stations.

VIII. A worker selects an empty carton from the belt conveyor, and positions the carton at the worker's pack station, e.g., at waist or thigh height.

IX. The top front closure flap is pulled up to open the carton for packing.

X. Product, such as Cryovac™ wrapped meat cuts are packed into the open carton.

XI. The filled carton is pushed forward onto a take-away conveyor to a sealing device, such as an Elliott Top & Side Sealer, a Pearson side flange sealer or a Smurfit-Stone Container Corporation side flange sealer.

XII. The top panel is plowed down and the top front closure flap is sealed with hot melt adhesive.

XIII. The carton is then rotated 90° and the top side closure flaps are sealed with hot melt adhesive.

XIV. Sealed cartons are then transported, e.g., by roller conveyor to a manual palletizing area. Pallet Loads are built, transferred by lift trucks to temporary storage, and then shipped to customers as required.

Figure 3:
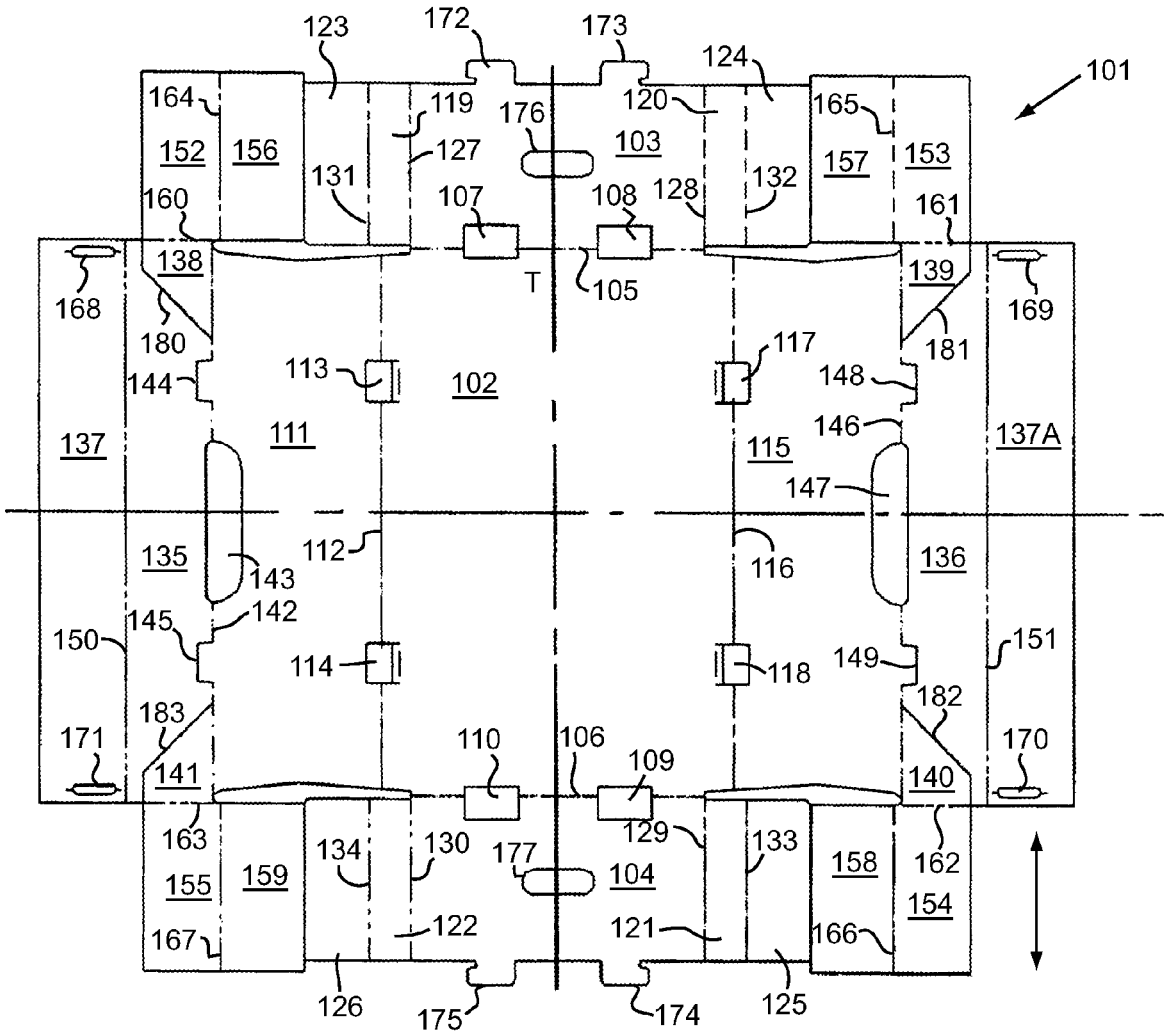
FIG. 3 is a plan view of a blank of a carton with integrated lid according to another preferred embodiment of the invention.
Figure 4:
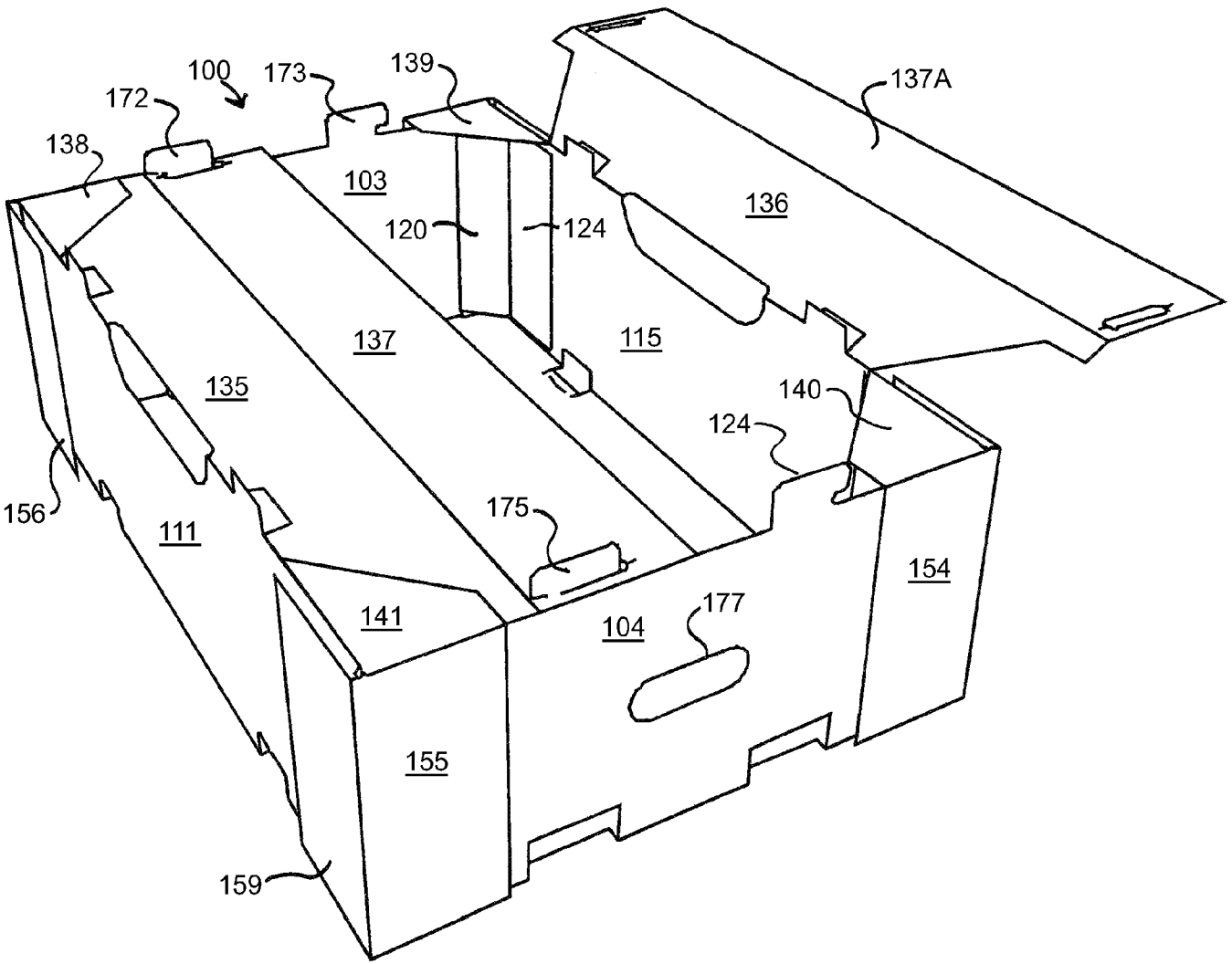
FIG. 4 is a simplified perspective view of a carton with integrated lid according to the embodiment of FIG. 3, shown in its erected configuration, with the top open prior to loading and sealing.

FIGS. 3-4 illustrate an embodiment which features a two panel top. Carton 100 is formed from a blank 101, which is preferably symmetrical about longitudinal axis L and transverse axis T. Again, for a corrugated paperboard blank, the preferred direction of the flutes is indicated by the double arrow in FIG. 3. Blank 101 includes bottom panel 102; side panels 103, 104; fold lines 105, 106, which are interrupted by cutouts 107, 108 and 109, 110, respectively; end panel 111; fold line 112 interrupted by cutouts 113, 114; end panel 115; fold line 116 interrupted by cutouts 117, 118; gusset panels 119-122; minor flaps 123-126; fold lines 127-134; first top panels 135, 136; second top panels 137, 137A; top corner panels 138-141; fold line 142, interrupted by vent hole 143 and die-cut tabs 144, 145; fold line 146, interrupted by vent hole 147 and die-cut tabs 148, 149; fold lines 150, 151; first overlap panels 152-155; second overlap panels 156-159; fold lines 160-167. Blank 102 also includes slots 168-171, which are configured to receive or fit over hooked tabs 172-175, as shown in FIG. 4. Side panels 103, 104 also may include hand holes 176, 177. Separation lines 180-183, between top corner panels 138-141 and first top panels 135, 136 may be perforations or through-cuts. If perforations, upon gluing and folding down of first overlap panels 152-155 and second overlap panels 156-159, first top panels 135, 136 will be in a "closed" position, and will have to be pulled up (in the manner described relative to the embodiment of FIGS. 1-2) to permit loading of the carton, if carton 100 were not already formed around a load.

In forming carton 100, side panels 103 and 104 have been folded perpendicular to bottom panel 102 as have end panel 111 and end panel 115. Minor flaps 124 and 125 have been adhered to the inside surface of end panel 115 while minor flaps 123 and 126 have been adhered to an inner surface of end panel 111 so that gusset panels 119-122 extend diagonally across the corners of the interior of the carton, acting as stacking support structures. (See gusset panel 120 in FIG. 4). In an embodiment in which this carton 100 is wrapped around a load, after the load has been placed and the front rear and side panels have been folded up, the first and second top panels 135-137A may be folded over. In particular, corner panels 138-141 are folded over to positions parallel to bottom wall 102. Then, first overlap panels 152-155 are folded down to positions parallel to and the outside surfaces of side panels 103, 104. Second overlap panels 156-159 are then folded perpendicular to first overlap panels 152-155 and adhered to outwardly facing surfaces of end panel 111 and end panel 115. Carton 100 is a self-locking carton, in that stacking tabs 172-175 are provided with notches which engage end edge regions of slots 168-171 of second top panels 137 and 137A.

Figure 5:
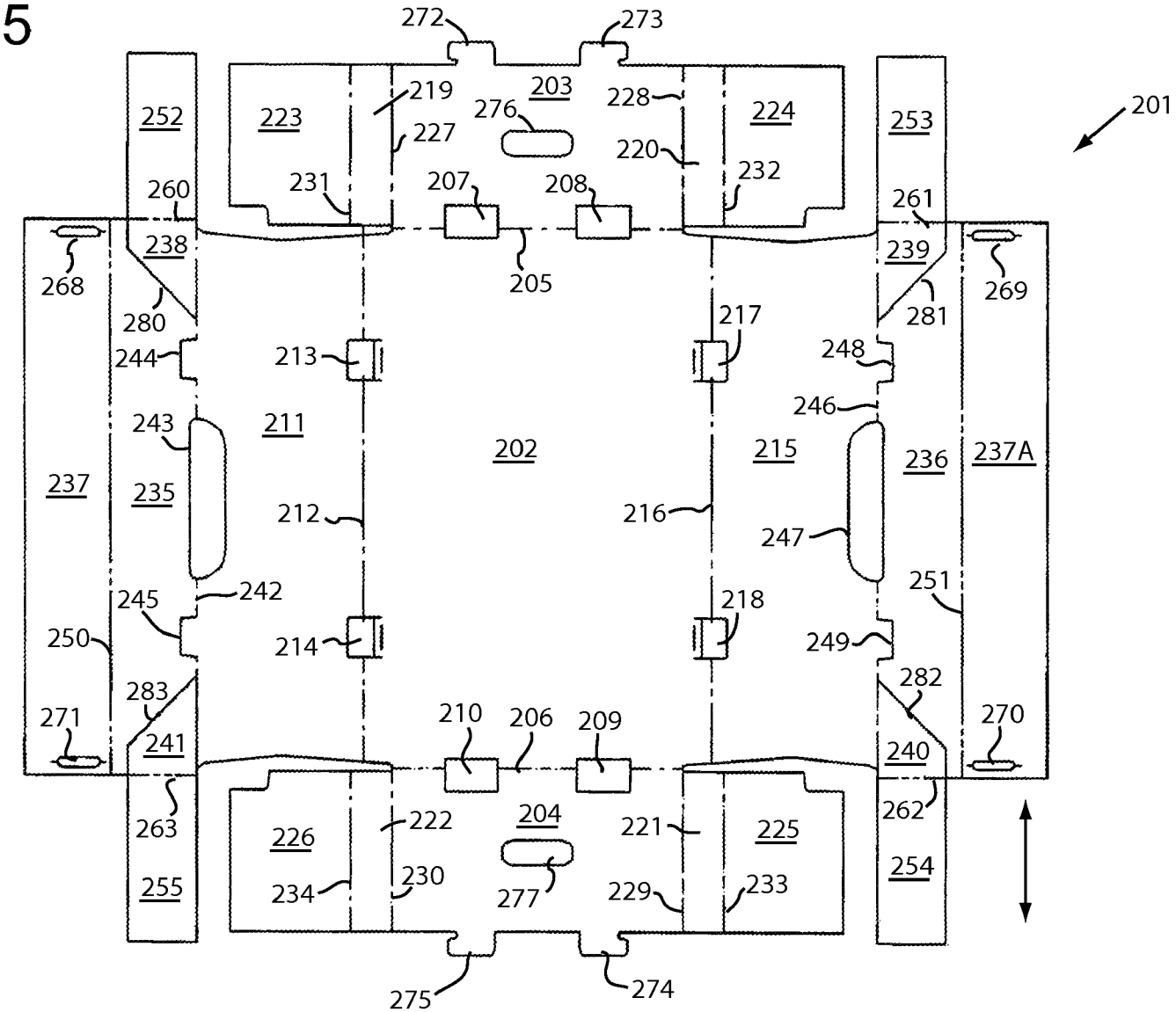
FIG. 5 is a plan view of a blank of a carton with integrated lid according to another preferred embodiment of the invention.
Figure 6:
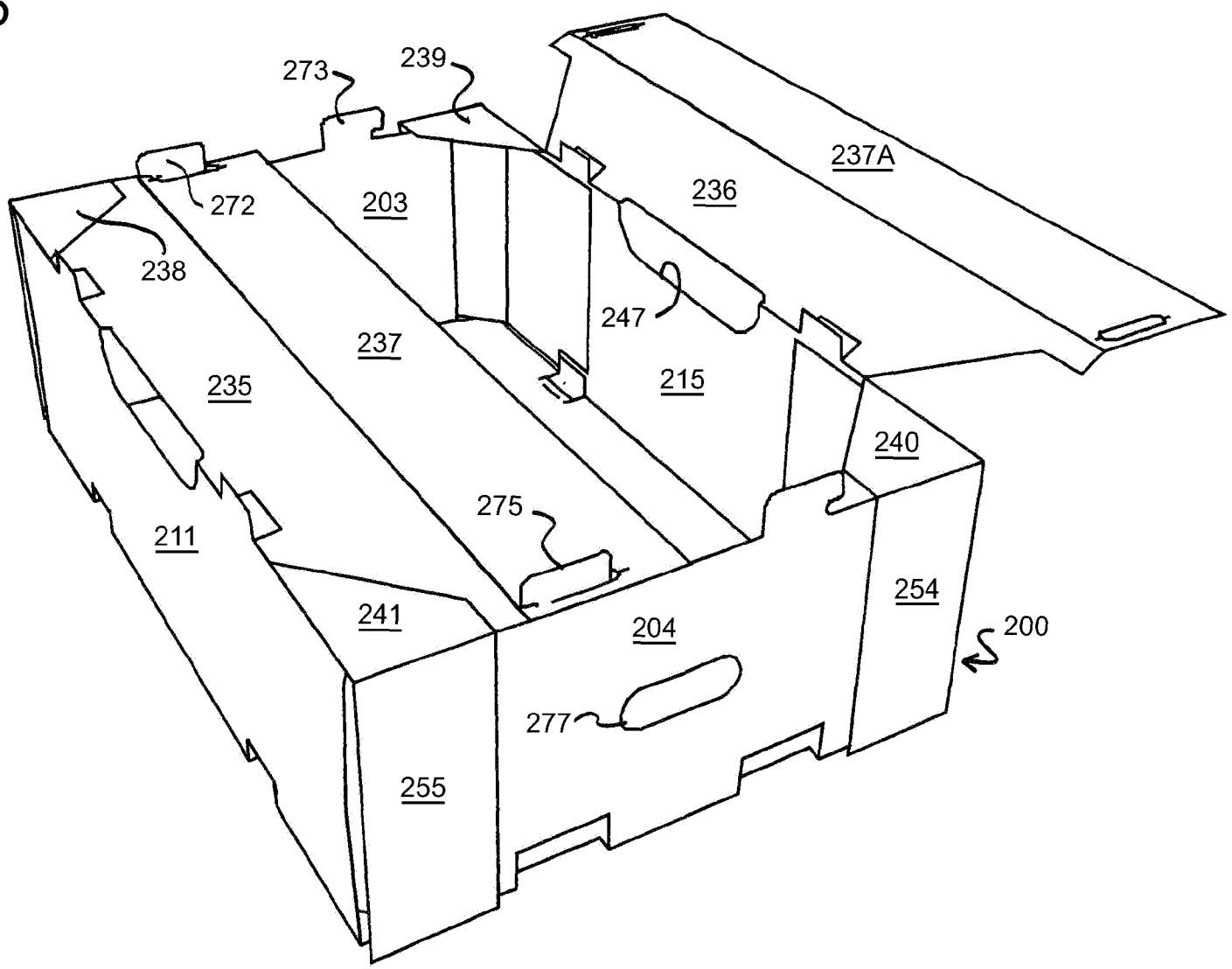
FIG. 6 is a simplified perspective view of a carton with integrated lid according to the embodiment of FIG. 5, shown in its erected configuration, with the top open prior to loading and sealing.

FIGS. 5-6 illustrate an embodiment which features a two panel top. Carton 200 is formed from a blank 201, which is preferably bilaterally symmetrical, in the manner of the embodiment of FIGS. 3 and 4. Again, for a corrugated paperboard blank, the preferred direction of the flutes is indicated by the double arrow in FIG. 5. Blank 201 includes bottom panel 202; side panels 203, 204; fold lines 205, 206, which are interrupted by cutouts 207, 208 and 209, 210, respectively; end panel 211; fold line 212 interrupted by cutouts 213, 214; end panel 215; fold line 216 interrupted by cutouts 217, 218; gusset panels 219-222; minor flaps 223-226; fold lines 227-234; first top panels 235, 236; second top panels 237, 237A;

top corner panels 238-241; fold line 242, interrupted by vent hole 243 and die-cut tabs 244, 245; fold line 246, interrupted by vent hole 247 and die-cut tabs 248, 249; fold lines 250, 251; overlap panels 252-255; fold lines 260-263. Blank 202 also includes slots 268-271, which are configured to receive or fit over hooked tabs 272-275, as shown in FIG. 6. Side panels 203, 204 also may include hand holes 276, 277, and separation lines 280-283, which as in the embodiment of FIGS. 3-4, may be perforations or through-cuts, with the corresponding modes of operation as discussed in that embodiment.

Carton 200 of FIGS. 5 and 6 is erected and affixed to itself in substantially the same manner as the carton of FIGS. 3-4, except that since there are only overlap panels 252-255, they must be adhered to outer facing surfaces of side panels 203, 204, to be held in place there. The closure of the top panels is accomplished in the same manner as in the embodiment of FIGS. 3-4.

Figure 7:
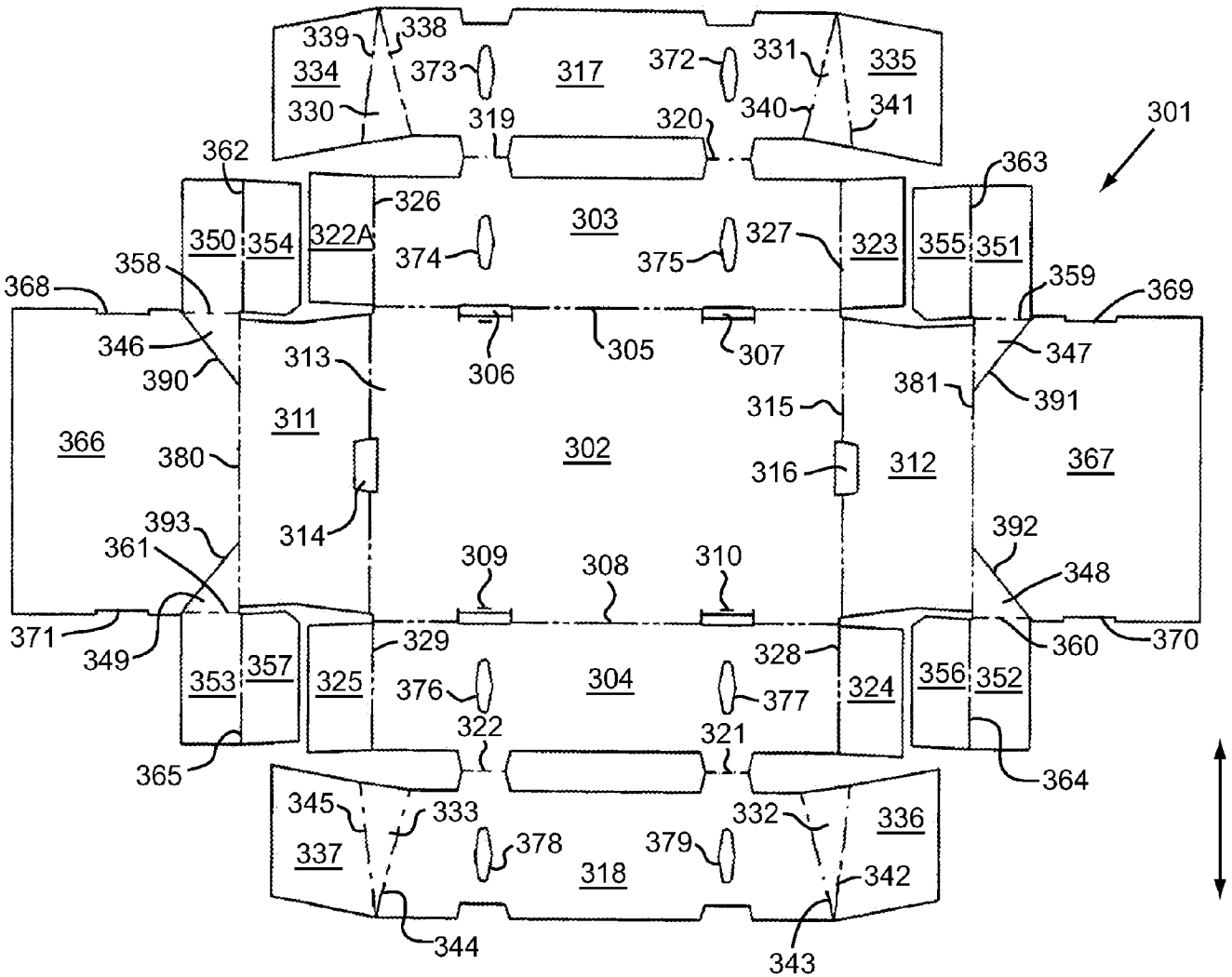
FIG. 7 is a plan view of a blank of a carton with integrated lid according to another preferred embodiment of the invention.
Figure 8:
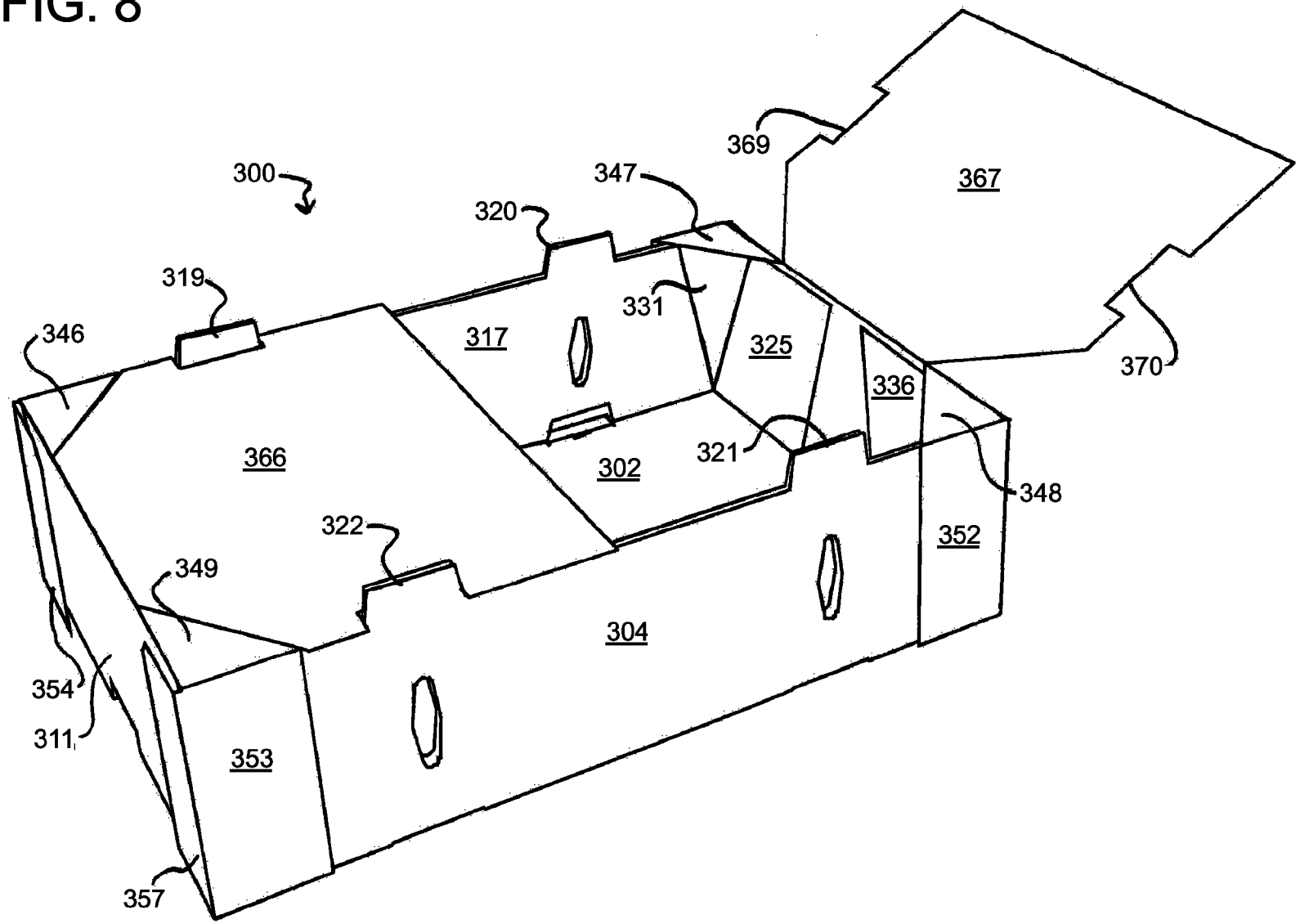
FIG. 8 is a simplified perspective view of a carton with integrated lid according to the embodiment of FIG. 7, shown in its erected configuration, with the top open prior to loading and sealing.

FIGS. 7 and 8 illustrate a covered tray with integral lid structure. Again, for a corrugated paperboard blank, the preferred direction of the flutes is indicated by the double arrow in FIG. 7. Tray 300 is formed from blank 301 (preferably bilaterally symmetrical), which includes bottom panel 302; outer side panels 303, 304; fold line 305 interrupted by die-cut slots 306, 307; fold line 308 interrupted by die-cut slots 309, 310; end panels 311, 312; fold line 313 interrupted by vent hole 314; fold line 315 interrupted by vent hole 316; inner side panels 317, 318; web fold lines 319-322; minor flaps 322A-325; fold lines 326-329; gusset panels 330-333; inner side panel minor flaps 334-337; fold lines 338-345; top corner panels 346-349; first overlap panels 350-353; second overlap panels 354-357; fold lines 358-361; fold lines 362-365; top panels 366, 367; notches 368-371; vent holes 372-379; and fold lines 380-381. In addition, blank 301 includes separation lines 390-393, which may be perforations or through-cuts, as in the embodiment of FIGS. 1-2, with similar modes of operation as discussed. When the inner side panels are folded in, the webs that connect the inner side panels and the outer side panels form stacking tabs, the top edges of which are defined by the fold lines 319-322.

Covered tray 300 is formed by folding up outer side panels 303, 304 perpendicular to bottom panel 302 while folding up end panels 311, 312 perpendicular to bottom 302. Inner side panel minor flaps 322A-325 are adhered to inside surfaces of end panels 311 and 312, while panels 334-337 are adhered to inside surfaces of minor flaps 322A-325, so that gusset panels 330-333 are positioned spanning the corners of the interior of the carton. Triangular top panels 346-349 are folded to positions over the corners of the carton parallel to bottom panel 302 to enable first overlap panels 350-353 to be folded down over the outside surfaces of and adhered to, if desired, to outer side panels 303, 304. Second overlap panels 354-357 are folded perpendicular to first overlap panels 350-353 and adhered to outer surfaces of end panels 311, 312. Top panels 366, 367 are then folded down parallel to bottom panel 302 so that notches 368-371 fit along the inside surfaces of the stacking tabs formed by the webs connecting outer side panels 303, 304 with their respective inner side panels 317, 318. Panels 317, 318 are folded over 180 degrees to be located parallel and to the inside of panels 303 and 304, so that the two sets of inner and outer minor flaps overlap one another, with the inner minor flaps not contacting the outer walls of the container.

Figure 9:
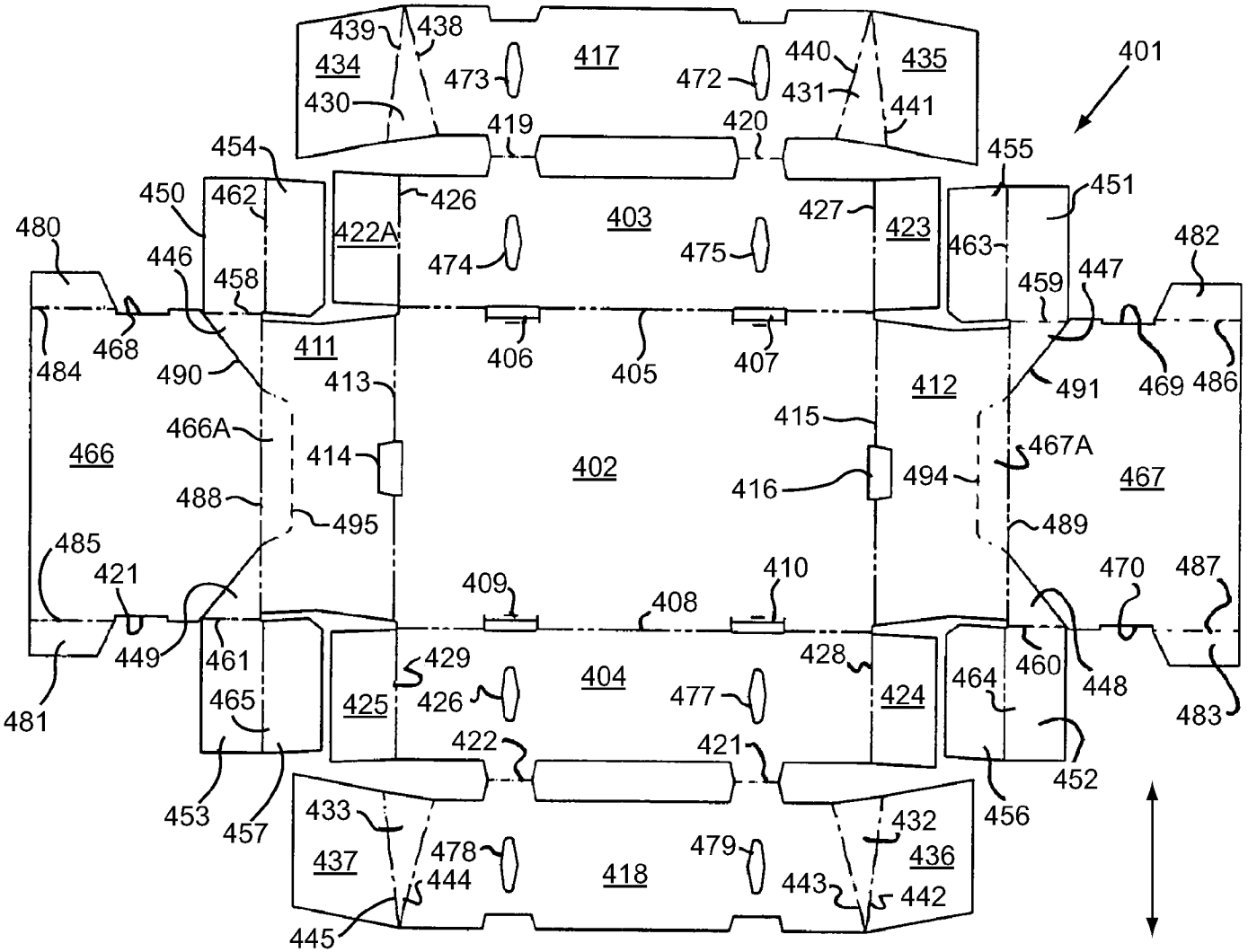
FIG. 9 is a plan view of a blank of a carton with integrated lid according to another preferred embodiment of the invention.
Figure 10:
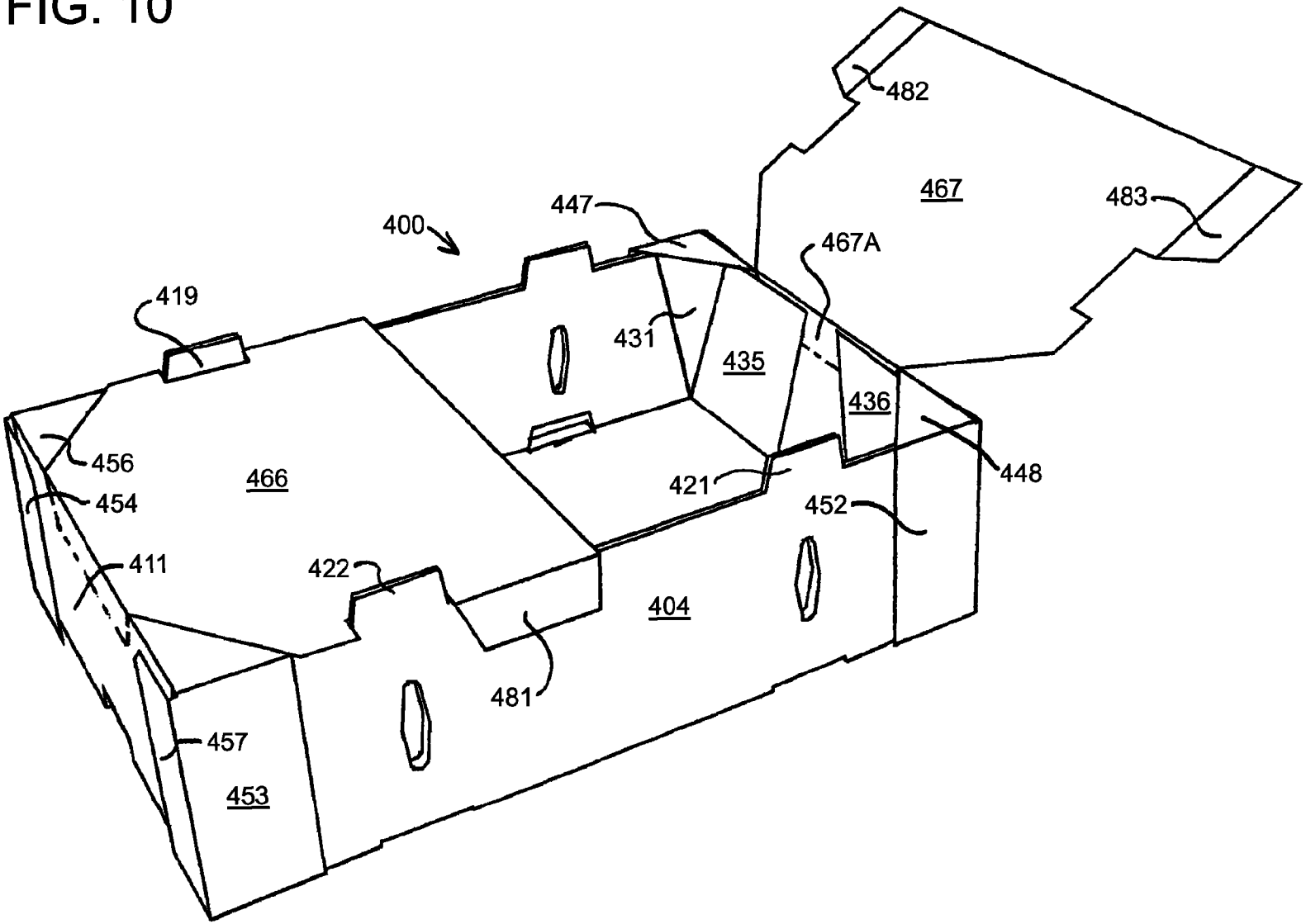
FIG. 10 is a simplified perspective view of a carton with integrated lid according to the embodiment of FIG. 9, shown in its erected configuration, with the top open prior to loading and sealing.

FIGS. 9 and 10 illustrate a covered tray with integral lid structure. For a corrugated paperboard blank, the preferred direction of the flutes is indicated by the double arrow in FIG. 9. Tray 400 is formed from blank 401 (preferably bilaterally symmetrical), which includes bottom panel 402; outer side panels 403, 404; fold line 405 interrupted by die-cut slots 406, 407; fold line 408 interrupted by die-cut slots 409, 410; end panels 411, 412; fold line 413 interrupted by vent hole 414; fold line 415 interrupted by vent hole 416; inner side panels 417, 418; web fold lines 419-422; minor flaps 422A-425; fold lines 426-429; gusset panels 430-433; inner side panel minor flaps 434-437; fold lines 438-445; top corner panels 446-449; first overlap panels 450-453; second overlap panels 454-457; fold lines 458-461; fold lines 462-465; top panels 466, 467 with extensions 466A, 467A; notches 468-471; vent holes 472-479; top side closure flaps 480-483; fold lines 484-487; and fold lines 488, 489. When the inner side panels are folded in, the webs that connect the inner side panels and the outer side panels form stacking tabs, the top edges of which are defined by the fold lines 419-422.

Blank 401 further includes separation lines 490, 491 which are preferably continuous perforations. To load carton 400 (if not formed around a load), top panels 466, 467 are pulled up, breaking the perforations of separation lines 490, 491, up to (but preferably not beyond) fold lines 488, 489. After filling, top panels 466, 467 are folded down, and top side closure flaps 480-483 will be glued and folded down. Removal of top panels 466, 467 is accomplished, in part, by tearing along the remaining unbroken perforated portions of separation lines 490, 491.

Carton 400 is formed in substantially the same manner as carton 300 except that for carton 400, blank 401 is provided with additional closure flaps 480-483, which are adhered to outside surfaces of outer side panels 403, 404. In addition, top panels 466, 467 terminate in extensions 466A and 467A, which are defined by perforations 494, 495. Extensions 466A and 467A can be used to open the container, and permit removal of the lid portion.

Figure 11:
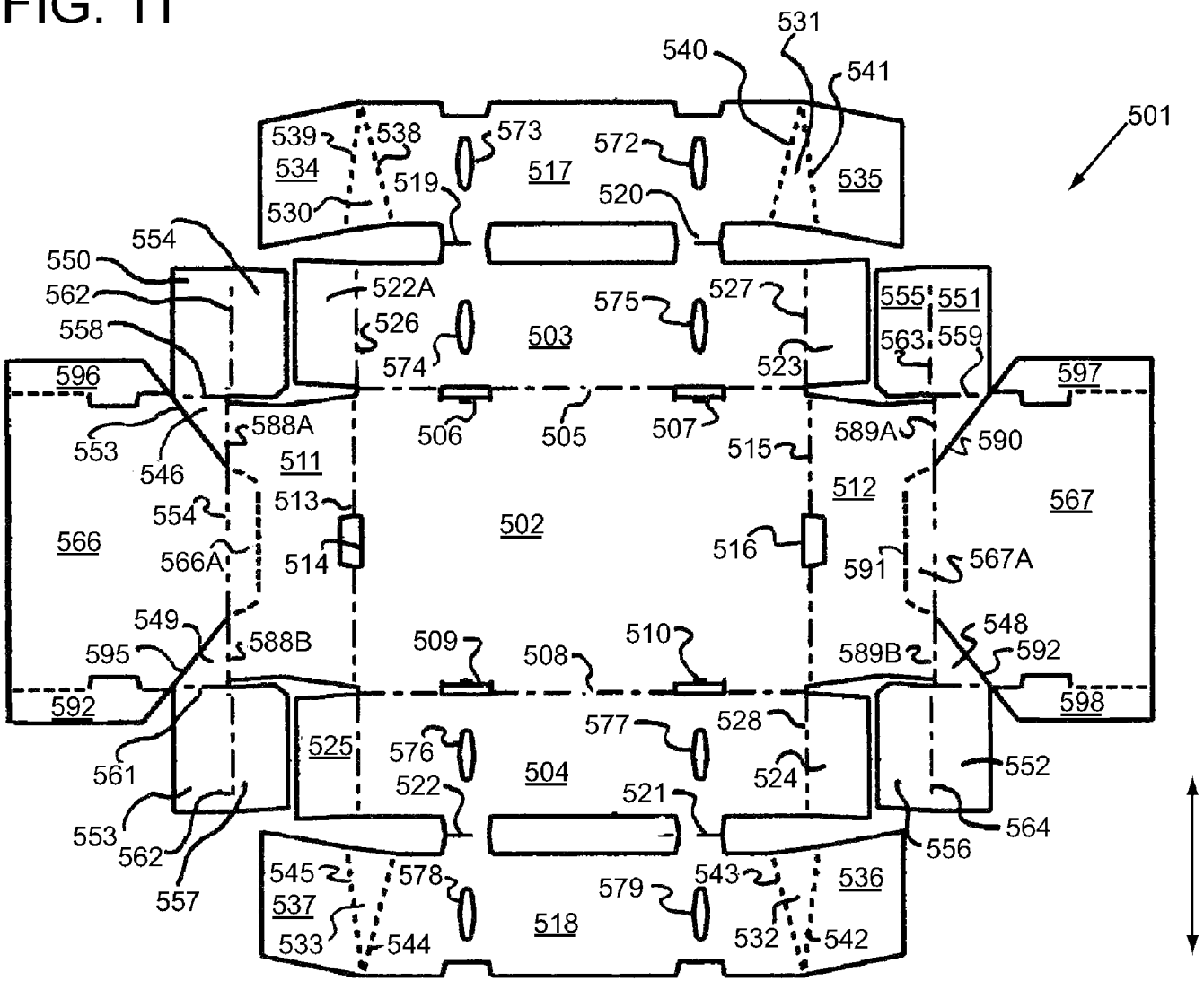
FIG. 11 is a plan view of a blank of a carton with integrated lid according to another preferred embodiment of the invention.
Figure 12:
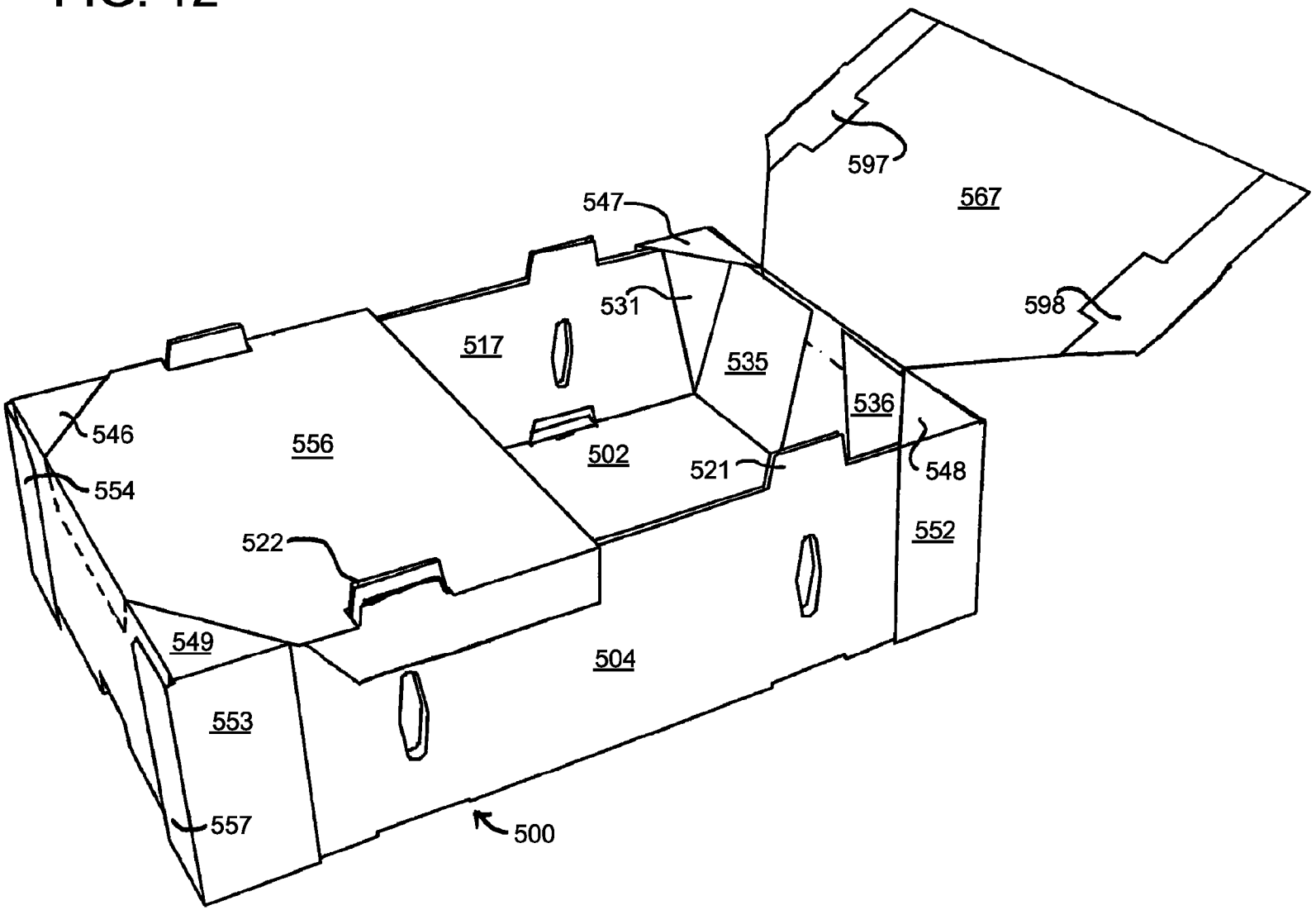
FIG. 12 is a simplified perspective view of a carton with integrated lid according to the embodiment of FIG. 11, shown in its erected configuration, with the top open prior to loading and sealing.

FIGS. 11 and 12 illustrate a covered tray, similar to tray 400. Tray 500 is formed from blank 501 (preferably bilaterally symmetrical), which includes bottom panel 502; outer side panels 503, 504; fold line 505 interrupted by die-cut slots 506, 507; fold line 508 interrupted by die-cut slots 509, 510; end panels 511, 512; fold line 513 interrupted by vent hole 514; fold line 515 interrupted by vent hole 516; inner side panels 517, 518; web fold lines 519-522; minor flaps 522A-525; fold lines 526-529; gusset panels 530-533; inner side panel minor flaps 534-537; fold lines 538-545; top corner panels 546-549; first overlap panels 550-553; second overlap panels 554-557; fold lines 558-561; fold lines 562-565; top panels 566, 567 with extensions 566A, 567A; top side closure flaps 596-599 (which when folded, form or expose slots, for fitting over the stacking tabs formed when the inner side panels are folded in against the outer side panels) and fold lines 588A, 588B, 589A, 589B. For a corrugated paperboard blank, the preferred direction of the flutes is indicated by the double arrow in FIG. 11. When the inner side panels are folded in, the webs that connect the inner side panels and the outer side panels form stacking tabs, the top edges of which are defined by the fold lines 519-522. Separation lines 590, 592, 593 and 595 are preferably through-cuts, while separation lines 591, 594 are preferably perforation lines.

Figure 13:
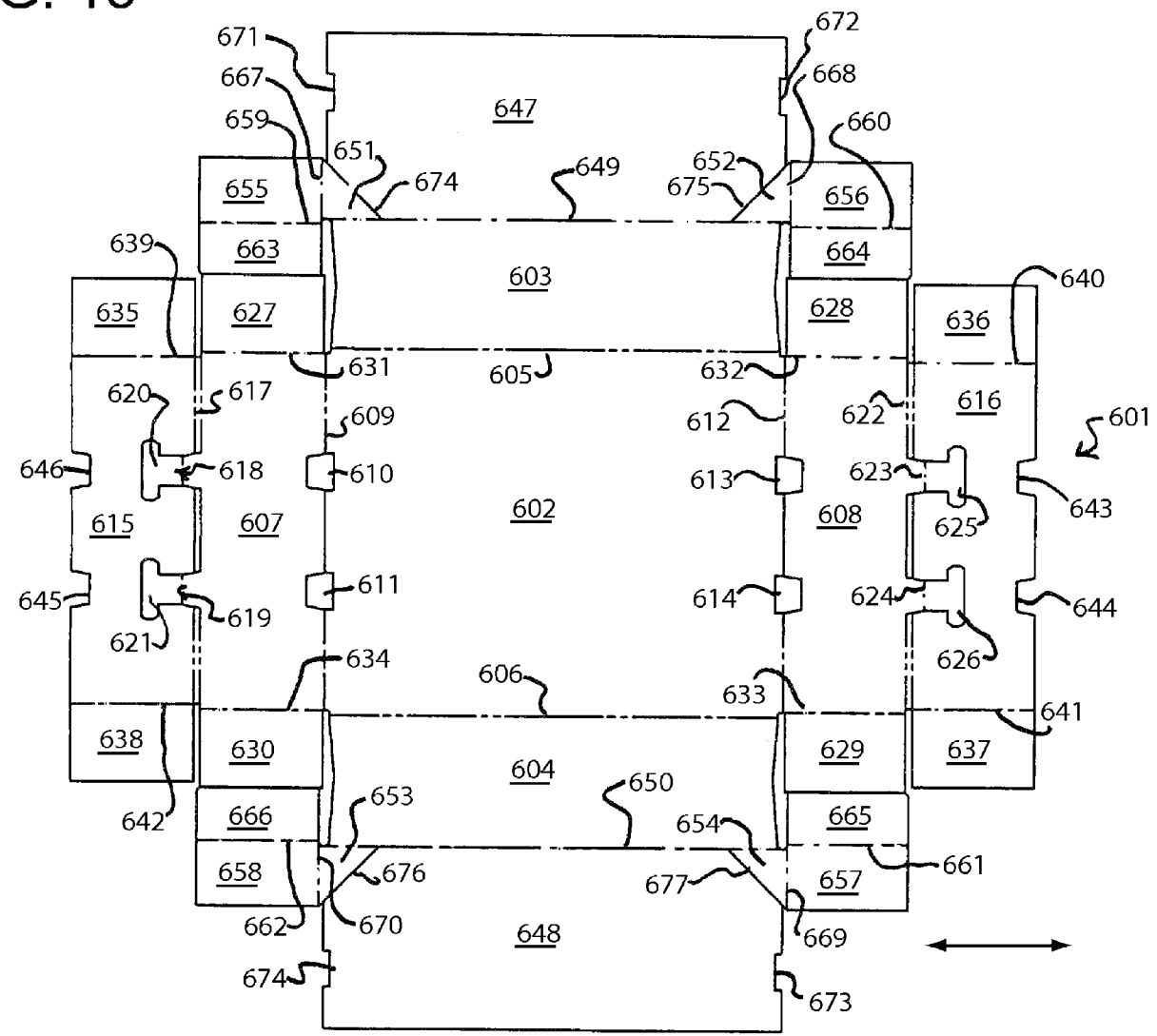
FIG. 13 is a plan view of a blank of a carton with integrated lid according to another preferred embodiment of the invention.
Figure 14:
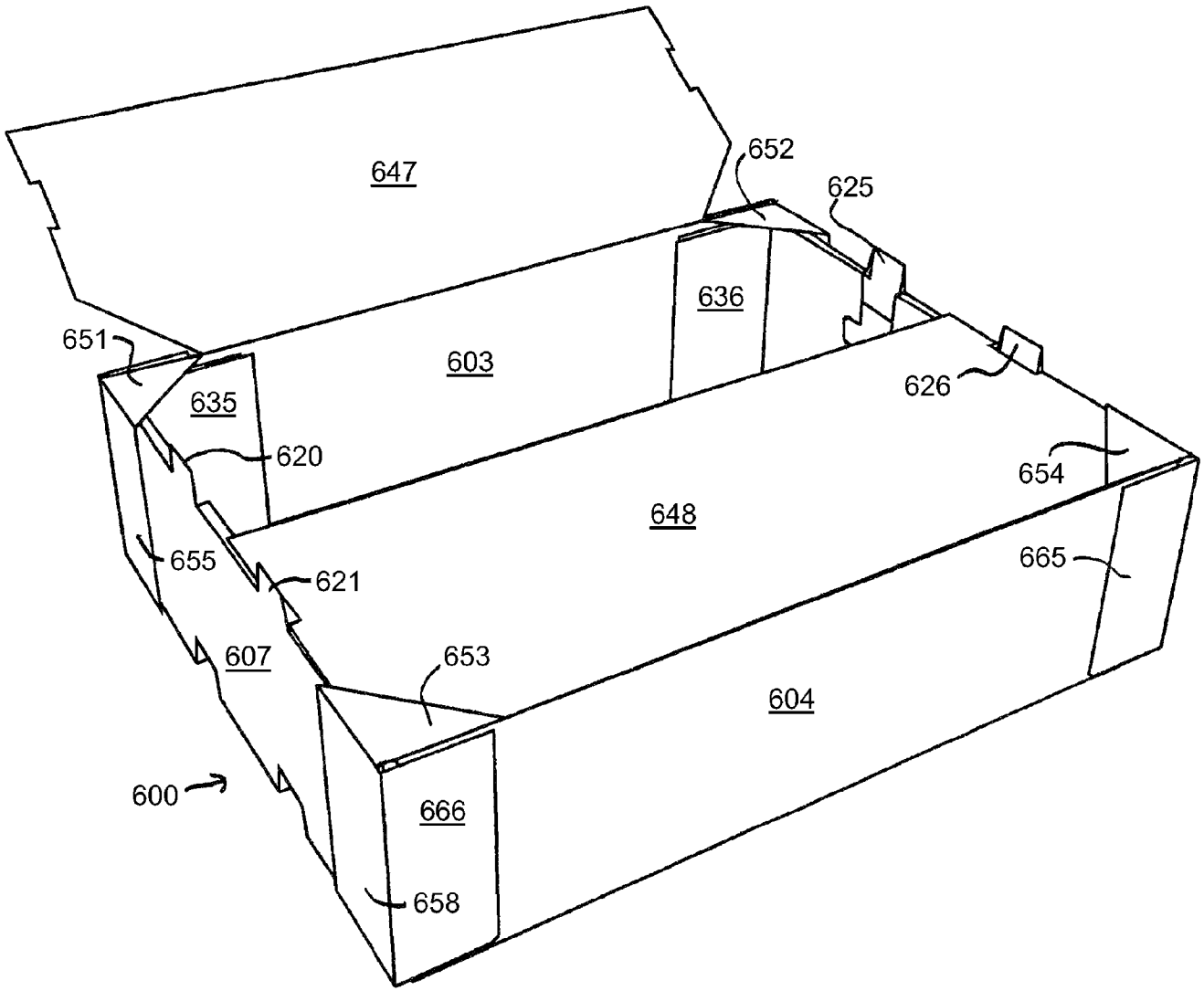
FIG. 14 is a simplified perspective view of a carton with integrated lid according to the embodiment of FIG. 13, shown in its erected configuration, with the top open prior to loading and sealing.

FIGS. 13-14 illustrate a covered tray with integral lid, and having stacking tabs. For a corrugated paperboard blank, the preferred direction of the flutes is indicated by the double arrow in FIG. 13. Covered tray 600 is formed from blank 601 (preferably bilaterally symmetrical), which includes bottom panel 602, end panels 603, 604; fold lines 605, 606; outer side panels 607, 608; fold line 609, interrupted by vent holes 610, 611; fold line 612, interrupted by vent holes 613, 614; inner side panels 615, 616; double fold line 617, interrupted by T-tab structures 620, 621 including offset tab fold lines 618, 619; double fold line 622, interrupted by T-tab structures 625, 626 including offset tab fold lines 623, 624; outer side panel minor flaps 627-630; fold lines 631-634; inner side panel minor flaps 635-638; fold lines 639-642; inner side panel notches 643-646; top panels 647, 648; fold lines 649, 650; top corner panels 651-654; first overlap panels 655-658; fold lines 659-662; second overlap panels 663-666; fold lines 667-670; top panel notches 671-674. Blank 601 also includes through-cuts 674-676 (which may be substituted by perforations, with the corresponding modes of operation as discussed herein).

In carton 600, when inner side panel 615, 616 are folded over their respective double fold lines to positions parallel to and overlying the inside surfaces of outer side panels 607, 608, the offset fold line 618, 619, 623 and 624 cause the upside down t-shaped tab 620, 621, 625, 626 to separate from the surrounding portions of the inner side panels 615, 616, as shown in FIG. 14. Inner side panel minor flaps 635-638 are adhered to the inside surfaces of minor flaps 627-630. Outer side panel minor flaps 627-630 are adhered to the inside surfaces of side panels 603, 604. First overlap panels 655-658 have been folded down to positions overlying the outside surfaces of outer side panels 607, 608 with second overlap panels 663-666 folded perpendicular thereto and adhered to outside surfaces of end panels 603, 604. The closure of carton 600 is an indicated in FIG. 14.

Figure 15:
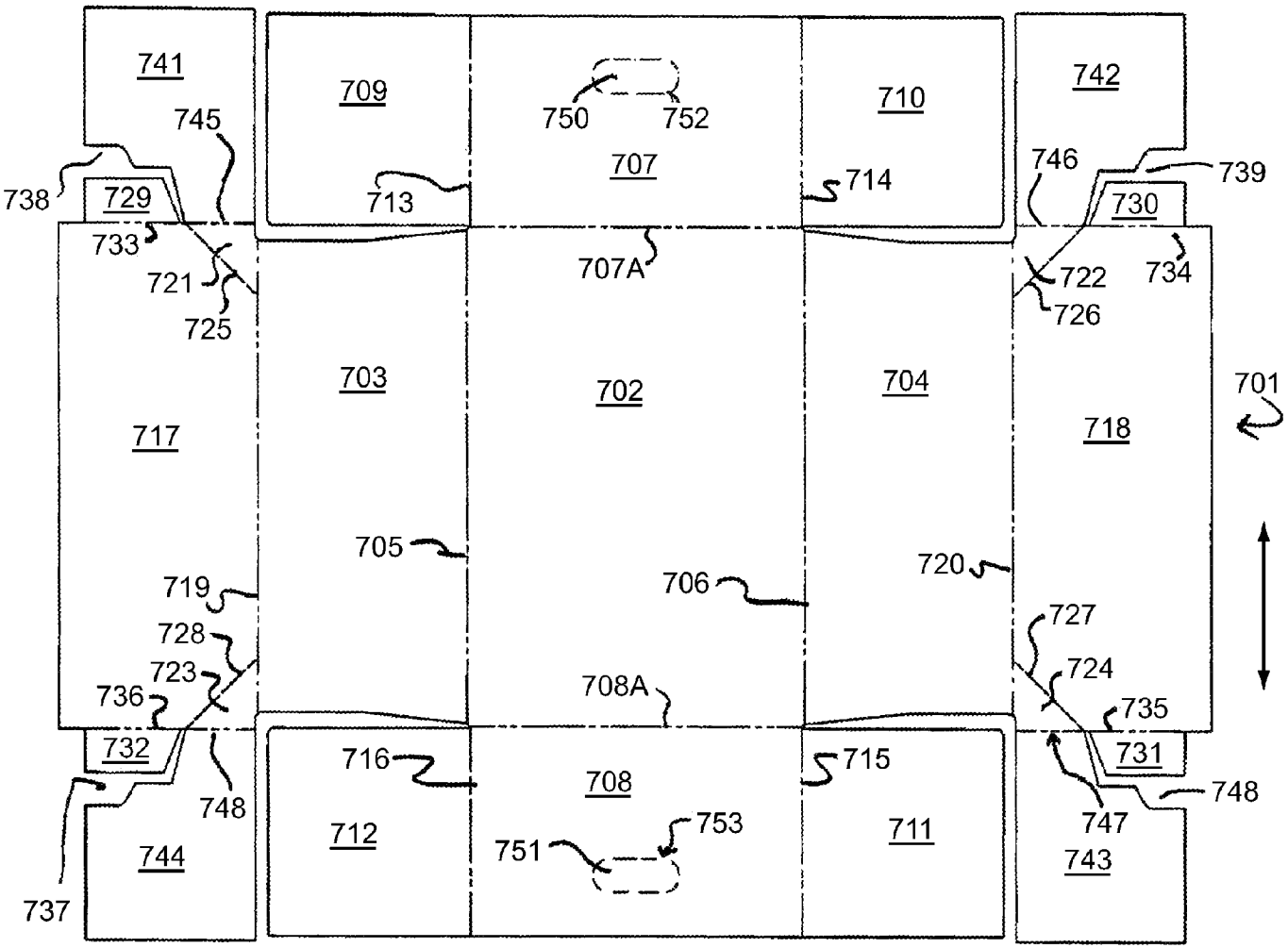
FIG. 15 is a plan view of a blank of a carton with integrated lid according to another preferred embodiment of the invention.
Figure 16:
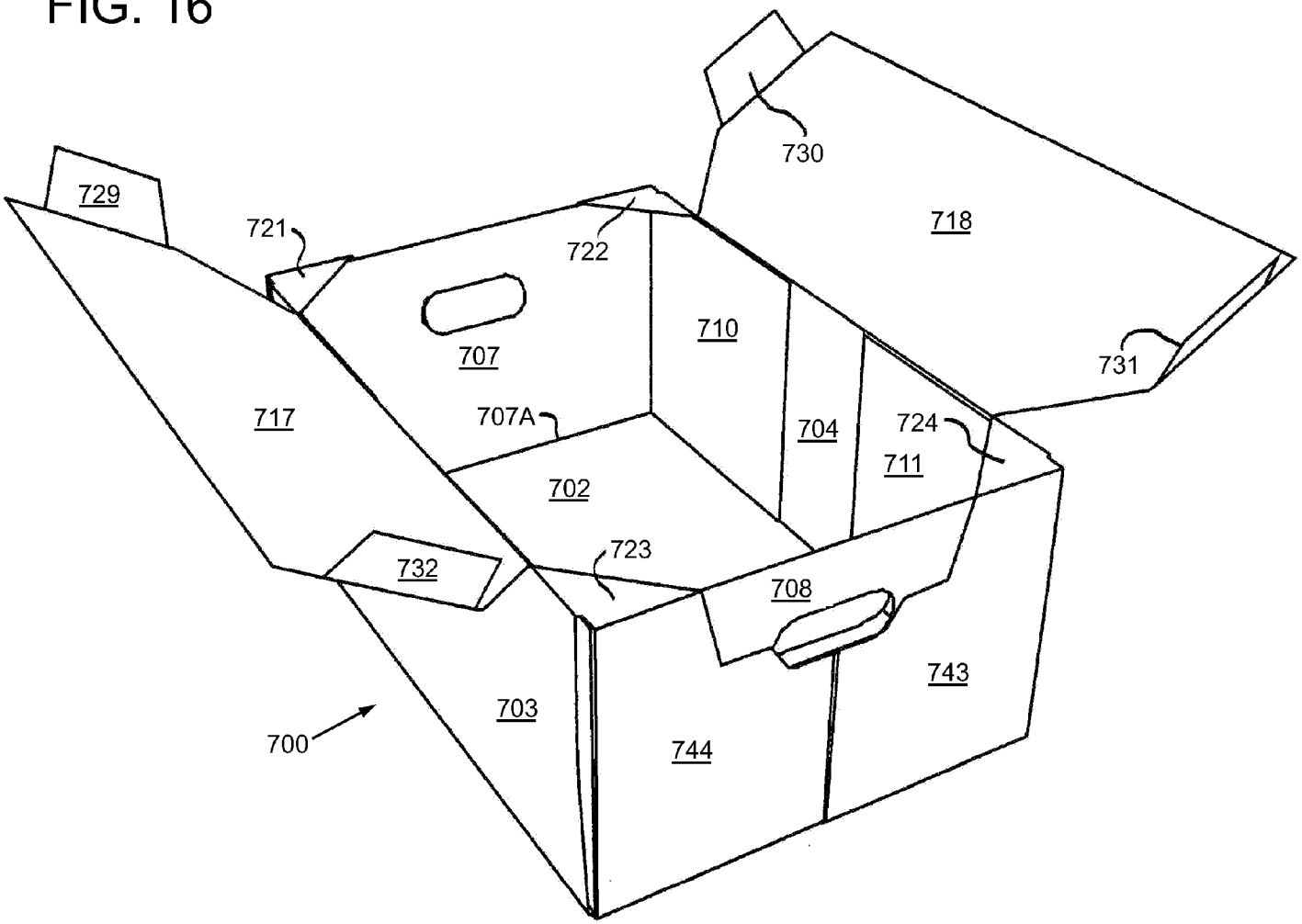
FIG. 16 is a simplified perspective view of a carton with integrated lid according to the embodiment of FIG. 15, shown in its erected configuration, with the top open prior to loading and sealing.

FIGS. 15-16 illustrate a carton with integral lid according to another embodiment of the invention. For a corrugated paperboard blank, the preferred direction of the flutes is indicated by the double arrow in FIG. 15. Carton 700 is formed from blank 701 (preferably bilaterally symmetrical), which includes bottom panel 702; end panels 703, 704; fold lines 705, 706; side panels 707, 708; fold lines 707A, 708A; side panel minor flaps 709-712; fold lines 713-716; top panels 717, 718; fold lines 719, 720; top corner panels 721-724; perforations 725-728; top flaps 729-732; fold lines 733-736; contoured cuts 737-740; overlap 741-744; and fold lines 745-748. Blank 701 also includes knock-outs 750, 751, formed by perforations 752, 753.

In carton 700, side panel minor flaps 709-712 have been adhered to the inside surfaces the end panels 703, 704 and overlap panels 741-744 have been preferably adhered to outside surfaces of side panels 707, 708. Upon closure of top panel 717, 718 the inner facing edges of these two panels may overlap and top flap 729-732 are folded down and adhered to outer surfaces of end panels 707, 708 where they are exposed by the contoured cuts 737-740.

Figure 17:
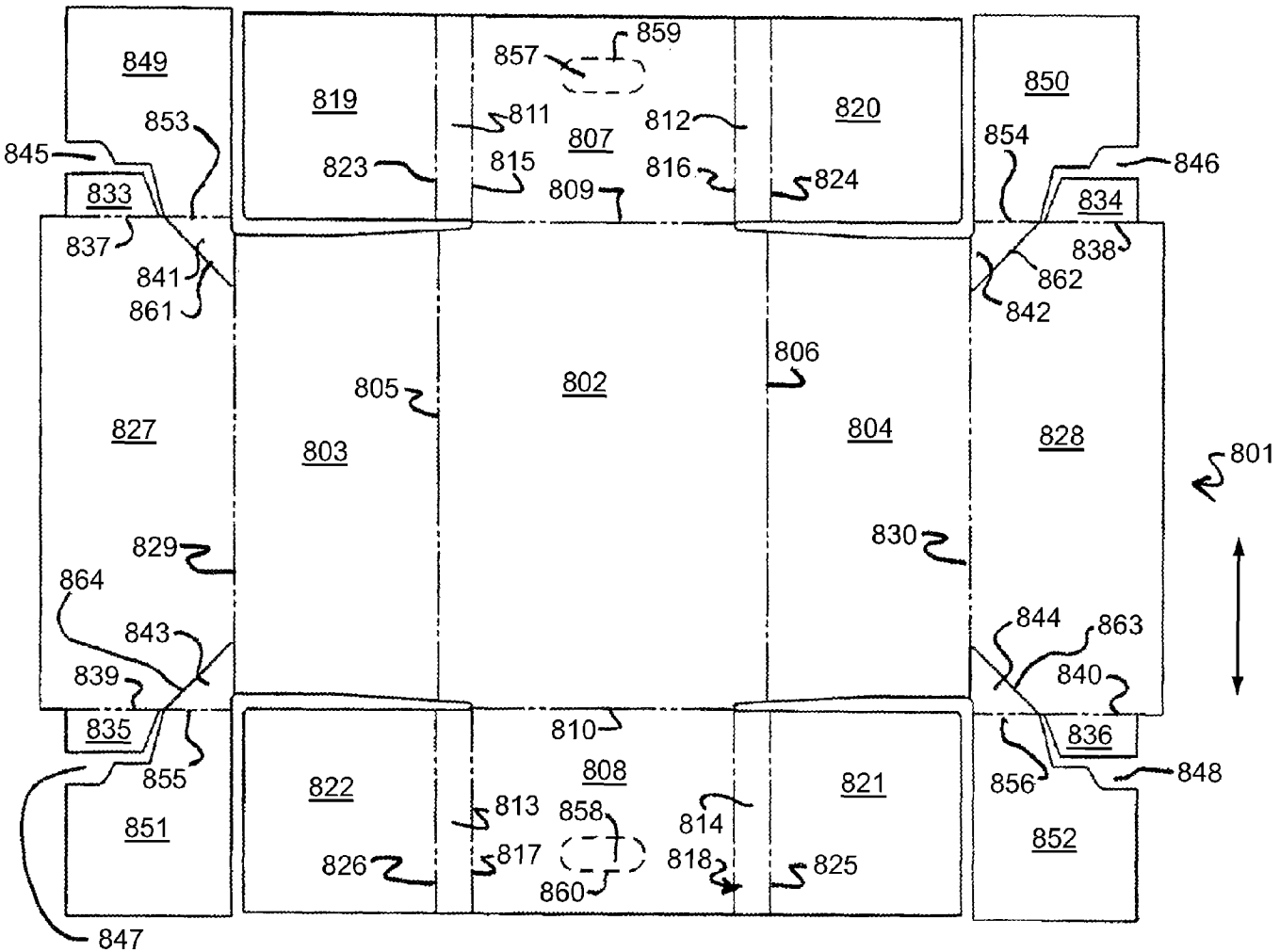
FIG. 17 is a plan view of a blank of a carton with integrated lid according to another preferred embodiment of the invention.
Figure 18:
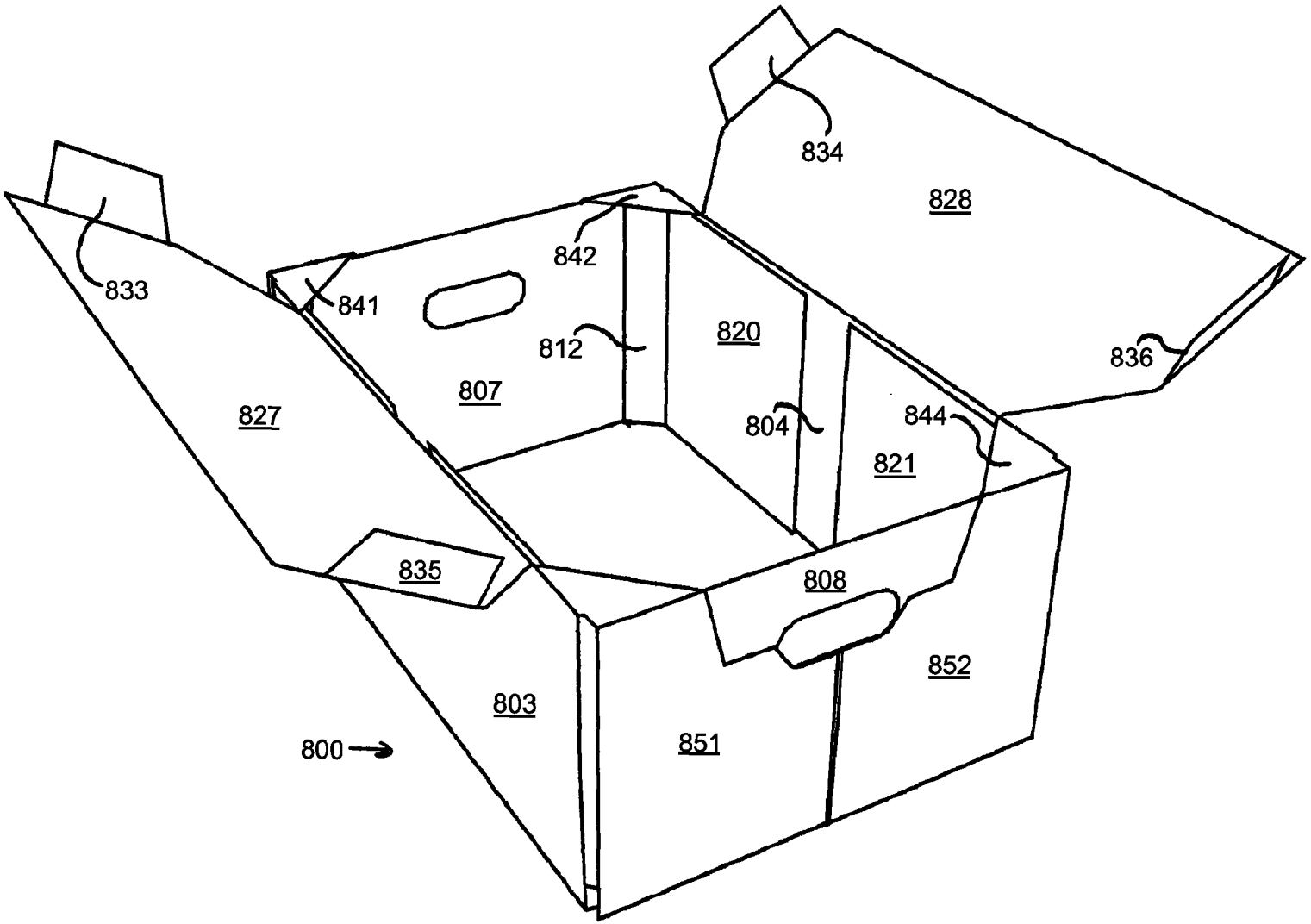
FIG. 18 is a simplified perspective view of a carton with integrated lid according to the embodiment of FIG. 17, shown in its erected configuration, with the top open prior to loading and sealing.

FIGS. 17-18 illustrate a carton with integral lid, including diagonal corner support panels. For a corrugated paperboard blank, the preferred direction of the flutes is indicated by the double arrow in FIG. 17. Carton 800 is formed from blank 801 (preferably bilaterally symmetrical), and includes bottom panel 802; end panels 803, 804; fold lines 805, 806; side panels 807, 808; fold lines 809, 810; gusset panels 811-814; fold lines 815-818; side panel minor flaps 819-822; fold lines 823-826; top panels 827, 828; fold lines 829, 830; top panel flaps 833-836; fold lines 837-840; top corner panels 841-844; countered cuts 845-848; overlap panels 849-852; fold lines 853-856; knock-outs 857, 868, formed by perforations 859, 860. Blank 801 also includes cuts 861-864 (which may be substituted with perforations, if desired, with the corresponding modes of operation as discussed herein).

Carton 800 is formed in a substantially similar manner as carton 700, except that blank 801 for 800 includes gusset panels 811-814.

Figure 19:
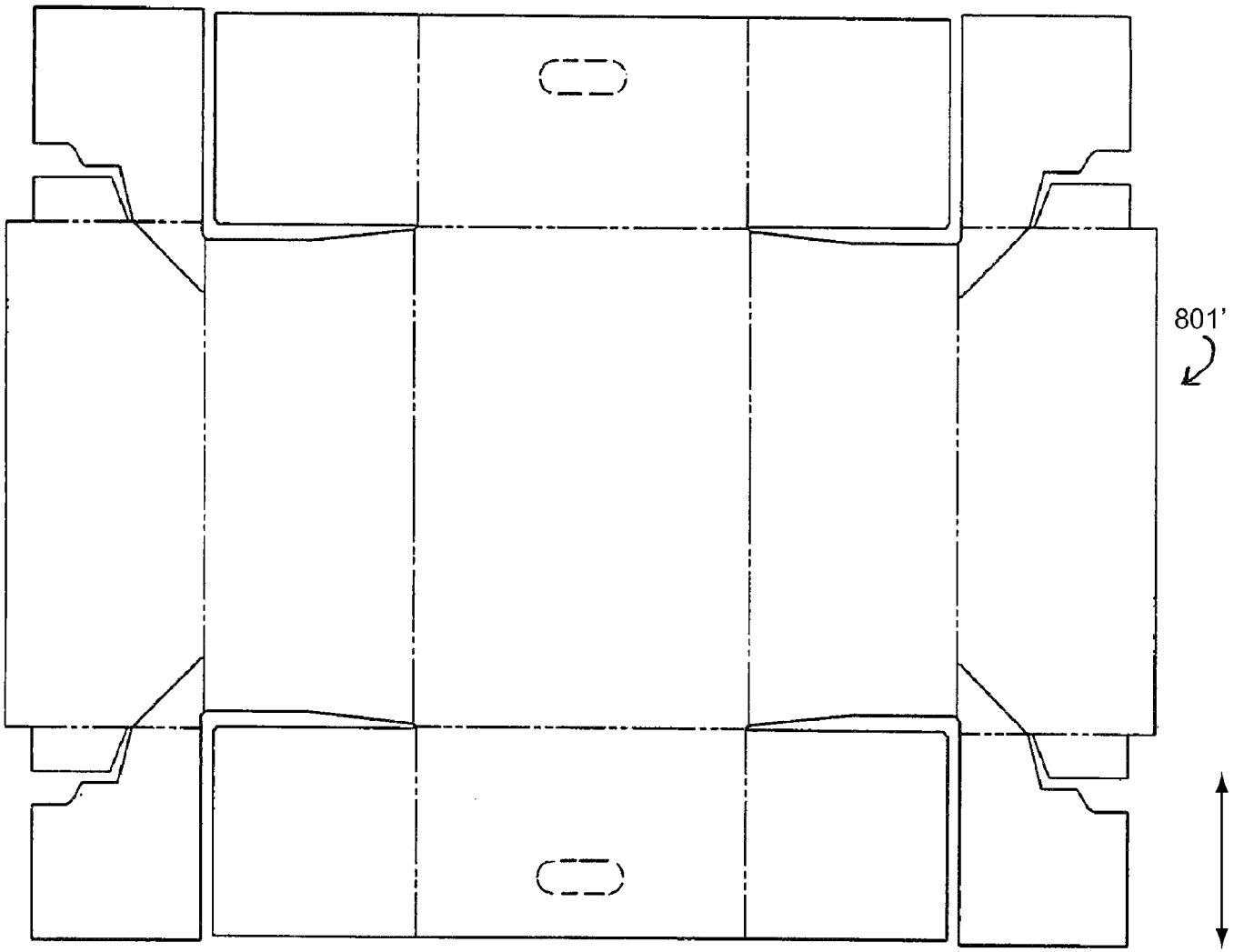
FIG. 19 is a plan view of a blank of a carton with integrated lid according to another preferred embodiment of the invention.
Figure 20:
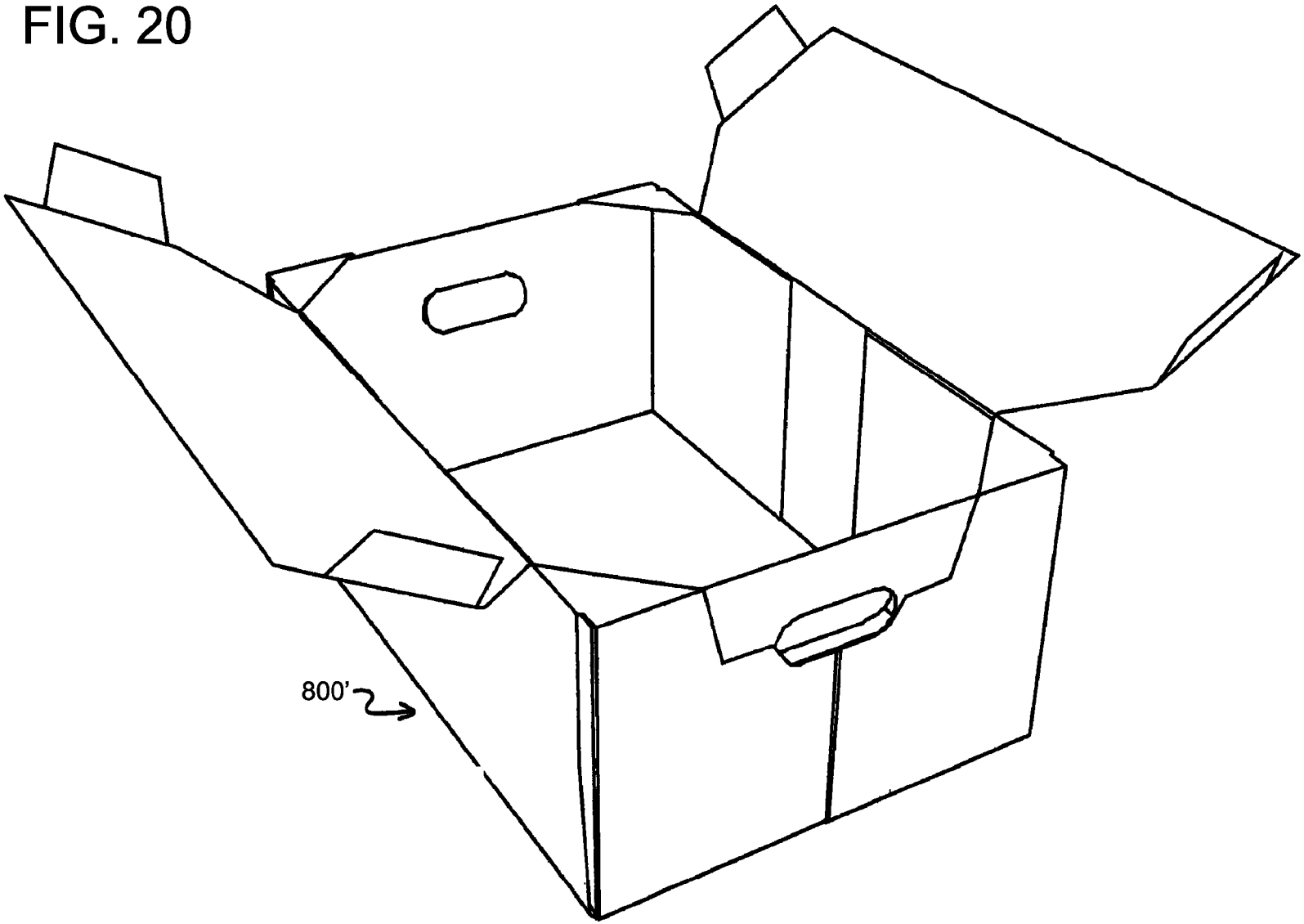
FIG. 20 is a simplified perspective view of a carton with integrated lid according to the embodiment of FIG. 19, shown in its erected configuration, with the top open prior to loading and sealing.

In a further alternative embodiment of the carton of FIGS. 17 and 18, gusset panels 811-814 may be omitted, by eliminating fold lines 815-818. Such an alternative construction is illustrated in FIGS. 19-20, by carton 800', formed by blank 801' (preferably bilaterally symmetrical), which has all the other panels, fold lines and other features of blank 800 of FIGS. 17-18. For a corrugated paperboard blank, the preferred direction of the flutes is indicated by the double arrow in FIG. 19.

Figure 21:
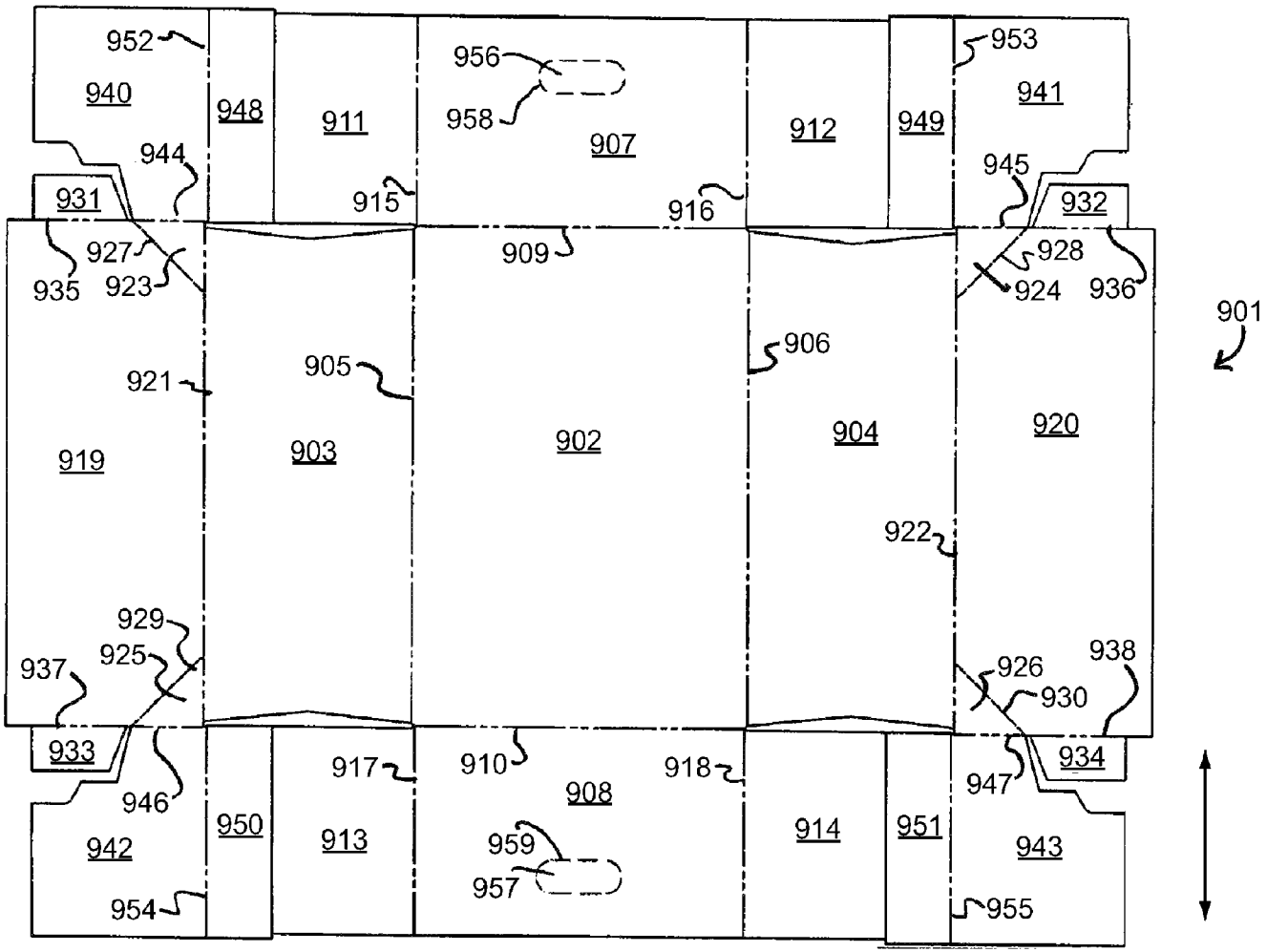
FIG. 21 is a plan view of a blank of a carton with integrated lid according to another preferred embodiment of the invention.
Figure 22:
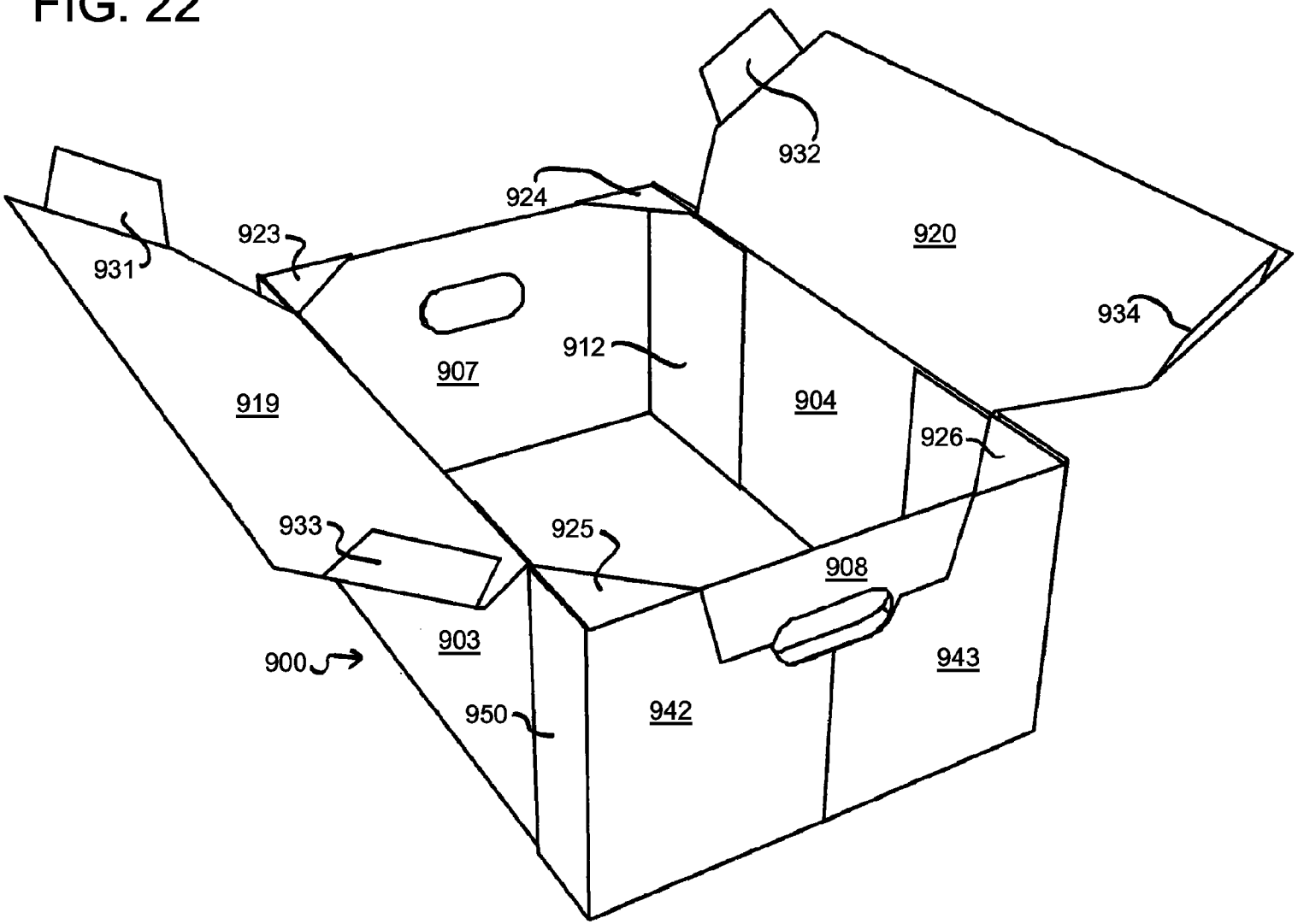
FIG. 22 is a simplified perspective view of a carton with integrated lid according to the embodiment of FIG. 21, shown in its erected configuration, with the top open prior to loading and sealing.

In another alternative embodiment, shown in FIGS. 21-22, a covered carton with two top panels, and with outer corner support panels, is shown. For a corrugated paperboard blank, the preferred direction of the flutes is indicated by the double arrow in FIG. 21. Carton 900 is formed from blank 901 (preferably bilaterally symmetrical), which includes bottom panel 902; end panels 903, 904; fold lines 905, 906; side panels 907, 908; fold lines 909, 910; minor flaps 911-914; fold lines 915-918; top panels 919, 920; fold lines 921, 922; top corner panels 923-926; perforations 927-930 (which may be replaced by straight cuts); top side closure flaps 931-934; fold lines 935-938; first overlap panels 940-943; fold lines 944-947; second overlap panels 948-951; fold lines 952-955; and knock-outs 956, 957, formed by perforations 958, 959.

Carton 900 is substantially similar to carton 700, but for the addition of second overlap panels 948-951, which are adhered to the outside surfaces of side panels 907, 908.

Figure 49:
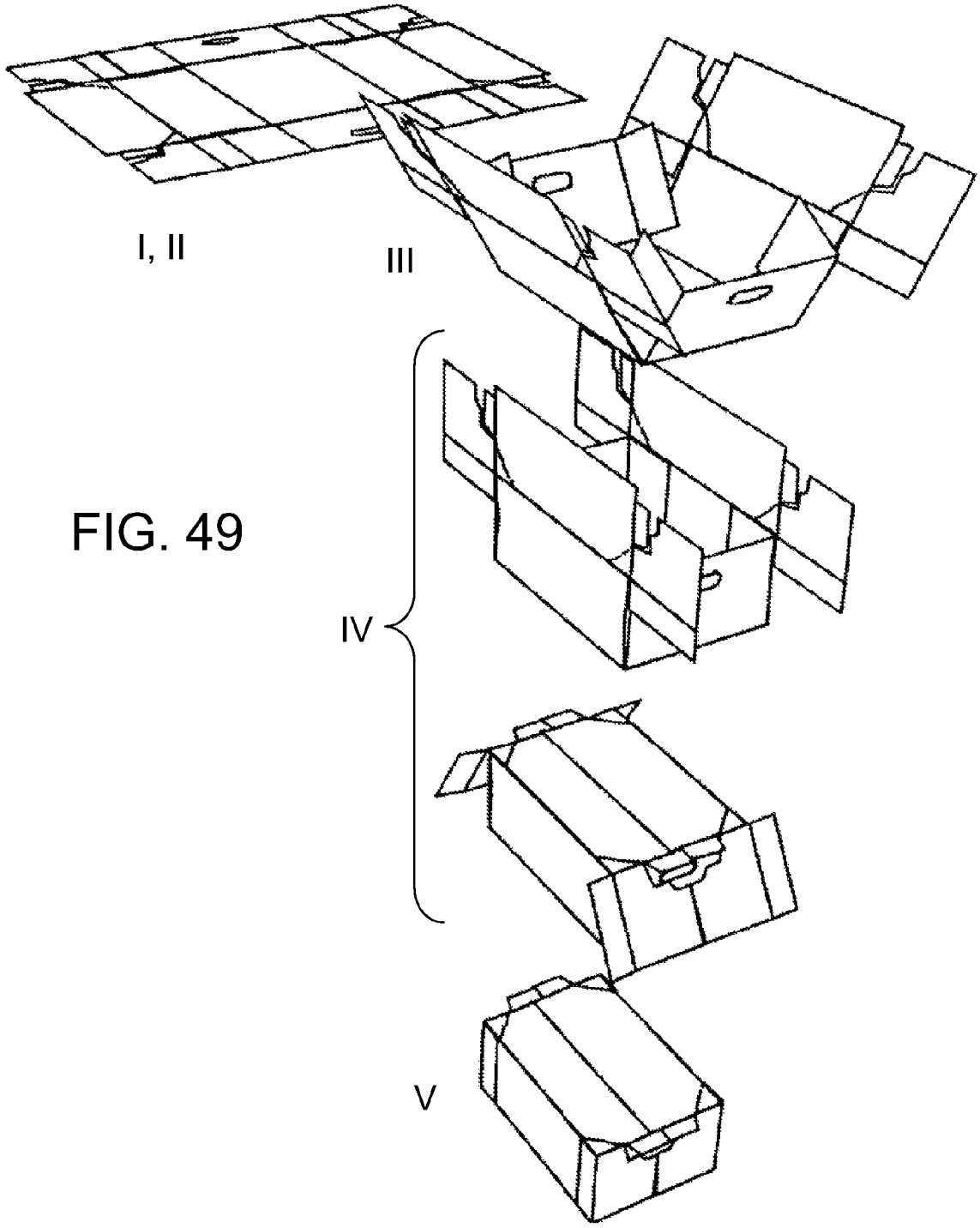
FIG. 49 illustrates the first several steps in a method for forming a package, using the carton blank from FIGS. 21-22.
Figure 50:
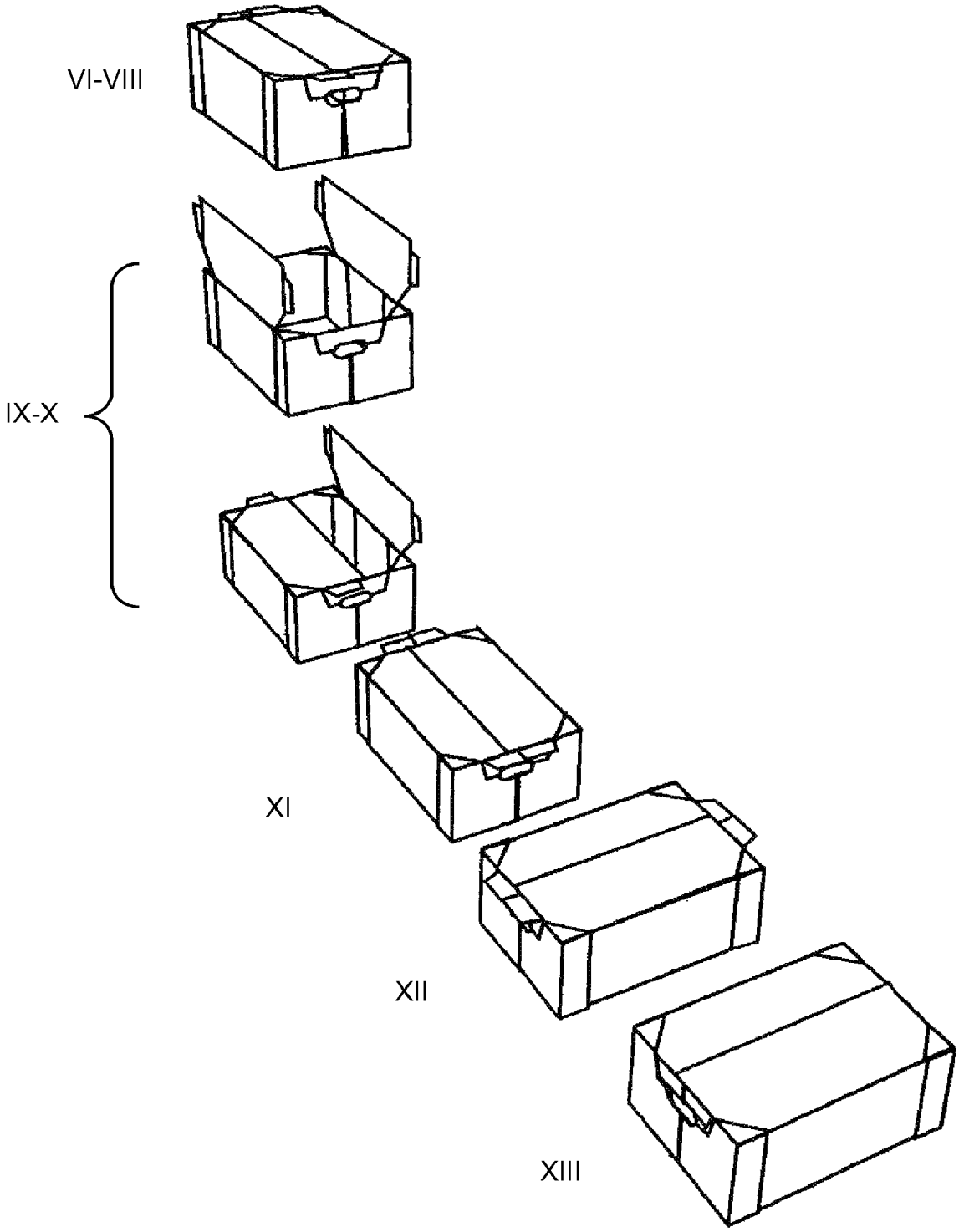
FIG. 50 illustrates the remaining steps in a method for forming a package, using the carton blank from FIGS. 21-22.

FIGS. 49-50 illustrate the steps in a method for setting up a carton, such as may be fabricated from the blank of FIGS. 21-22. These methods may be performed using suitably modified carton forming machinery such as are known in the art, and such modifications may be readily accomplished by one of ordinary skill in the art, having the present disclosure before them. The steps are as follows:

I. A flat blank is indexed into a forming station from the top of a stack of blanks.

II. The blank is indexed laterally as adhesive is applied to the inside surfaces of panels 903, 904, 948-951 and 940-943, particularly in a series of parallel glue lines, extending in a direction parallel to the direction of the flutes (as shown by the double arrow). In panels 903, 904, the glue lines may be placed near the top and bottom of those panels (as observed in FIG. 21), but not along the mid-regions of those panels, if desired.

III. A mandrel pushes the blank down through a forming chamber into a compression section.

IV. At a secondary forming station, the top panels and first overlap panels are folded down while the second overlap panels are articulated and glued.

V. As a new carton is received in the forming chamber, the just-formed carton is discharged from the compression section onto a powered take-away conveyor.

VI. Formed cartons are pushed down a chute from a case erecting room located on an upper floor to a production floor of a production facility.

VII. Cartons are moved laterally, e.g., at shoulder height, on a powered belt conveyor, past manual packing stations.

VIII. A worker selects an empty carton from the belt conveyor, and positions the carton at the worker's pack station, e.g., at waist or thigh height.

IX. The top panels are pulled up (breaking perforations as necessary) to open the carton for packing.

X. Product, such as Cryovac™ wrapped meat cuts are packed into the open carton.

XI. The filled carton is pushed forward onto a take-away conveyor to a sealing device, such as an Elliott Top & Side Sealer, a Pearson side flange sealer or a Smurfit-Stone Container Corporation side flange sealer.

XII. The top panels are plowed down and the top side closure flaps are sealed with hot melt adhesive.

XIII. Sealed cartons are then transported, e.g., by roller conveyor to a manual palletizing area. Pallet Loads are built, transferred by lift trucks to temporary storage, and then shipped to customers as required.

Figure 23:
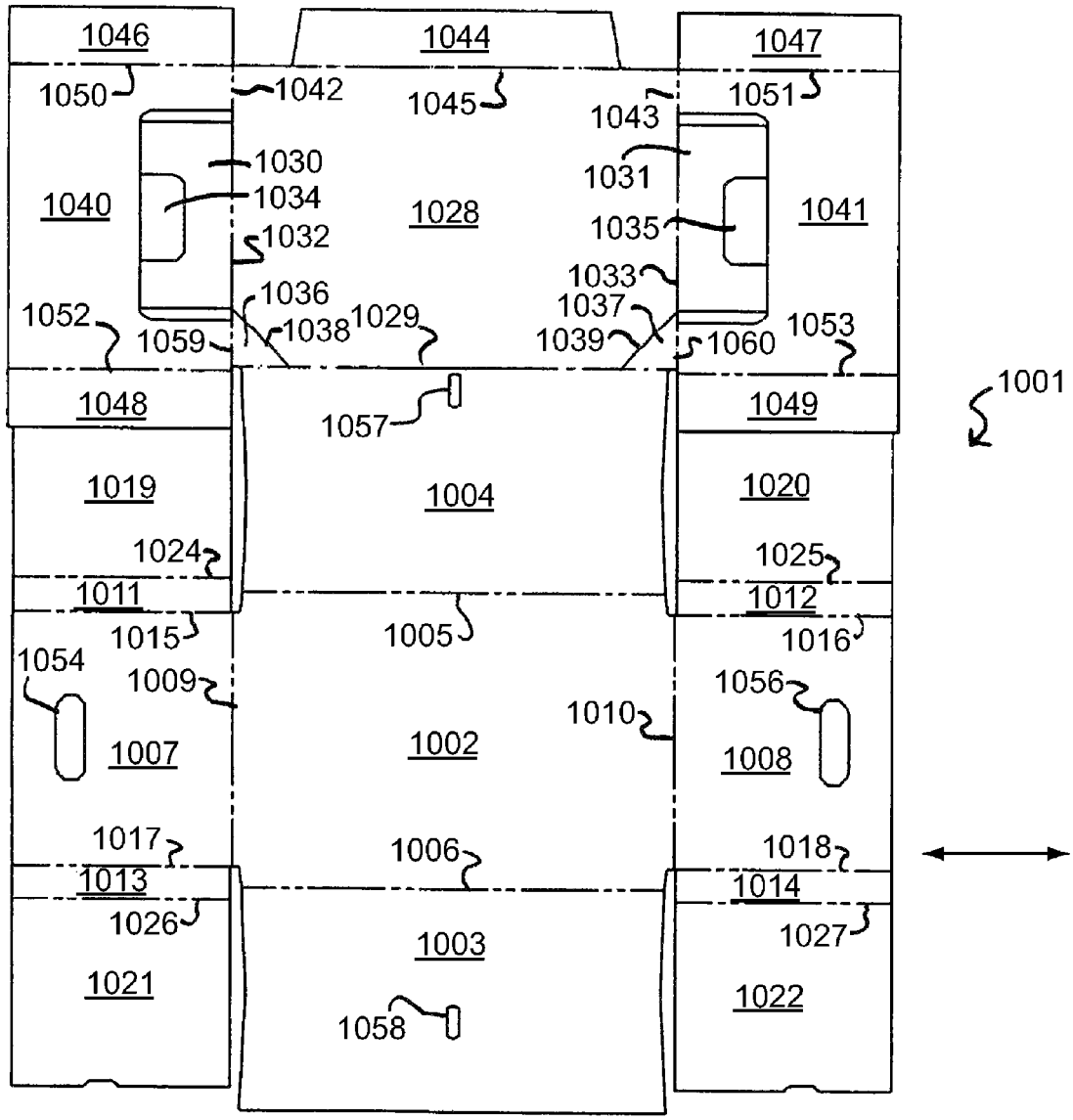
FIG. 23 is a plan view of a blank of a carton with integrated lid according to another preferred embodiment of the invention.
Figure 24:
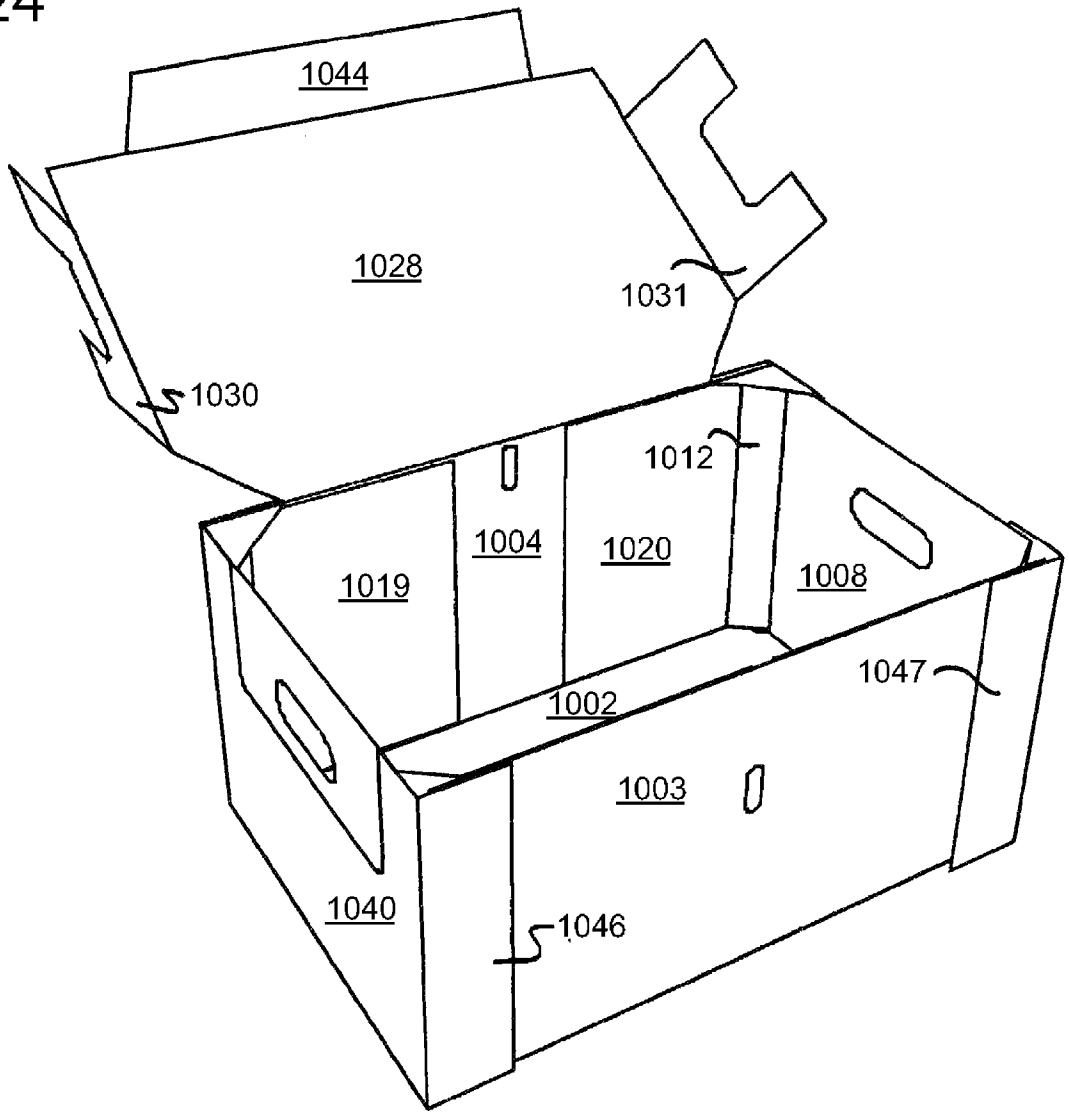
FIG. 24 is a simplified perspective view of a carton with integrated lid according to the embodiment of FIG. 23, shown in its erected configuration, with the top open prior to loading and sealing.

In the embodiment of FIGS. 23, 24, carton 1000 is formed by blank 1001, to create a single top panel carton. For a corrugated paperboard blank, the preferred direction of the flutes is indicated by the double arrow in FIG. 23. Blank 1001 includes bottom panel 1002; (front) end panel 1003; (rear) end panel 1004; fold lines 1005, 1006; side panels 1007, 1008; fold lines 1009, 1010; gusset panels 1011-1014; fold lines 1015-1018; minor flaps 1019-1022; fold lines 1024-1027; top panel 1028; fold line 1029; top side closure flaps 1030, 1031; fold lines (or perforation lines) 1032, 1033; cutouts 1034, 1035; top corner panels 1036, 1037; perforations or through-cuts 1038, 1039; first overlap panels 1040, 1041; fold lines 1059, 1060; perforations 1042, 1043; top front closure flap 1044; fold line 1045; second overlap panels 1046-1049; fold lines 1050-1053; hand holes 1054, 1056; and vent apertures 1057, 1058.

Carton 1000 is formed by placing side panels 1007, 1008 perpendicular to bottom panel 1002. Minor flaps 1019-1022 are affixed to inside surfaces of (front) end panel 1003 and (rear) end panel 1004. Closure of carton 1000 is accomplished by folding top panel 1028 to a position parallel to bottom panel 1002. At this point, top panel 1028 is still attached along perforations 1042 and 1043 to first overlap panels 1040, 1041. First overlap panels 1040, 1041 are affixed to outside surfaces of side panels 1007, 1008 with second overlap panels 1046-1049 being affixed to outside surfaces of (front) end panel 1003 and (rear) end panel 1004. Top front closure flap 1044 is affixed to an outer surface of (front) end panel 1003. In addition, top side closure panels 1030 and 1031 are adhered to outside surfaces of side panels 1007 and 1008. Opening of carton 1000 is accomplished by peeling back top front closure panel 1044, and top side closure panels 1030 and 1031 (or tearing along their respective fold lines/perforations), and tearing along perforations 1042 and 1043.

Figure 25:
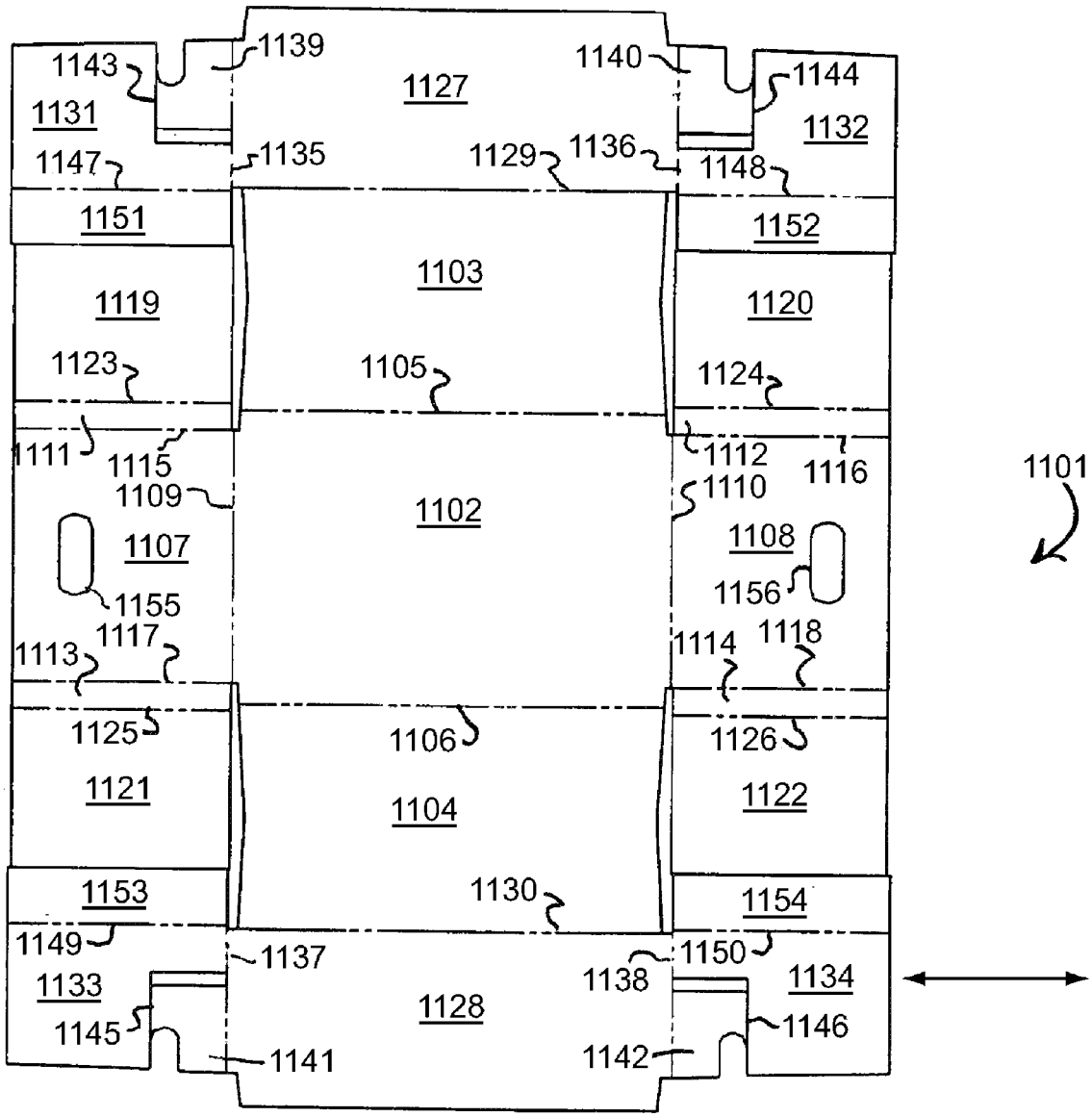
FIG. 25 is a plan view of a blank of a carton with integrated lid according to another preferred embodiment of the invention.
Figure 26:
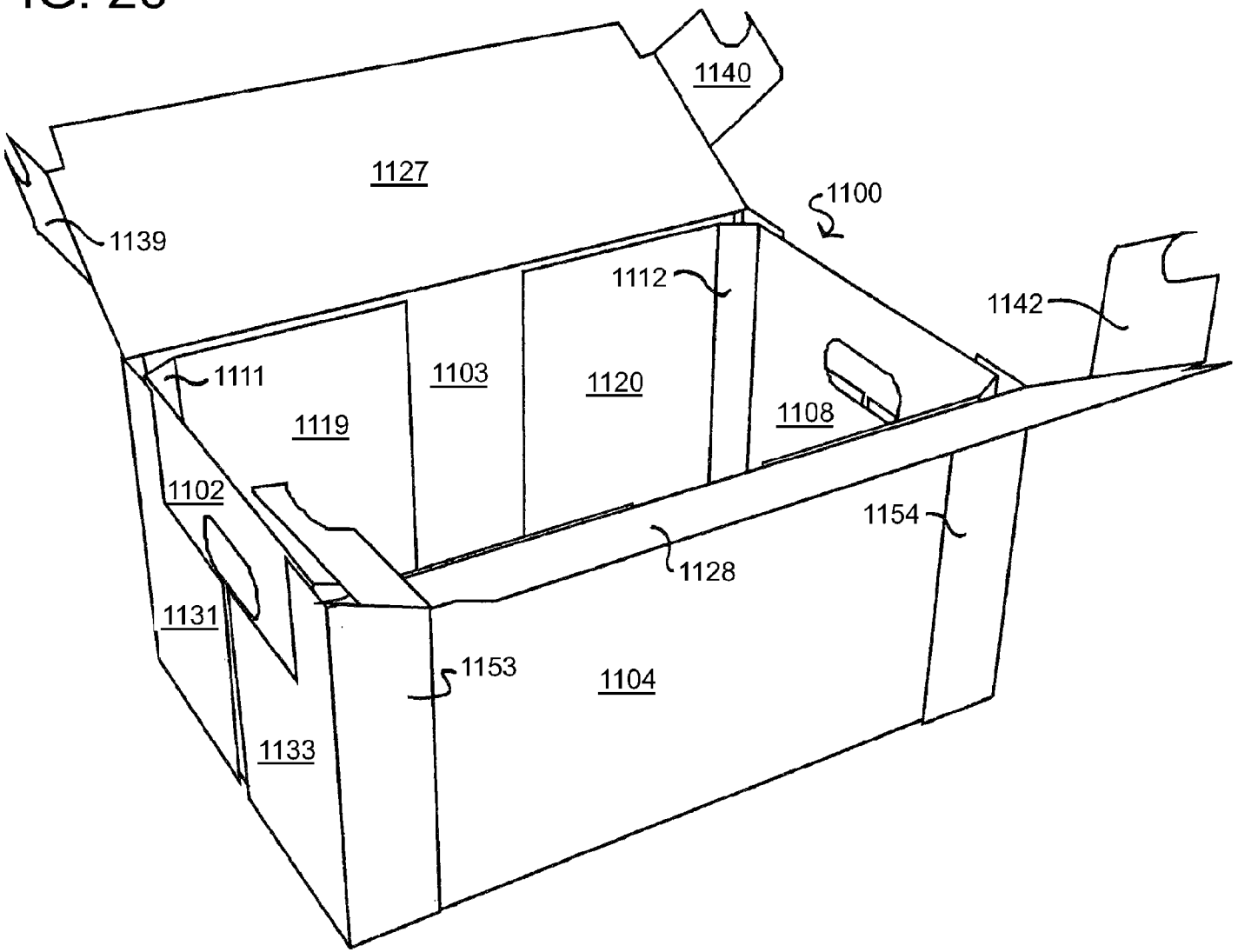
FIG. 26 is a simplified perspective view of a carton with integrated lid according to the embodiment of FIG. 25, shown in its erected configuration, with the top open prior to loading and sealing.

The embodiment of FIGS. 25-26 is a carton 1100 provided with a two-panel top, and is formed from blank 1101 (preferably bilaterally symmetrical). For a corrugated paperboard blank, the preferred direction of the flutes is indicated by the double arrow in FIG. 25. Blank 1101 includes bottom panel 1102, end panels 1103, 1104; fold lines 1105, 1106; side panels 1107, 1108; fold lines 1109, 1110; gusset panels 1111-1114; fold lines 1115-1118; minor panels 1119-1122; fold lines 1123-1126; top panels 1127, 1128; fold lines 1129, 1130; first overlap panels 1131-1134; perforations 1135-1138; top side closure flaps 1139-1142; cuts 1143-1146; fold lines 1147-1150; second overlap panels 1151-1154; and hand holes 1155, 1156.

In carton 1100, minor panels 1119-1122 are adhered to inside surfaces of side panels 1103, 1104, so that gusset panels 1111-1114 extend diagonally across the corners of the interior of carton 1100 to provide vertical stacking strength. First overlap panels 1131-1134 are adhered to outside surfaces of side panels 1107, 1108. Top panels 1128, 1127 are pulled up, tearing perforations 1135-1138 where the top panels are joined to first overlap panels 1131-1134, to permit the top panels to be raised for loading. After loading, top side closure flaps 1139-1142 are folded down and glued in place, later to be separated from the top panels along the perforations to enable access to the interior of carton 1100.

Figure 27:
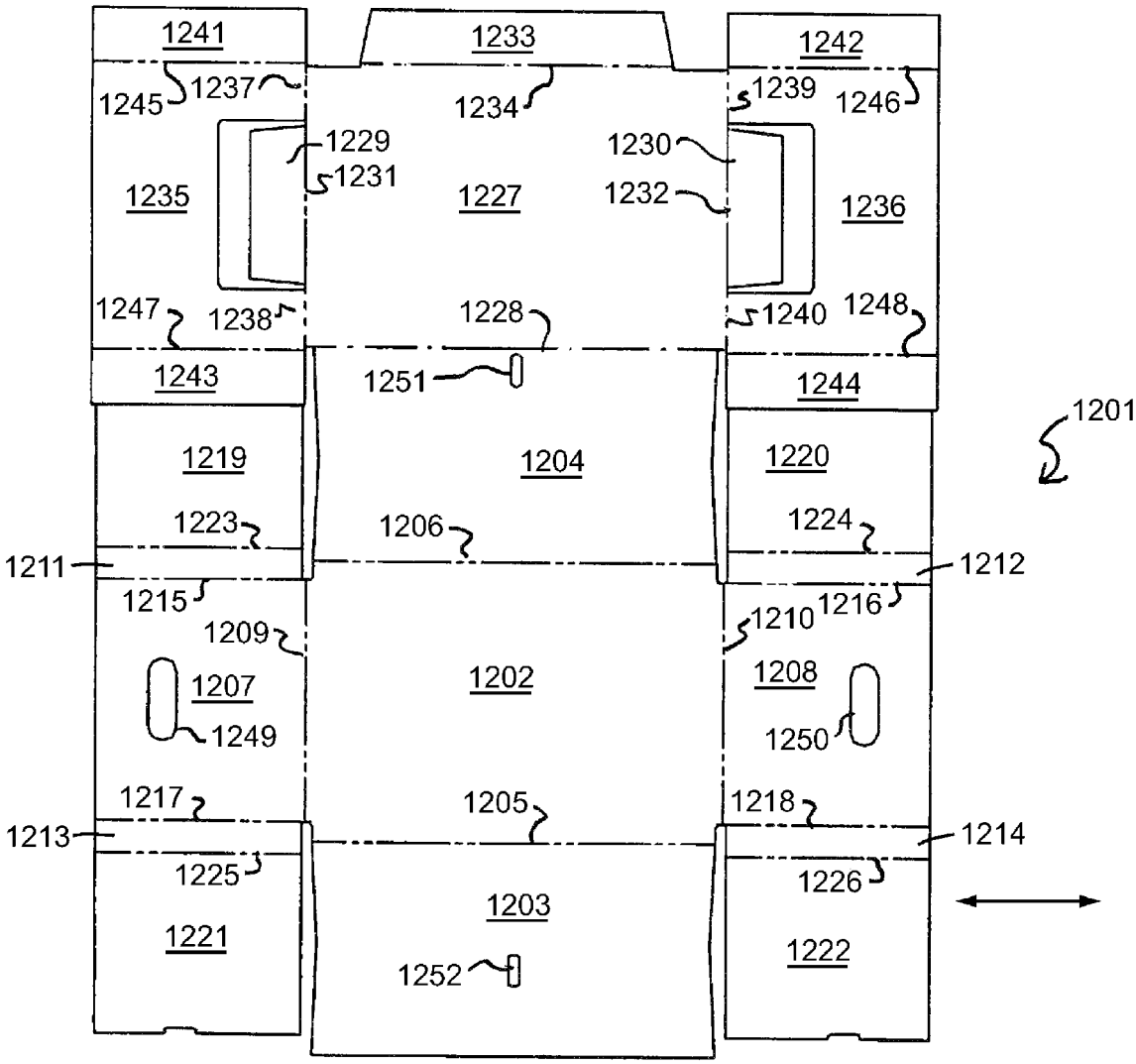
FIG. 27 is a plan view of a blank of a carton with integrated lid according to another preferred embodiment of the invention.
Figure 28:
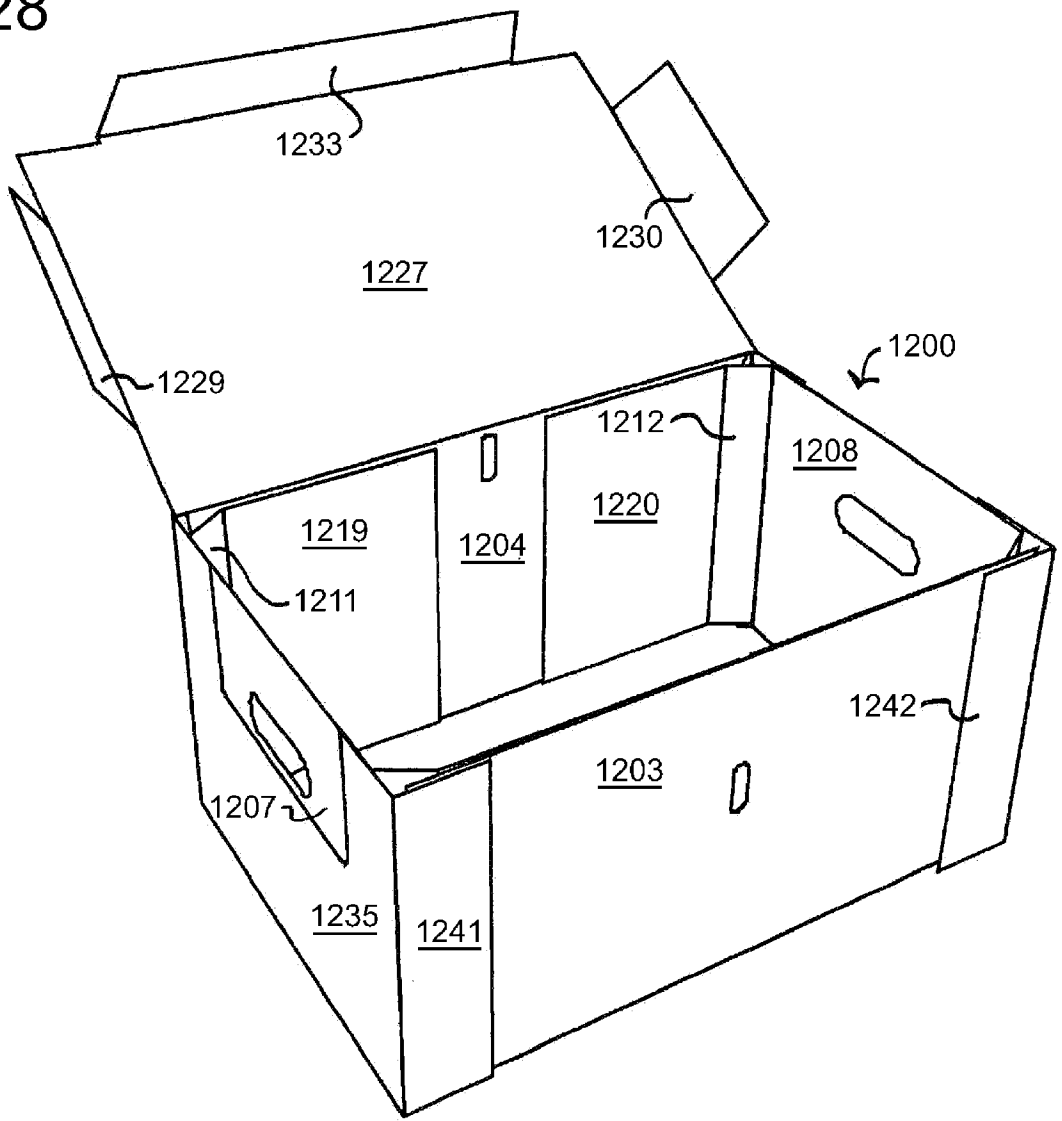
FIG. 28 is a simplified perspective view of a carton with integrated lid according to the embodiment of FIG. 27, shown in its erected configuration, with the top open prior to loading and sealing.

Carton 1200 of FIGS. 27-28 is formed from blank 1201. For a corrugated paperboard blank, the preferred direction of the flutes is indicated by the double arrow in FIG. 27. Blank 1201 includes bottom panel 1202; (front) end panel 1203; (rear) end panel 1204; fold lines 1205, 1206; side panels 1207, 1208; fold lines 1209, 1210; gusset panels 1211-1214; fold lines 1215-1218; minor flaps 1219-1222; fold lines 1223-1226; top panel 1227; fold line 1228; top side closure flaps 1229, 1230; fold lines 1231, 1232; top front closure flap 1233; fold line 1234; first overlap panels 1235, 1236; perforations 1237-1240; second overlap panels flaps 1241-1244; fold lines 1245-1248; hand holes 1249, 1250; and vent holes 1251, 1252.

Carton 1200 is formed from a blank 1201, which is similar to carton 1000 previously described, the primary difference being that the blank of carton 1200 is not provided with the top corner panels along the rear panel of the blank as in the embodiment of carton 1000.

Figure 29:
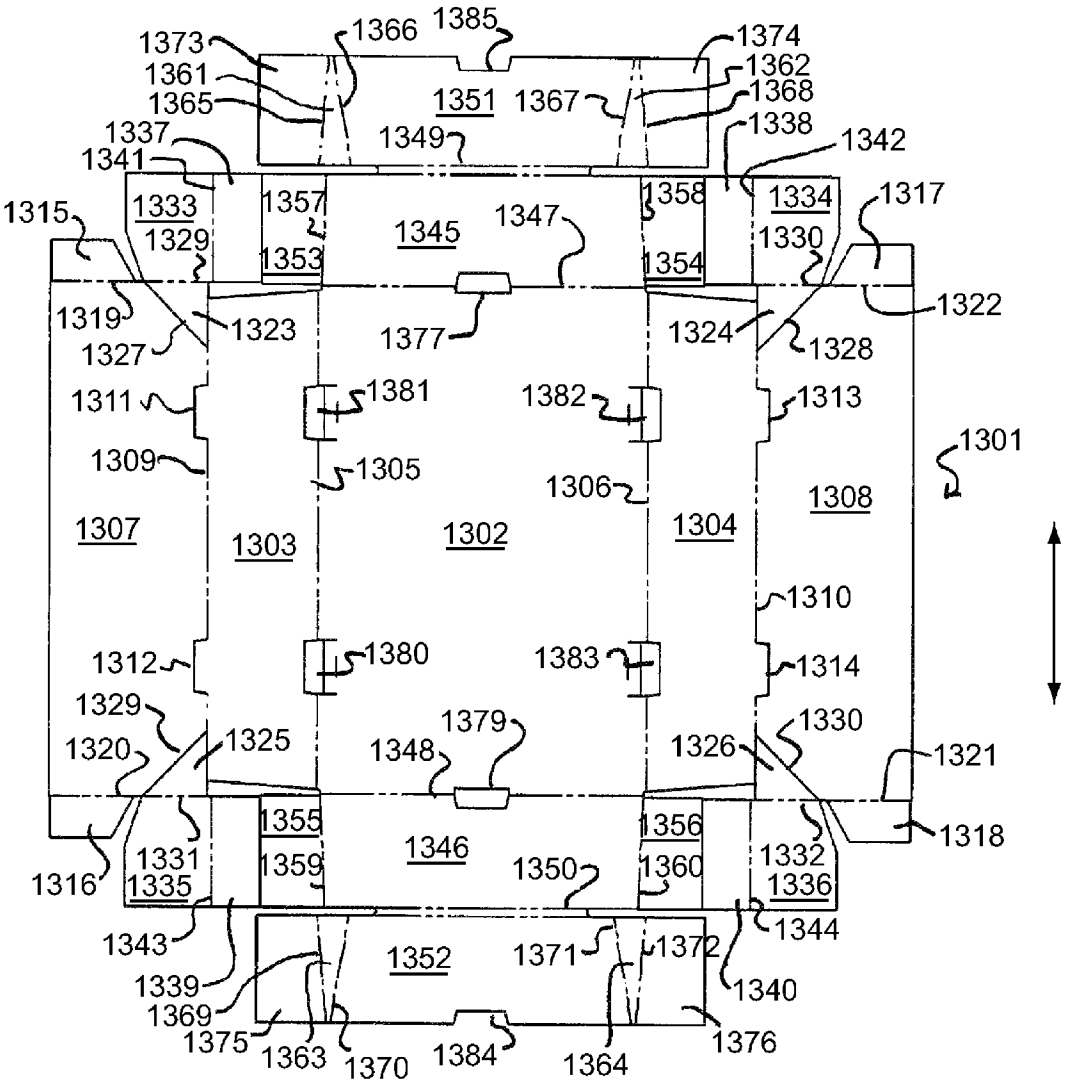
FIG. 29 is a plan view of a blank of a carton with integrated lid according to another preferred embodiment of the invention.
Figure 30:
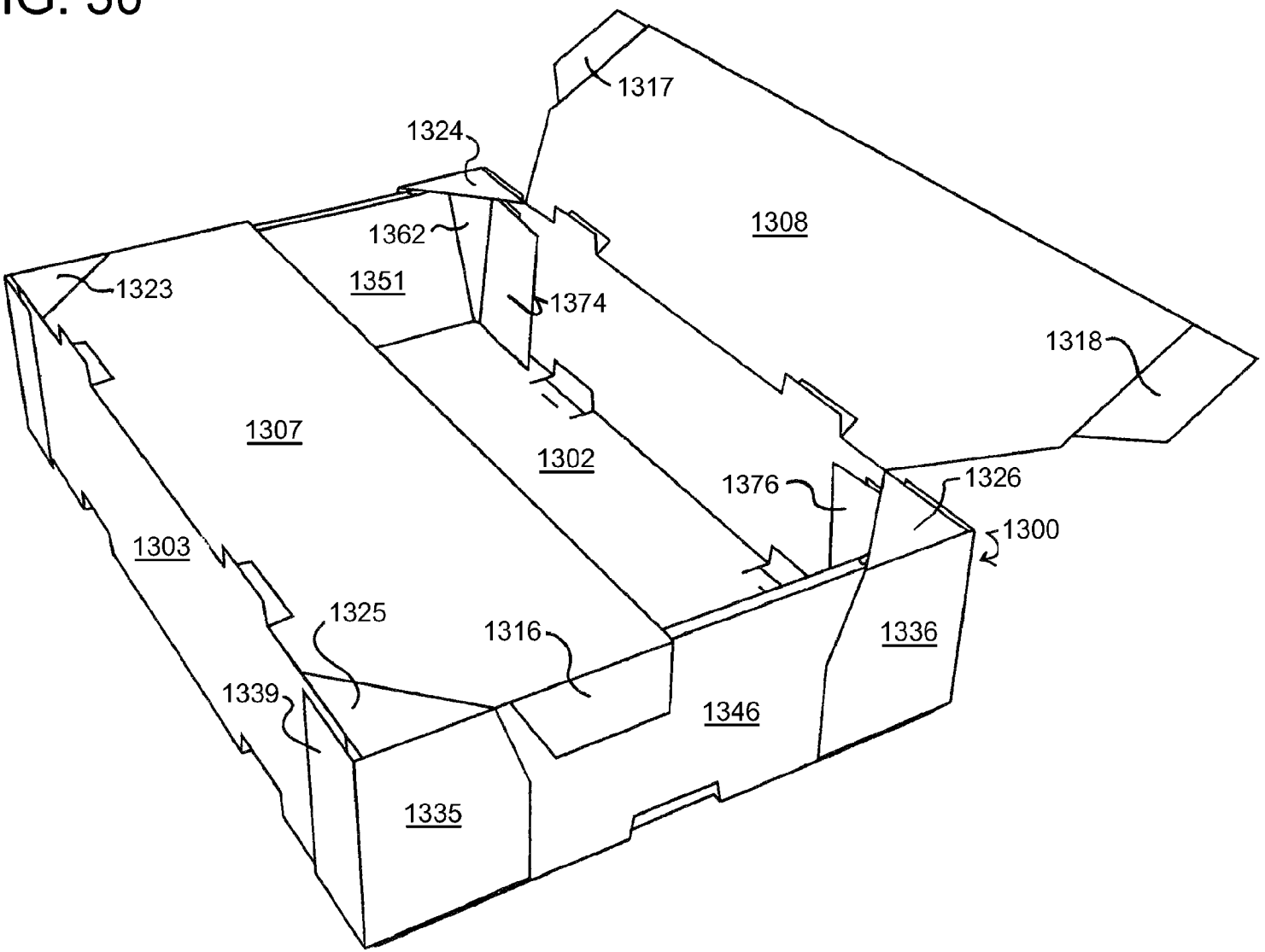
FIG. 30 is a simplified perspective view of a carton with integrated lid according to the embodiment of FIG. 29, shown in its erected configuration, with the top open prior to loading and sealing.

Carton 1300 of FIGS. 29-30 is formed from blank 1301. For a corrugated paperboard blank, the preferred direction of the flutes is indicated by the double arrow in FIG. 29. Blank 1301 includes bottom panel 1302; end panels 1303, 1304; fold lines 1305, 1306; top panels 1307, 1308; fold line 1309 interrupted by die-cut stacking tabs 1311, 1312; fold line 1310 interrupted by die-cut stacking tabs 1313, 1314; top side closure flaps 1315-1318; fold lines 1319-1322; top corner panels 1323-1326; through-cuts 1327-1330 (which could be replaced by perforations); fold lines 1331-1334; first overlap panels 1333-1336; second overlap panels 1337-1340; fold lines 1341-1344; outer side panels 1345, 1346; fold lines 1347-1348; double fold lines 1349, 1350; inner side panels 1351, 1352; outer side panel minor flaps 1353-1356; fold lines 1357-1360; V-shaped gusset panels 1361-1364; fold lines 1365-1372; inner side panel minor flaps 1373-1376; vent openings 1377, 1379; die-cut stacking slots 1380-1383.

Carton 1300, shown in FIGS. 29-30, is, except for the proportions, substantially similar in the structure and mode of operation to carton 300. In addition, top side closure flaps 1315-1318 extend from end edges of the top panels and are adhered to outside surfaces of side panels 1345, 1346.

Figure 31:
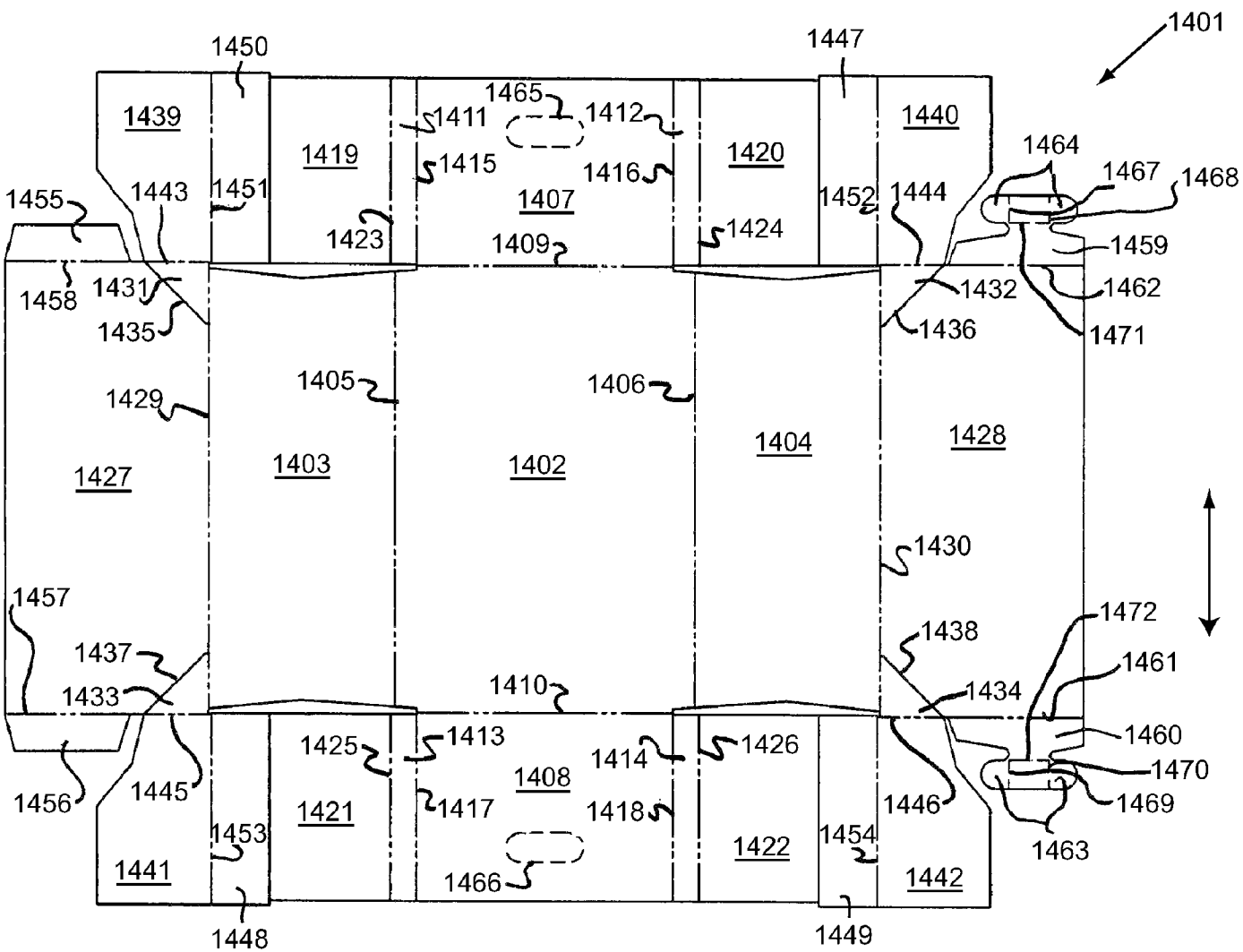
FIG. 31 is a plan view of a blank of a carton with integrated lid according to another preferred embodiment of the invention.
Figure 32:
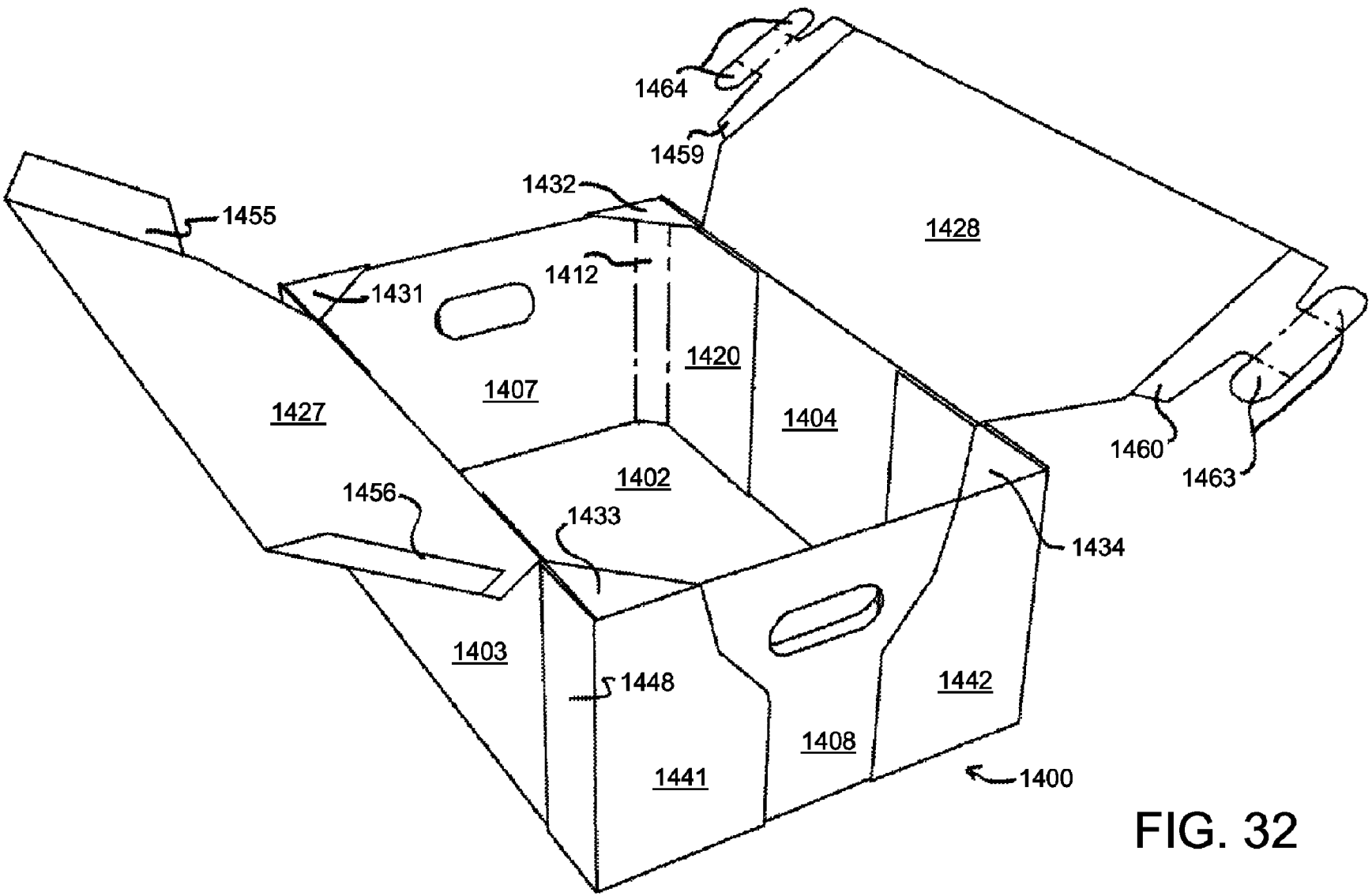
FIG. 32 is a simplified perspective view of a carton with integrated lid according to the embodiment of FIG. 31, shown in its erected configuration, with the top open prior to loading and sealing.

Carton 1400, shown in FIGS. 31-32, is a two top panel carton, but based on an asymmetrical blank 1401. For a corrugated paperboard blank, the preferred direction of the flutes is indicated by the double arrow in FIG. 31. Blank 1401 includes bottom panel 1402; end panels 1403, 1404; fold lines 1405, 1406; side panels 1407, 1408; fold lines 1409, 1410; gusset panels 1411-1414; fold lines 1415-1418; minor flaps 1419-1422; fold lines 1423-1426; top panels 1427, 1428; fold lines 1429, 1430; top corner panels 1431-1434; through-cuts 1435-1438 (which could be replaced by perforations); first overlap panels 1439-1442; fold lines 1443-1446; second overlap panels 1447-1450; fold lines 1451-1454; top side closure flaps 1455, 1456; fold lines 1457, 1458; locking flaps 1459, 1460; fold lines 1461, 1462; tabs 1463, 1464; hand holes 1465, 1466.

In the embodiment shown in FIGS. 31, 32, tabs 1463, 1464 are set off by separate score lines 1467-1470 that extend perpendicular to fold lines 1471, 1472 that extend across locking flaps 1459, 1460. In an alternative embodiment of the invention, score lines 1467-1470 may be omitted.

In carton 1400, minor flaps 1419-1422 are adhered to inside surfaces of end panels 1403, 1404. First overlap panels 1439-1442 are adhered to outside surfaces of side panels 1407, 1408 and/or second overlap panels 1447-1450 are adhered to outside surfaces of end panels 1403, 1402. To maintain closure panel 1427 in place over bottom panel 1402, closure flaps 1455, 1456 are folded down over the outer surfaces of side panels 1407, 1408, while tabs 1464, 1463 or locking flaps 1459, 1460 are inserted and received through hand holes 1465, 1466, locking the top flaps 1427, 1428 down in place.

Figure 33:
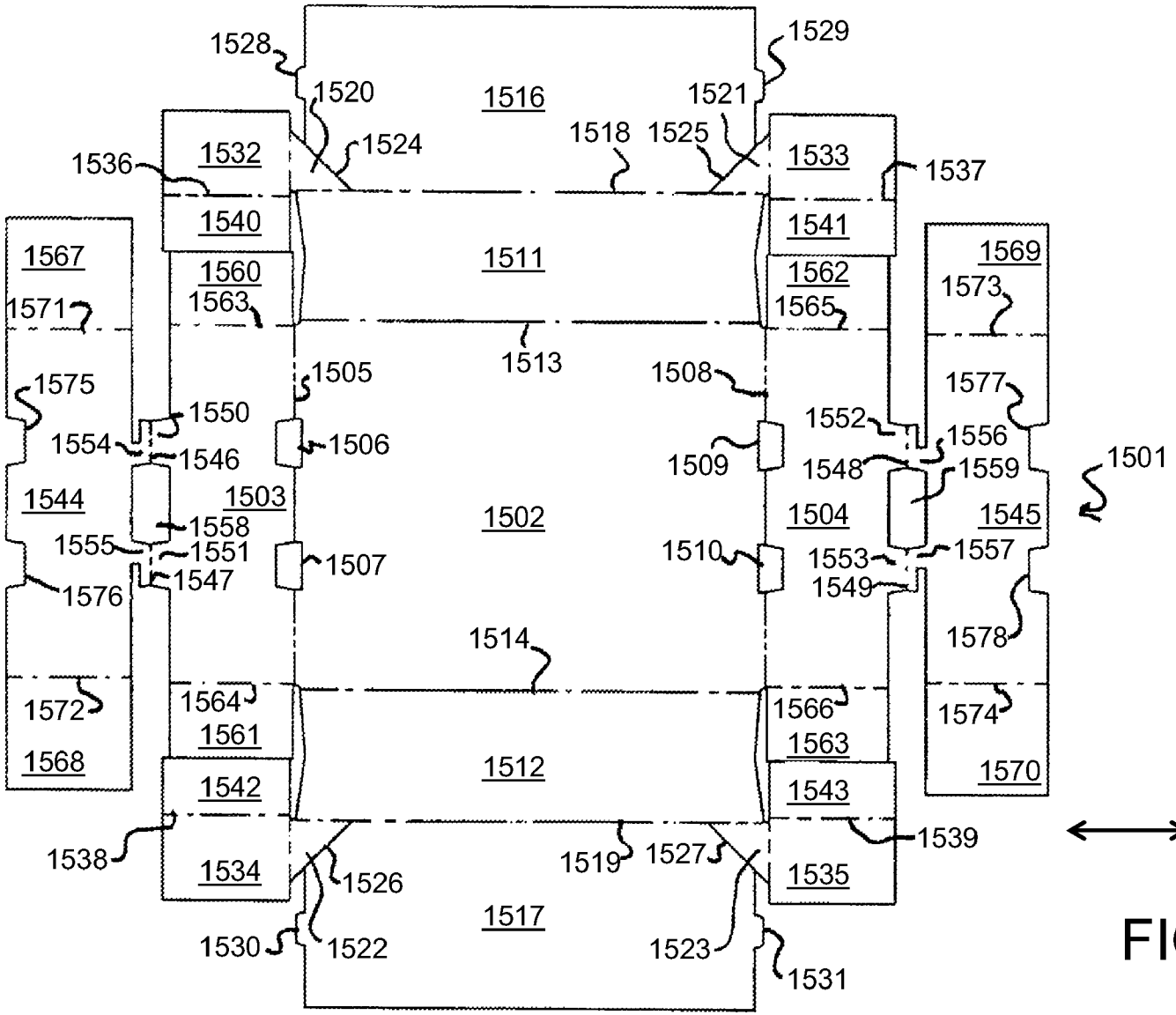
FIG. 33 is a plan view of a blank of a carton with integrated lid according to another preferred embodiment of the invention.
Figure 34:
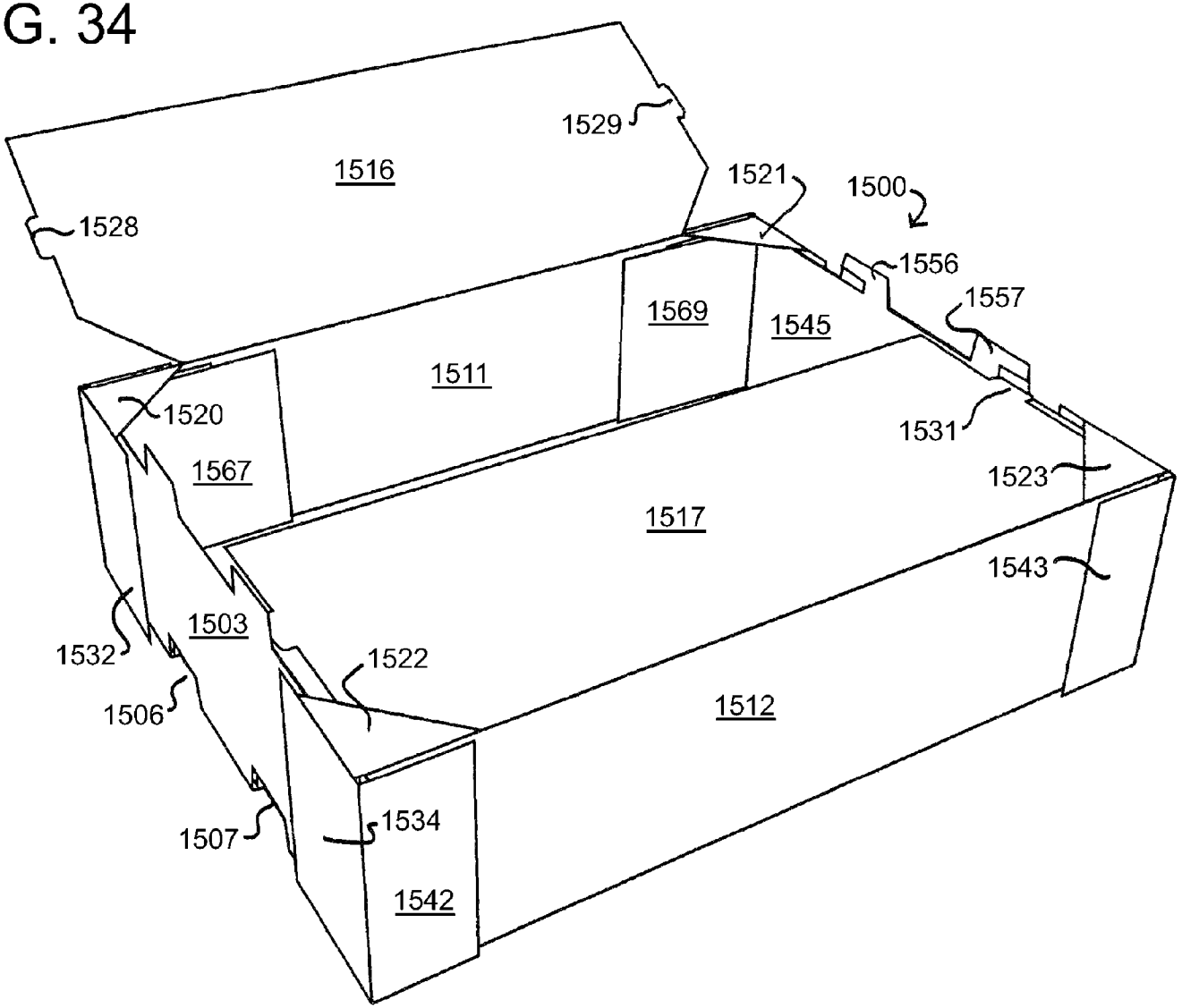
FIG. 34 is a simplified perspective view of a carton with integrated lid according to the embodiment of FIG. 33, shown in its erected configuration, with the top open prior to loading and sealing.

FIGS. 33-34 illustrate a covered carton with self-locking top panels. For a corrugated paperboard blank, the preferred direction of the flutes is indicated by the double arrow in FIG. 33. Carton 1500 is formed from blank 1500, which includes bottom panel 1502; outer side panels 1503, 1504; fold line 1505, interrupted by stacking notches 1506, 1507; fold line 1508 interrupted by stacking notches 1509, 1510; end panels 1511, 1512; fold lines 1513, 1514; top panels 1516, 1517; fold lines 1518, 1519; top corner panels 1520-1523; through-cuts 1524-1527 (which may be replaced by perforations); locking tabs 1528-1531; first overlap panels 1532-1535; fold lines 1536-1539; second overlap panels 1540-1543; inner side panels 1544, 1545; web fold lines 1546-1549; outer side panel stacking tabs 1550-1553; inner side panel stacking tabs 1554-1557; minor flaps 1560-1563; fold lines 1563'-1566; minor flaps 1567-1570; fold lines 1571-1574; and stacking notches 1575-1578.

In the carton 1500, minor flaps 1560-1563 are affixed to inside surfaces of end panels 1511, 1512 and minor flaps 1567-1570 are affixed to inside surfaces of minor flaps 1560-1563. In addition, second overlap panels 1540-1543 are affixed to outside surfaces of end panels 1511, 1512. The stacking tab structures 1554-1557 also serve to help keep the lid closed or re-closeable by being provided with notches that receive locking tabs 1528, 1531 as indicated in FIG. 34.

Figure 35:
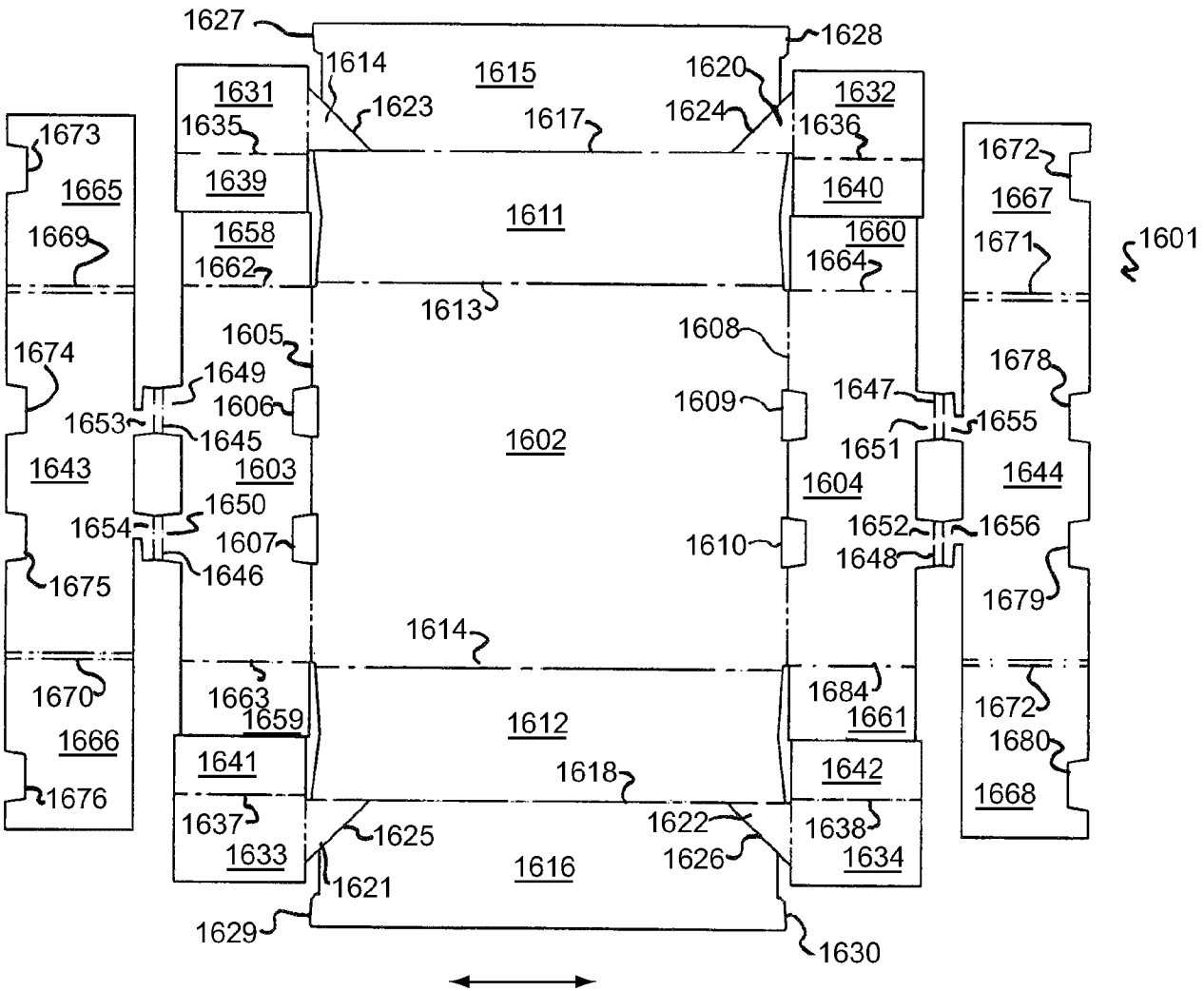
FIG. 35 is a plan view of a blank of a carton with integrated lid according to another preferred embodiment of the invention.
Figure 36:
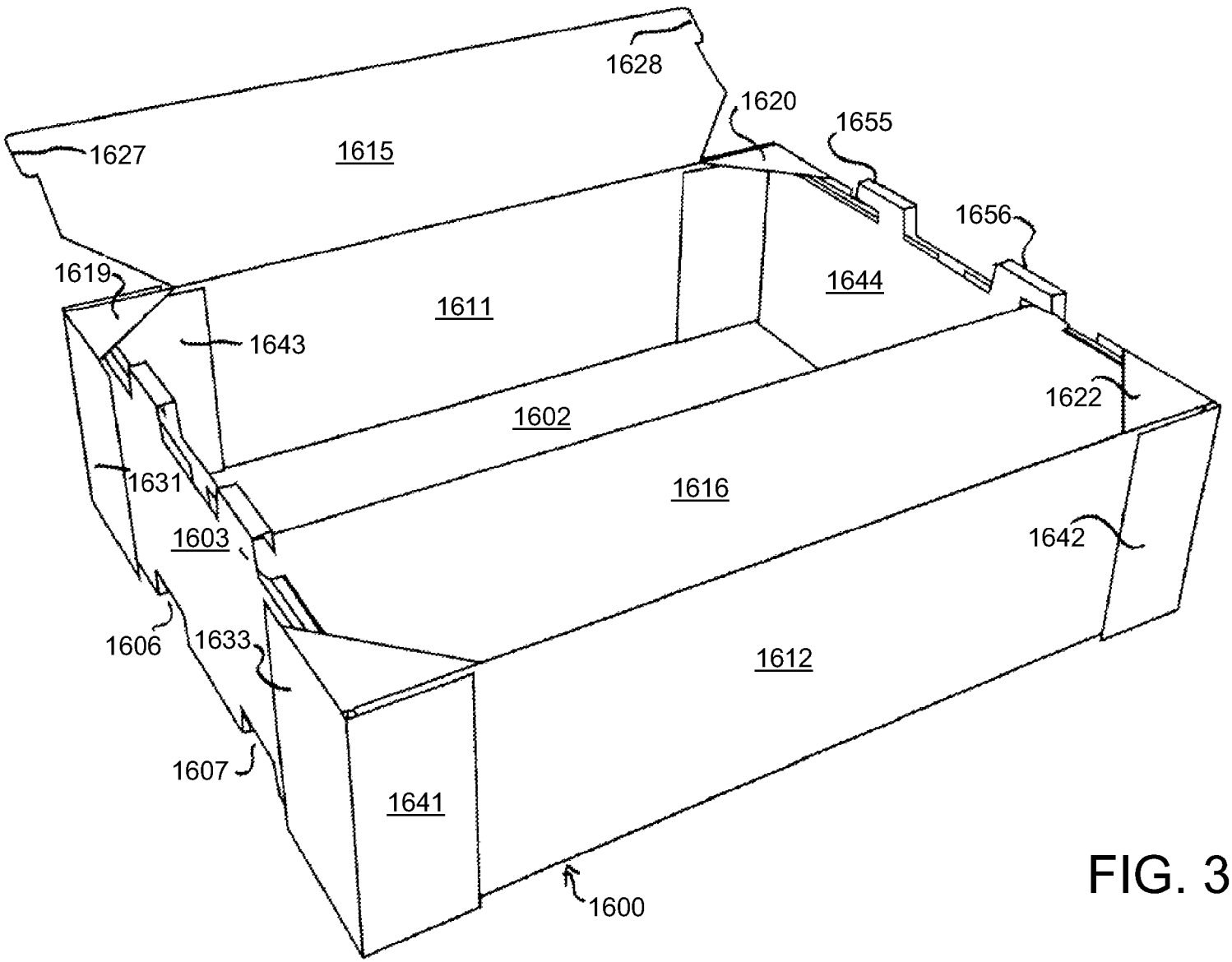
FIG. 36 is a simplified perspective view of a carton with integrated lid according to the embodiment of FIG. 35, shown in its erected configuration, with the top open prior to loading and sealing.

Carton 1600 of FIGS. 35-36 is formed from blank 1601, and has bottom panel 1602; outer side panels 1603, 1604; fold line 1605, interrupted by stacking openings 1606, 1607; fold line 1608, interrupted by stacking openings 1609, 1610; end panels 1611, 1612; fold lines 1613, 1614; top panels 1615, 1616; fold lines 1617, 1618; top corner panels 1619-1622; through-cuts 1623-1626 (which may be replaced by perforations); locking tabs 1627-1630; first overlap panels 1631-1634; fold lines 1635-1638; second overlap panels 1639-1642; inner side panels 1643, 1644; web double fold lines 1645-1648; outer side panel stacking tabs 1649-1652; notched inner side panel stacking tabs 1653-1656; minor flaps 1658-1661; fold lines 1662-1664; minor flaps 1665-1668; double fold lines 1669-1672; and stacking notches 1673-1680. For a corrugated paperboard blank, the preferred direction of the flutes is indicated by the double arrow in FIG. 35.

In carton 1600, the structure mode of operation and manner of affixation of certain panels to other panels is substantially similar to that of the embodiment of carton 1500, except that the panels emanating from the ends of the inner side panels are elongated so as to be folded back upon outwardly facing surfaces of the inner side panels. Thus, panels 1665, 1666 are captured between panels 1603 and 1643, and panels 1667 and 1668 are captured between panels 1604 and 1664. This sandwiching of panels is evidenced in FIG. 36, particularly on the left end of the carton where outer side panel 1603 and inner side panel 1643 capture between them panels 1665 and 1666.

Figure 37:
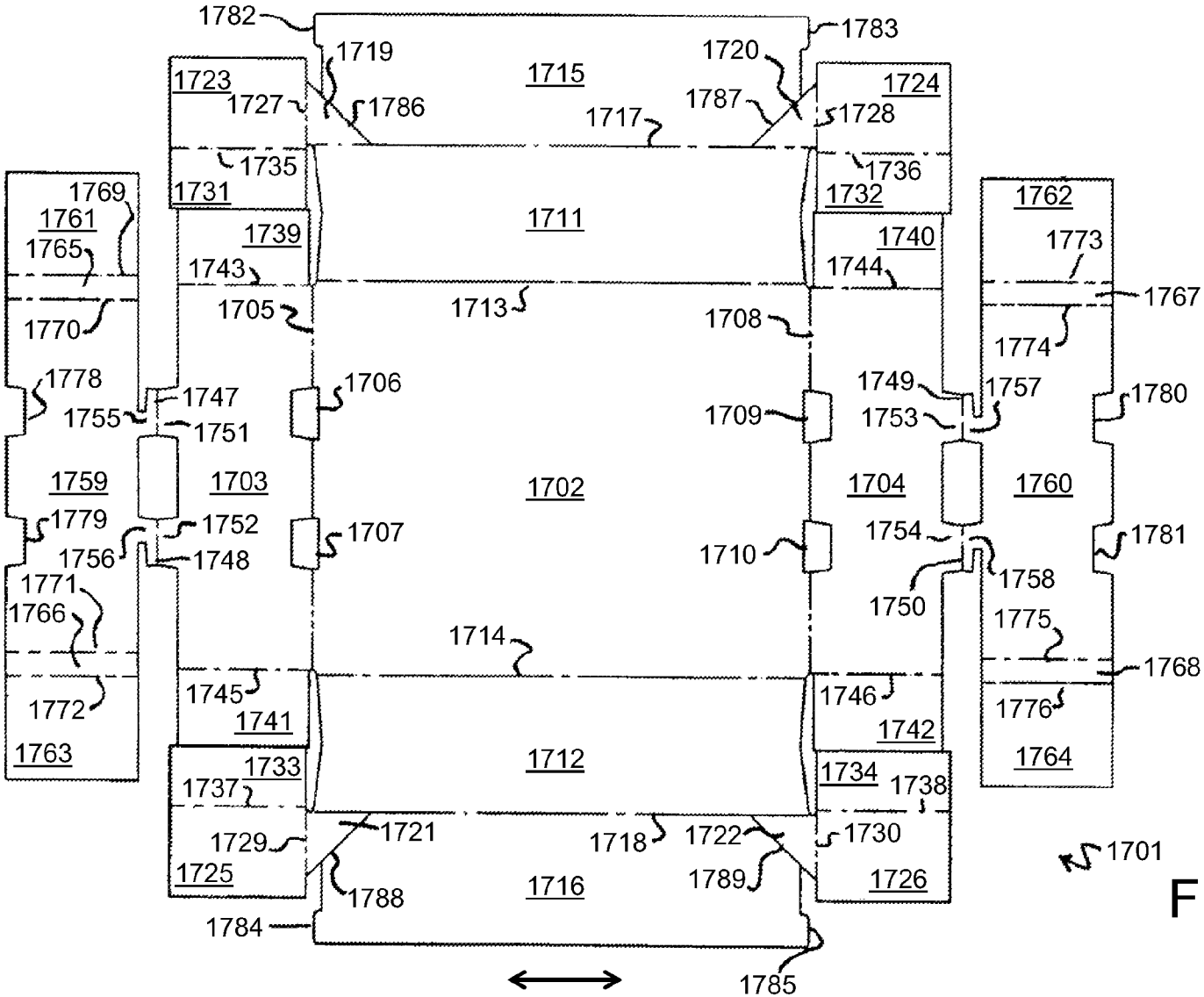
FIG. 37 is a plan view of a blank of a carton with integrated lid according to another preferred embodiment of the invention.
Figure 38:
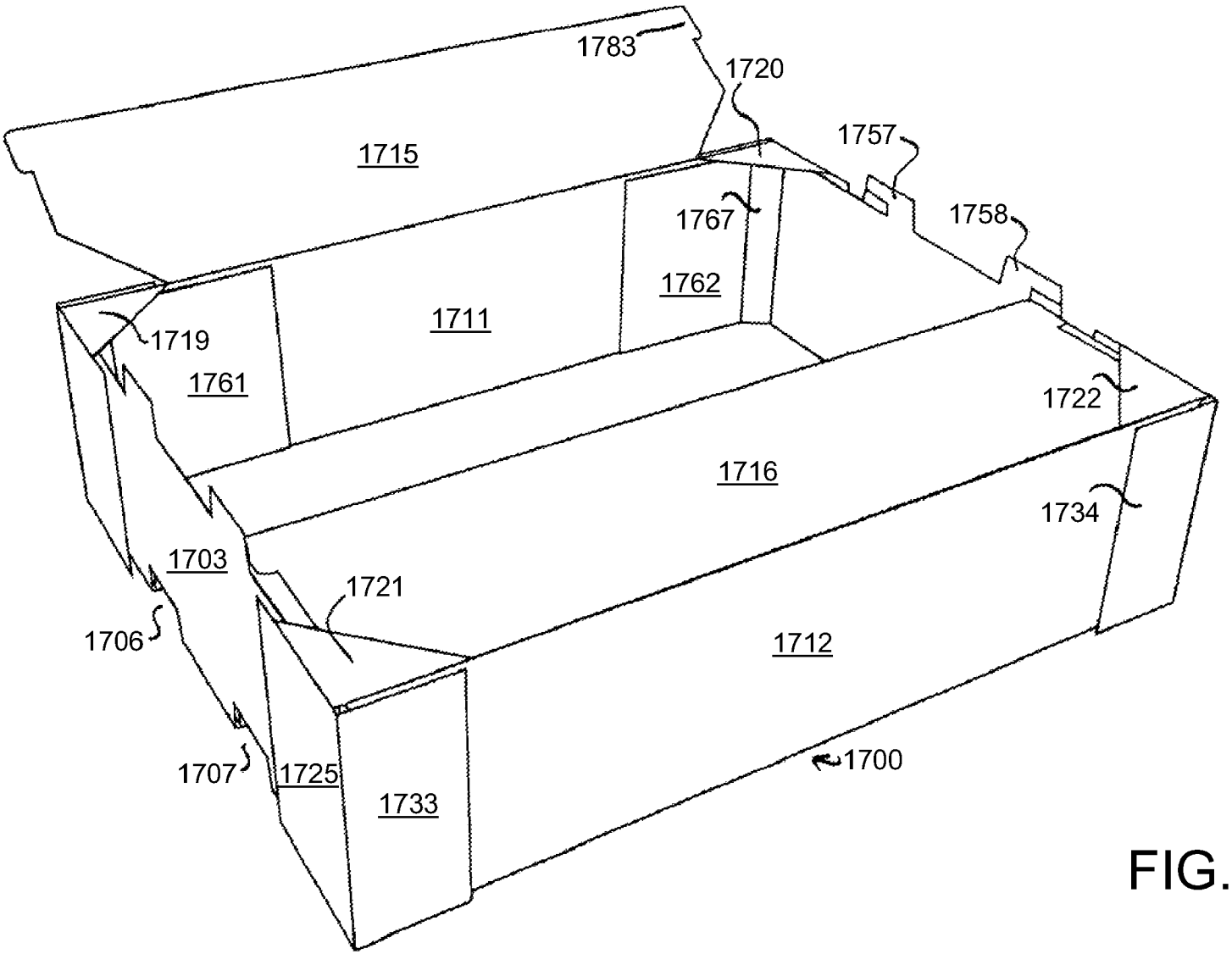
FIG. 38 is a simplified perspective view of a carton with integrated lid according to the embodiment of FIG. 37, shown in its erected configuration, with the top open prior to loading and sealing.

Carton 1700 is illustrated in FIGS. 37-38. For a corrugated paperboard blank, the preferred direction of the flutes is indicated by the double arrow in FIG. 37. Blank 1701 includes bottom panel 1702; outer side panels 1703, 1704; fold line 1705 interrupted by stacking openings 1706, 1707; fold line 1708 interrupted by stacking openings 1709, 1710; end panels 1711, 1712; fold lines 1713, 1714; top panels 1715, 1716; fold lines 1717, 1718; top corner panels 1719-1722; through-cuts 1786-1789; first overlap panels 1723-1726; fold lines 1727-1730; second overlap panels 1731-1734; fold lines 1735-1738; minor flaps 1739-1742; fold lines 1743-1746; web fold lines 1747-1750; outer side panel stacking tabs 1751-1754; inner side panel stacking tabs 1755-1758; inner side panels 1759, 1760; minor flaps 1761-1764; gusset panels 1765-1768; fold lines 1769-1776; stacking notches 1778-1781; and locking tabs 1782-1785.

Carton 1700 is substantially similar to cartons 1600, except that gusset panels are provided adjacent inside side panels 1759 and 1760 with minor flaps 1739-1742 being adhered to inside surfaces of end panels 1711, 1712 and minor flaps 1761-1764 being affixed to inside minor flaps 1739-1742. The closure mechanism for carton 1700 is the same as it is for carton 1600.

Carton 1800 (FIGS. 39-40) includes self-locking top panels as well as interior corner supports. For a corrugated paperboard blank, the preferred direction of the flutes is indicated by the double arrow in FIG. 39. Blank 1801 includes bottom panel 1802; end panels 1803, 1804; fold line 1805, interrupted by stacking openings 1806, 1807; fold line 1808, interrupted by stacking openings 1809, 1810; outer side panels 1811, 1812; fold line 1813, interrupted by stacking openings 1814, 1815; fold line 1816, interrupted by stacking openings 1817, 1818; notched stacking tabs 1819-1822; side end panels 1823, 1824; double fold lines 1825, 1826; stacking notches 1827-1830; gusset panels 1831-1834; fold lines 1835-1838; minor flaps 1839-1843; fold lines 1843-1846; minor flaps 1847-1850; fold lines 1851-1854; fold line 1855, interrupted by die-cut stacking tabs 1856, 1857; fold line 1858, interrupted by die-cut stacking tabs 1859, 1860; outer top panels 1861, 1862; top corner panels 1863-1866; through-cuts 1867-1870; overlap panels 1871-1874; fold lines 1875-1878; inner top panels 1879, 1880; fold lines 1881, 1882; locking tab receiving slots 1883-1886; and knock-outs 1887-1890 (surrounded by oval lines of perforations).

In carton 1801, the stacking tab structures are incorporated into the side and end panel structures, especially upon folding over of the inner side panels to the positions inside the outer side panels exposes the hooked stacking and closure tabs 1819-1822. Minor flaps 1847-1850 are affixed to inside surfaces of outer end panels 1803, 1804 and minor flaps 1839-1843 are affixed to minor flaps 1847-1850, while support panels 1871-1874 are affixed to outside surfaces of outer side panels 1811, 1812.

Figure 41:
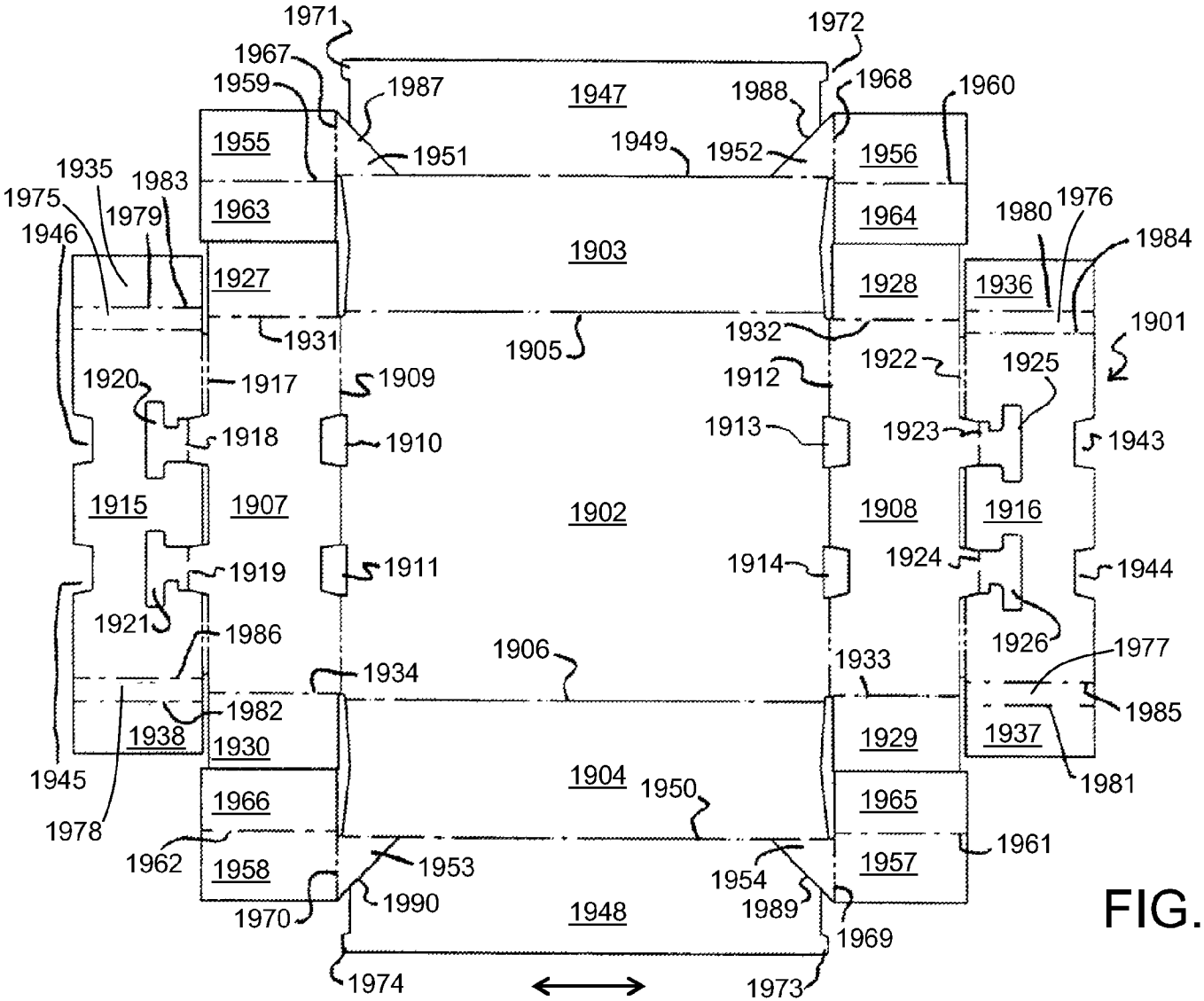
FIG. 41 is a plan view of a blank of a carton with integrated lid according to another preferred embodiment of the invention.
Figure 42:
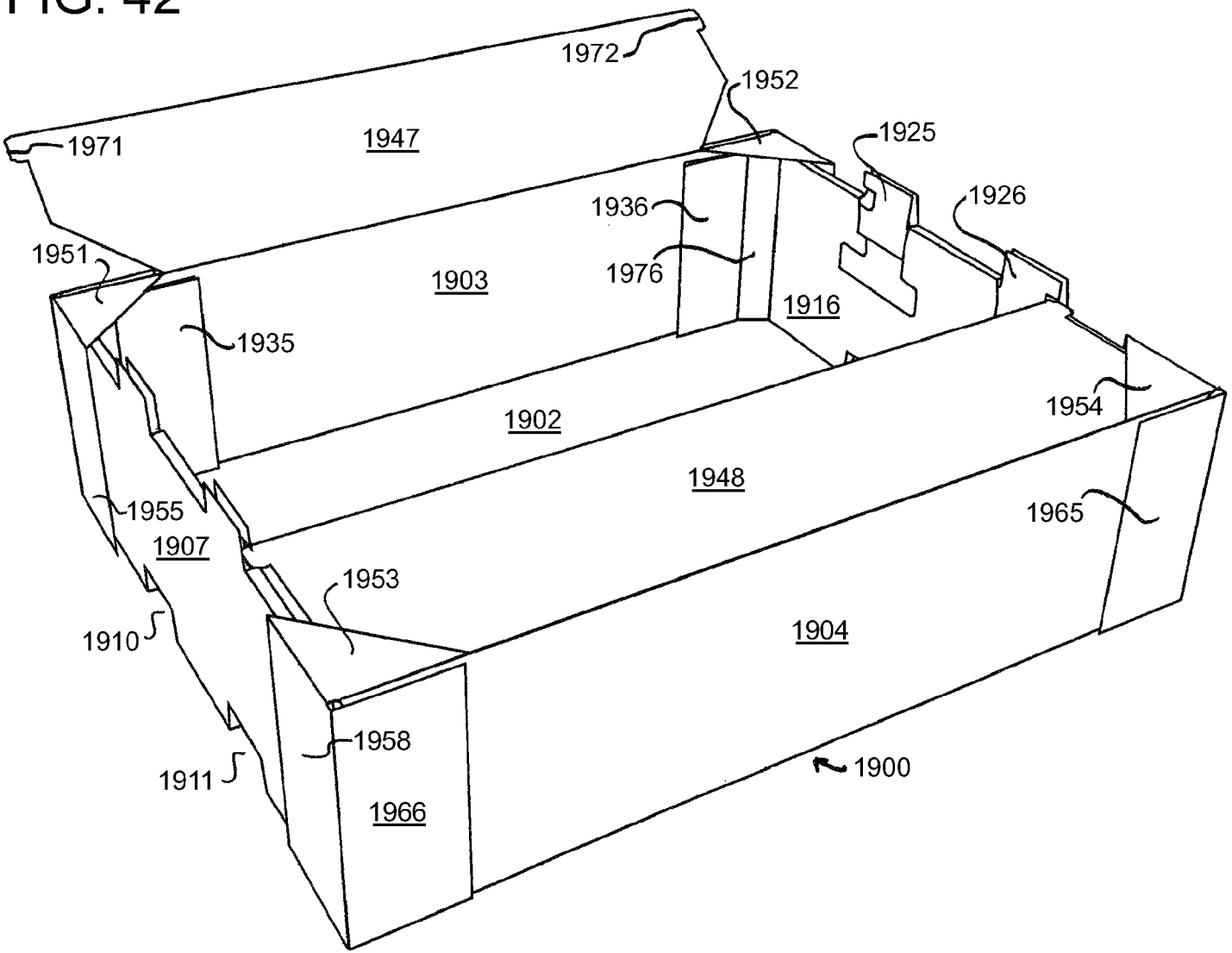
FIG. 42 is a simplified perspective view of a carton with integrated lid according to the embodiment of FIG. 41, shown in its erected configuration, with the top open prior to loading and sealing.
Figure 43:
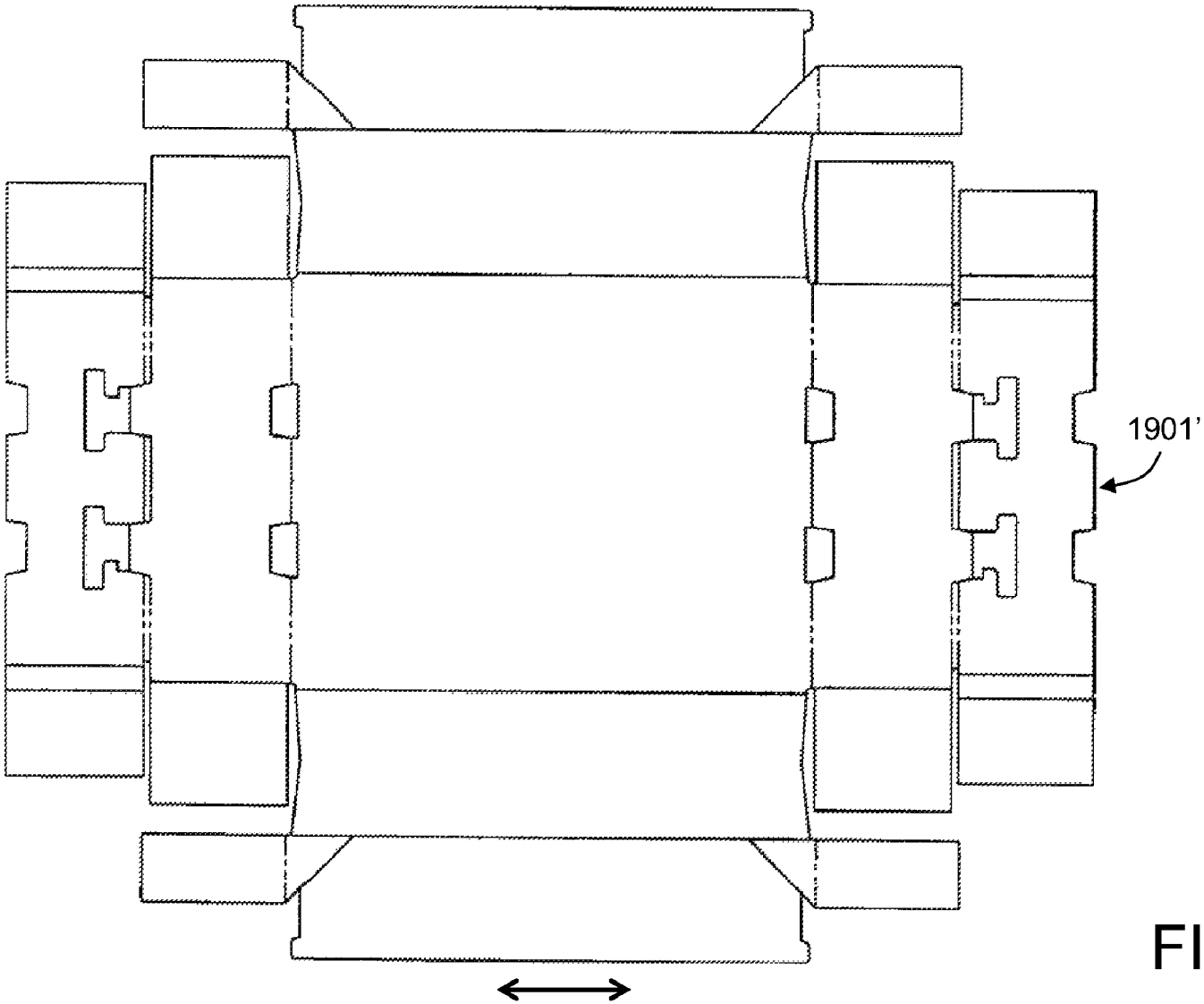
FIG. 43 is a plan view of a blank of a carton with integrated lid according to another preferred embodiment of the invention.
Figure 44:
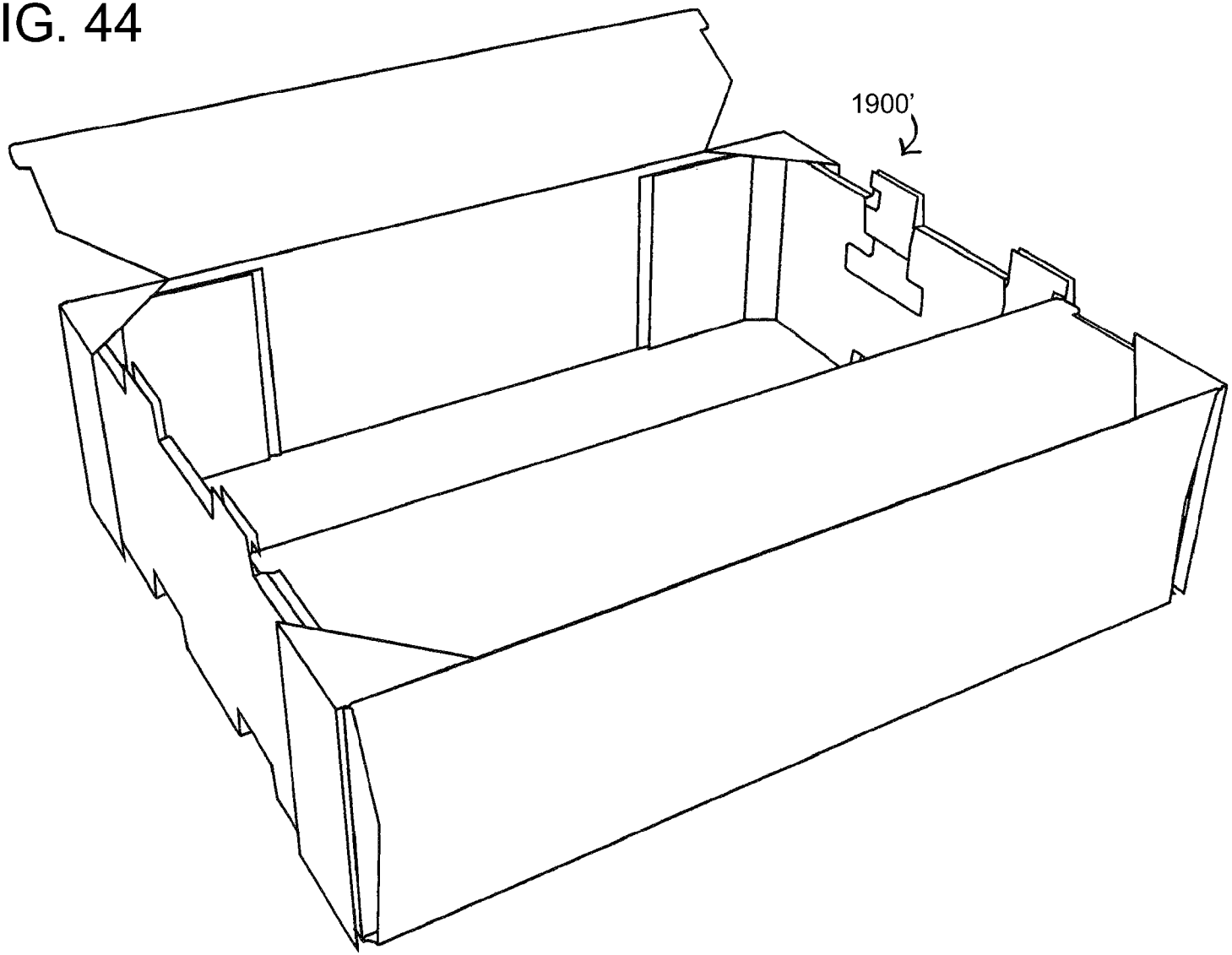
FIG. 44 is a simplified perspective view of a carton with integrated lid according to the embodiment of FIG. 43, shown in its erected configuration, with the top open prior to loading and sealing.

FIGS. 41-42 illustrate a covered tray with integral lid, and having stacking tabs. For a corrugated paperboard blank, the preferred direction of the flutes is indicated by the double arrow in FIG. 41. Covered tray 1900 is formed from blank 1901 (preferably bilaterally symmetrical), which includes bottom panel 1902, end panels 1903, 1904; fold lines 1905, 1906; outer side panels 1907, 1908; fold line 1909, interrupted by vent/stacking holes 1910, 1911; fold line 1912, interrupted by vent/stacking holes 1913, 1914; inner side panels 1915, 1916; double fold line 1917, interrupted by T-tab structures 1920, 1921 including offset tab fold lines 1918, 1919; double fold line 1922, interrupted by T-tab structures 1925, 1926 including offset tab fold lines 1923, 1924; outer side panel minor flaps 1927-1930; fold lines 1931-1934; inner side panel minor flaps 1935-1938; inner side panel notches 1943-1946; top panels 1947, 1948; fold lines 1949, 1950; top corner panels 1951-1954; first overlap panels 1955-1958; fold lines 1959-1962; second overlap panels 1963-1966; fold lines 1967-1970; top panel locking tabs 1971-1974, 671-674. Blank 1901 also includes gusset panels 1975-1978; fold lines 1979-1986; and through-cuts 1987-1990 (which may be substituted by perforations). An alternative embodiment of this carton, carton 1900', is shown in FIGS. 43-44, wherein blank 1901' is nearly identical to blank 1900, except that panels 1963-1966 have been omitted, and panels, corresponding to panels 1927-1930 in blank 1900, have been lengthened. For a corrugated paperboard blank, the preferred direction of the flutes is indicated by the double arrow in FIG. 43.

Carton 1900 features T-shaped stacking tabs similar to the embodiment of carton 600, with the notches for capturing locking tabs in the lid panels as in the embodiment of carton 1800. In carton 1900, inner side panel minor flaps 1927-1930 are adhered to inside surfaces of end panels 1903, 1904 and minor flaps 1935-1938 are adhered to outside minor flaps 1927-1930, such that gusset panels 1975-1978 extend diagonally across the corners of the interior volume. Second overlap panels 1963-1966 are adhered to outside surfaces of end panels 1903, 1904. As mentioned, top panels 1947, 1948 may be retained in place through the capture of locking tabs 1971-1974 which can be received in the notches in T-tab structures 1925, 1926, 1920 and 1921. As mentioned, carton 1900' is substantially identical in structure and mode of operation to carton 1900.

Figure 39:
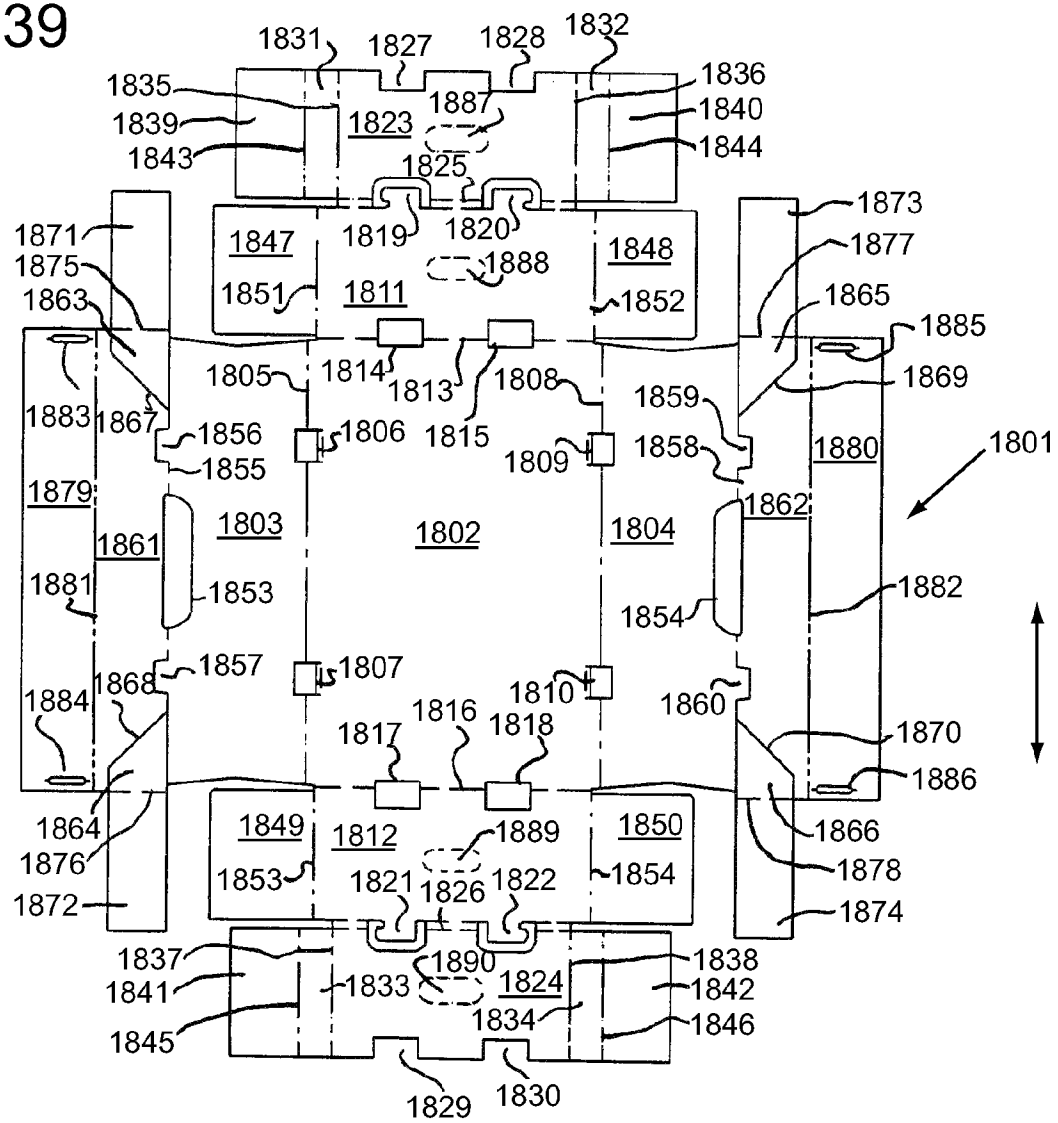
FIG. 39 is a plan view of a blank of a carton with integrated lid according to another preferred embodiment of the invention.
Figure 40:
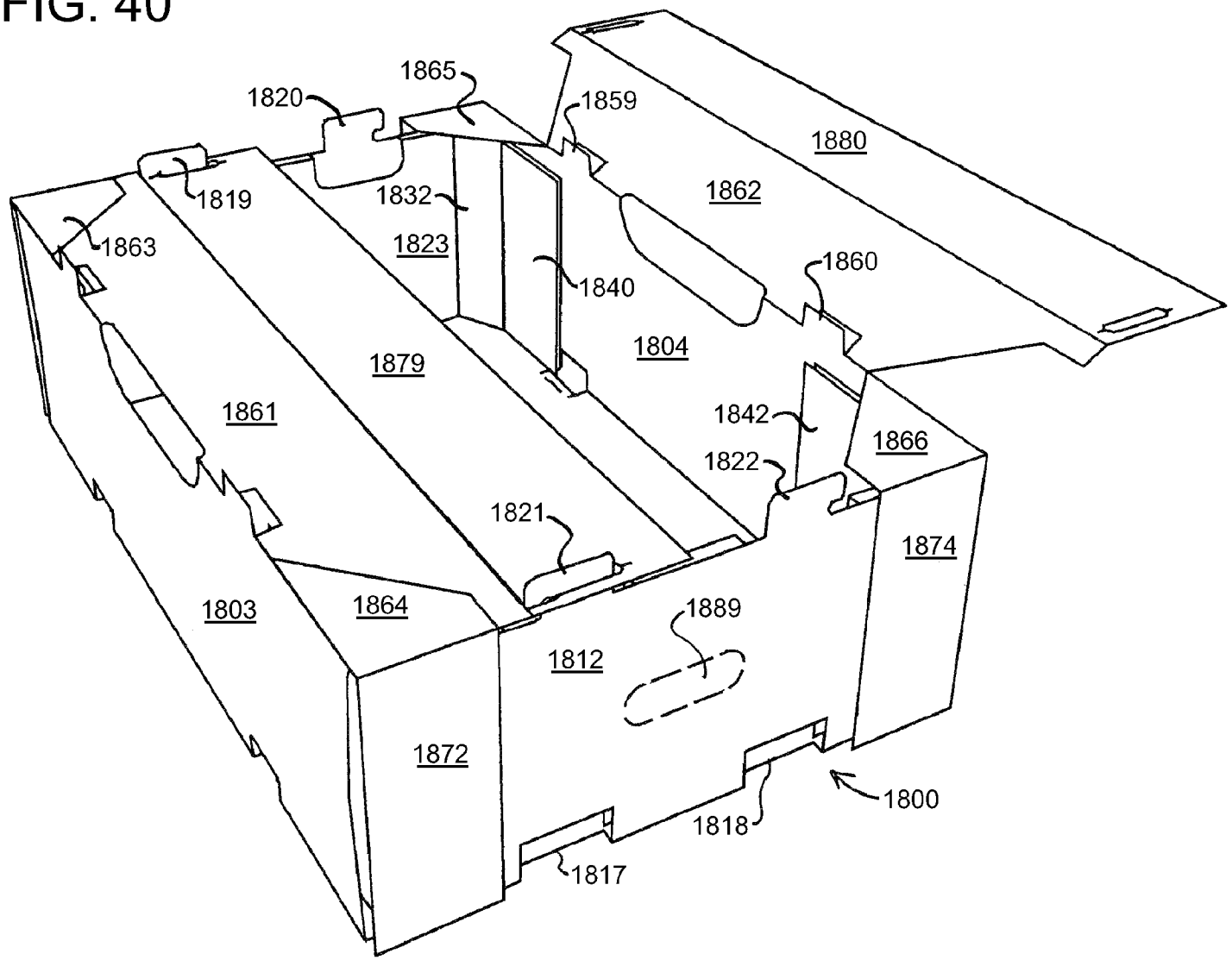
FIG. 40 is a simplified perspective view of a carton with integrated lid according to the embodiment of FIG. 39, shown in its erected configuration, with the top open prior to loading and sealing.
Figure 45:
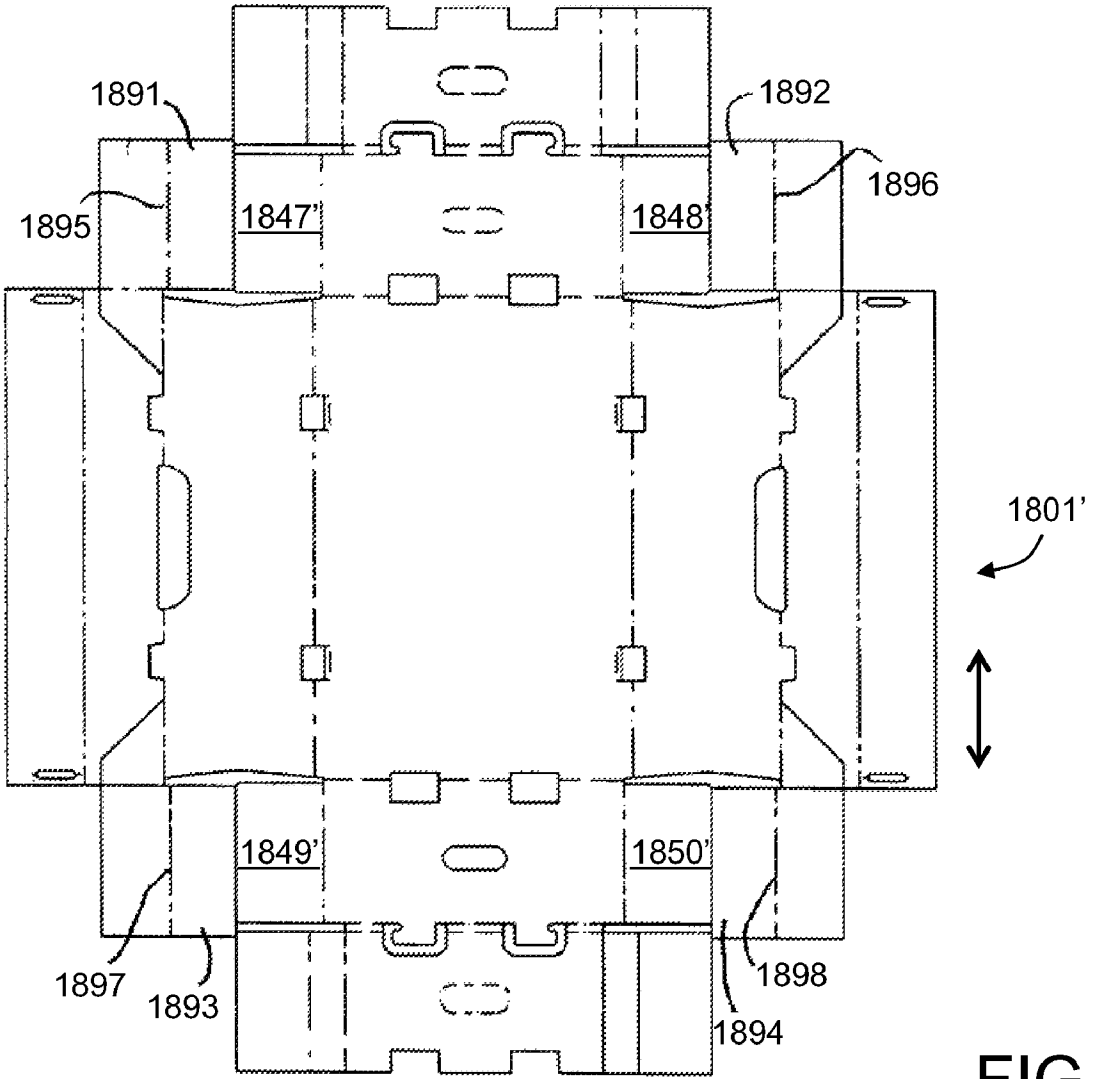
FIG. 45 is a plan view of a blank of a carton with integrated lid according to another preferred embodiment of the invention.
Figure 46:
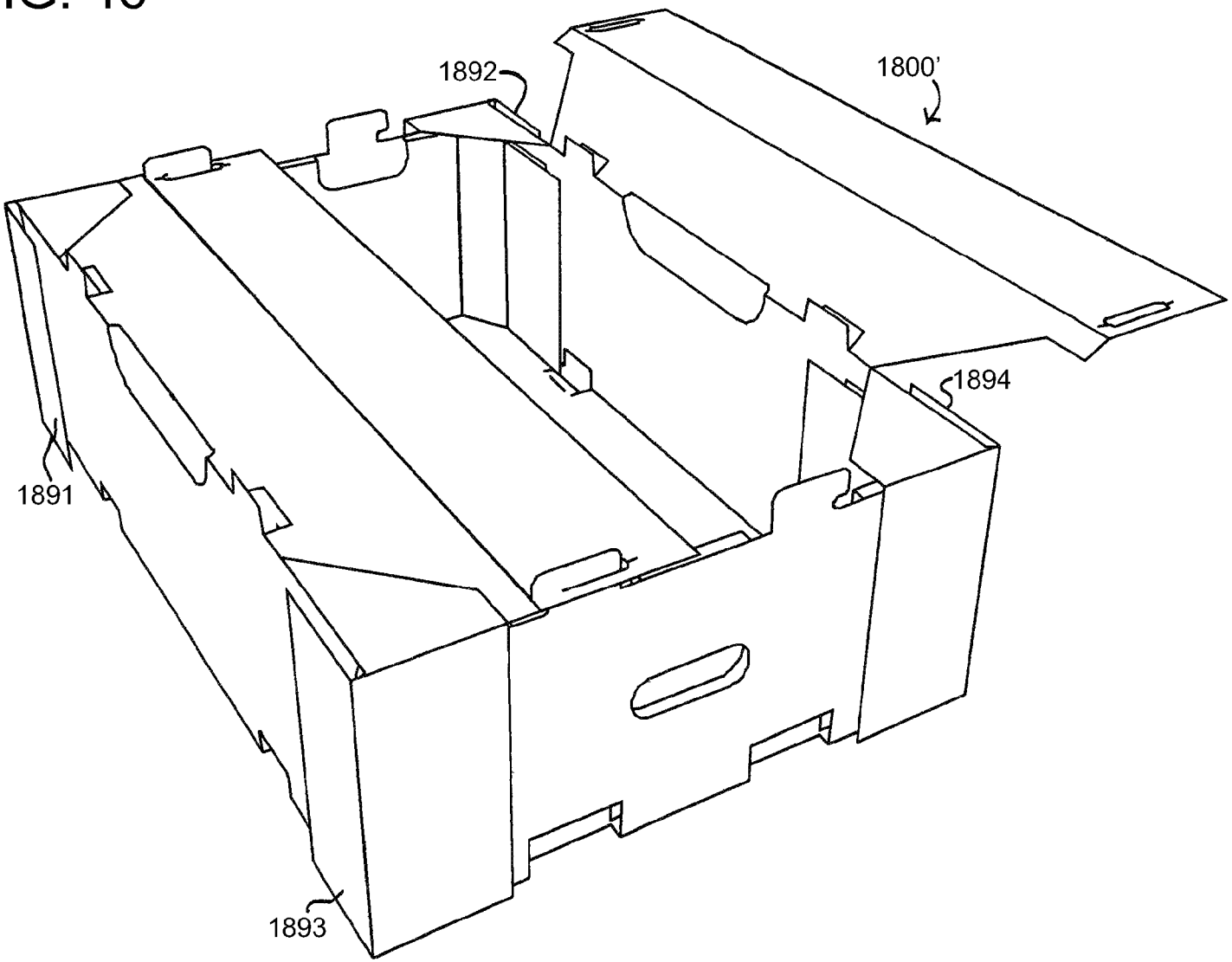
FIG. 46 is a simplified perspective view of a carton with integrated lid according to the embodiment of FIG. 45, shown in its erected configuration, with the top open prior to loading and sealing.

Carton 1800' of FIGS. 45-46 is substantially identical to carton 1800 of FIGS. 39-40, except that blank 1801' is provided with second overlap panels 1891-1894, along fold lines 1895-1898, and the shortening of panels 1847'-1850' as compared to panels 1847-1850 in blank 1801.

Although processes for forming and packing the foregoing cartons are provided specifically for the embodiments of FIGS. 1-2 and FIGS. 21-22, it is to be understood that one of ordinary skill in the art, having the present disclosure before them, would readily be able to modify existing carton forming equipment, using ordinary design and engineering skills, for the purposes of erecting, and subsequently sealing, the cartons, of each of the embodiments, without departing from the scope of the present invention, and without extensive experimentation.

The carton designs of the present invention permit the carton to be fully erected with all of the vertical inner and outer flaps and any attached flaps to be sealed and properly positioned for maximum stacking performance, but will allow a portion of the top flaps (horizontal) to be separated from the vertical outer end flaps so that access to the carton cavity can be accomplished for loading of product. Additional design features incorporated into the separated top flap feature allow the top flaps to be sealed or locked into position as desired after the product has been loaded.

As described herein, among the critical features that enable this invention to perform well is the strategic use of slits or perforations that separate the top horizontal panel (flap) from the end flaps of a tray or wrap design having full overlapping end flaps. These fully overlapping vertical end flaps may include additional (secondary) flaps which provide additional corner structures for added stack strength. Through the utilization of the slits or perforations (nicks), this permits the erecting machine to fully set up the carton's stacking features (inner and outer full overlapping flaps and inner and where applicable outer minor flaps), but allows the horizontal top flaps to remain free or only lightly attached (nicked) to the end flaps.

This allows user access to the carton cavity for loading of the products through either manual, man-machine interface, or automatic methods. In the situation in which a slit is used to separate the top and end structures, the carton can be effectively erected with the top flaps left in an upright position upon discharge from the erecting machine. In the situation in which nicks are used, keeping the top and end panels connected, the top flaps are in a horizontal or closed position upon discharge from the machine and opened, through the breaking of the nicks (either manually or mechanically) when desired. Final sealing or closure is accomplished with special features, such as slot and tab mechanisms, or through the use of additional material removed from the vertical end flaps and left attached to the horizontal top flaps (such as a flange), which is glued to the outer container walls to facilitate final closure when desired. These features, among others, permit this strategic use of the top flap panel, while protecting the important functions of the end flaps, can be applied to a number of container designs, as shown in the accompanying description and drawings.

The foregoing description and drawings merely explain and illustrate the invention, and the invention is not so limited as those skilled in the art who have the disclosure before them will be able to make modifications and variations therein without departing from the scope of the invention.

What is claimed is:

1. A carton comprising:

a bottom panel;

two side panels each emanating from opposing side edges of the bottom panel, each of the two side panels having a top edge;

two end panels each emanating from opposing end edges of the bottom panel, the opposing end edges of the bottom panel extending perpendicular to the opposing side edges of the bottom panel;

two minor panels associated with respective end edges of each of the two side panels, the minor panels affixed, at least indirectly, to an inside surface of an adjacent one of the two end panels for maintaining the two end panels and the two side panels in raised, upright orientation relative to the bottom panel, wherein the bottom panel, the two side panels, the minor panels and the two end panels define a cavity within the carton;

at least one top panel emanating from a top edge of one of the end panels, the at least one top panel movable between an open position and a closed position, wherein the at least one top panel forms at least a portion of a top wall at least partially covering the cavity when the at least one top panel is in the closed position;

at least two first outer overlap panels emanating at least indirectly from the at least one top panel;

at least two overlap panel connection structures each extending between the first outer overlap panel adjacent thereto and the at least one top panel, the at least two overlap panel connection structures configured to enable the at least two first outer overlap panels to be affixed in place without interfering with movement of the at least one top panel; and a second outer overlap panel emanating from a side edge of each of the at least two first outer overlap panels and operably positioned in substantially parallel, at least partially overlying relation to an exterior surface of at least one of the minor panels.

2. A carton in accordance with claim 1, further comprising at least one cut-out extending upwardly from each of the end edges of the bottom panel, the at least one cut-out extending into at least a portion of at least one end of the two end panels.

3. A carton in accordance with claim 1, further comprising stacking tabs emanating upwardly from the top edge of at least one of a side panel of the two side panels and an end panel of the two end panels.

4. A carton in accordance with claim 1, wherein each first outer overlap panel is in overlying relation to an adjacent side panel of the two side panels.

5. A carton in accordance with claim 1, wherein each second outer overlap panel is folded relative to its respective first outer overlap panel and positioned in substantially parallel, at least partially overlying relation to the exterior surface of at least one of the minor panels.

6. A carton in accordance with claim 1, wherein the at least one top panel is operably positioned upon articulation in substantially spaced, parallel, overlying relation to at least a portion of the bottom panel, the at least one top panel, being substantially maintained in said overlying position over at least a corner region of the carton when positioned in the substantially spaced, parallel, overlying relation to the at least a portion of the bottom panel.

7. A carton in accordance with claim 6, wherein each corner region of the carton is defined by one of the two side panels, one of the minor panels and one of the two end panels.

8. A carton in accordance with claim 1, further comprising:

stacking tabs emanating upwardly from the top edges at least one of the side panels and the end panels; and stacking tab apertures disposed in at least one of the bottom panel, bottom edge regions of the side panels, and bottom edge regions of the end panels, wherein each stacking tab aperture of the carton is configured to receive a corresponding stacking tab of a second carton when the carton is positioned on top of the second carton.

9. A carton in accordance with claim 1, wherein each minor panel of the two minor panels comprises a miter panel and an inner end panel, the inner end panel affixed at least indirectly to the inside surface of the adjacent one of the two end panels.

10. A carton comprising:

a bottom panel having at least a first side edge region and at least a first end edge region;

at least a first side panel having at least a first minor flap emanating from an end edge of the at least first side panel operably connected to the at least first side edge region of the bottom panel;

at least a first end panel operably connected to the at least first end edge region of the bottom panel, wherein the at least first side panel, the at least first minor flap, and the at least first end panel being operably arranged with respect to one another to define at least a first corner region of the carton;

at least one top panel connected to the first end panel and operably positioned in an open position and a closed position, the at least one top panel being substantially maintained in said overlying position over the at least first corner region when positioned in the closed position; and at least one corner support assembly operably emanating from the at least one top panel and configured to provide vertical loading support for the carton, wherein said at least one corner support assembly comprises:

a first outer overlap panel operably emanating from the at least one top panel and being operably positioned in substantially parallel, at least partially overlying relation to an outer surface of the first side panel;

a second outer overlap panel emanating from a side edge of said first outer overlap panel, said second outer overlap panel being folded relative to said first outer overlap panel and operably positioned in substantially parallel, at least partially overlying relation to an exterior surface of the at least first minor flap; and an overlap panel connection structure extending between the at least one top panel and the first outer overlap panel, wherein said overlap panel connection structure is configured to enable the first outer overlap panel to be affixed in place without interfering with movement of the at least one top panel.

11. A carton in accordance with claim 10, further comprising:

stacking tabs emanating upwardly from a top edge of at least one of said at least first side panel and said at least first end panel; and stacking tab apertures disposed in at least one of the bottom panel, bottom edge regions of the at least first side panel, and bottom edge regions of the at least first end panel, wherein each stacking tab aperture of the carton is configured to receive a corresponding stacking tab of a second carton when the carton is positioned on top of the second carton.

12. A carton in accordance with claim 10, wherein each minor panel of the two minor panels comprises a miter panel and an inner end panel, the inner end panel affixed at least indirectly to an inside surface of the adjacent one of the two end panels.

13. A blank of sheet material for forming a carton, said blank comprising:

a bottom panel;

two side panels each emanating from opposing side edges of the bottom panel;

two end panels each emanating from opposing end edges of the bottom panel, the opposing end edges of the bottom panel extending perpendicular to the opposing side edges of the bottom panel;

two minor panels each emanating from respective end edges of each of the two side panels, wherein a first of the two side panels, a first of the two end panels and a first of the two minor panels emanating from the first of the two side panels forms a first corner region upon articulation of the blank;

at least one top panel emanating from a top edge of one of the two end panels, the at least one top panel moveable between an open position and a closed position, wherein the at least one top panel forms at least a portion of a top wall at least partially covering the first corner region upon articulation of the blank;

at least two first outer overlap panels emanating at least indirectly from the at least one top panel;

at least two overlap panel connection structures each extending between the first outer overlap panel adjacent thereto and the at least one top panel, the at least two overlap panel connection structures configured to enable the at least two first outer overlap panels to be affixed in place without interfering with movement of the at least one top panel; and a second outer overlap panel emanating from a side edge of each of the at least two first outer overlap panels, each second outer overlap panel being operably positionable in substantially parallel, at least partially overlying relation to at least one of the minor panels.

14. A blank in accordance with claim 13, wherein each minor panel of the two minor panels comprises a miter panel and an inner end panel, the inner end panel affixed at least indirectly to an inside surface of the adjacent one of the two end panels.

* * * * *